US007874656B2

(12) United States Patent
Ota et al.

(10) Patent No.: US 7,874,656 B2
(45) Date of Patent: Jan. 25, 2011

(54) INK-FEEDING DEVICE AND PRESSURE-GENERATING METHOD

(75) Inventors: Noritaka Ota, Ibaraki (JP); Yuichi Takahashi, Ibaraki (JP); Daisuke Nakamura, Ibaraki (JP); Takeshi Miura, Ibaraki (JP); Kazuo Haida, Ibaraki (JP)

(73) Assignee: Canon Finetech Inc., Ibaraki (JP)

( * ) Notice: Subject to any disclaimer, the term of this patent is extended or adjusted under 35 U.S.C. 154(b) by 629 days.

(21) Appl. No.: 11/281,927

(22) Filed: Nov. 16, 2005

(65) Prior Publication Data

US 2006/0132554 A1 Jun. 22, 2006

(30) Foreign Application Priority Data

Dec. 10, 2004 (JP) ..... 2004-357745
Apr. 28, 2005 (JP) ..... 2005-132031
May 23, 2005 (JP) ..... 2005-149319

(51) Int. Cl.
*B41J 2/175* (2006.01)

(52) U.S. Cl. ..... 347/85

(58) Field of Classification Search ..... 347/84, 347/85, 89; 141/2, 18
See application file for complete search history.

(56) References Cited

U.S. PATENT DOCUMENTS 4,380,770 A * 4/1983 Maruyama ..... 347/29
4,433,341 A * 2/1984 Thomas ..... 347/6
4,435,719 A * 3/1984 Snaper ..... 347/82
4,680,696 A * 7/1987 Ebinuma et al. ..... 347/85
4,737,801 A * 4/1988 Ichihashi et al. ..... 347/85
5,291,215 A * 3/1994 Nozawa et al. ..... 347/18
5,520,108 A * 5/1996 Hasegawa et al. ..... 101/121
5,757,399 A * 5/1998 Murayama et al. ..... 347/32
5,880,748 A * 3/1999 Childers et al. ..... 347/6
5,963,237 A * 10/1999 Ikkatai et al. ..... 347/85
5,967,045 A 10/1999 Staiger et al.
6,805,437 B2 * 10/2004 Yamanaka et al. ..... 347/92

FOREIGN PATENT DOCUMENTS

JP S62-023759 A 1/1987
JP 11-342630 A 12/1999
JP 2002-522724 A 8/2002
JP 2003-182104 A 7/2003

* cited by examiner

*Primary Examiner*—Anh T. N. Vo
(74) *Attorney, Agent, or Firm*—patenttm.us

(57) ABSTRACT

An ink-feeding device is provided in which the pressure applied to the ink in the printing head can be adjusted arbitrarily irrespective of the relative positions of the ink container and the printing head. Inside the sub-tank 80, a pressure-adjusting pump 82 is installed for applying a suitable pressure to many nozzles 22Kn of the printing head 22K. This pressure-adjusting pump 82 is placed a little above the bottom face of the sub-tank 80 at a prescribed distance from the bottom face. Thereby the pressure-adjusting pump 82 is immersed in the ink held in the sub-tank 80. A drive unit 83 for driving the pressure-adjusting pump 82 is placed above the sub-tank 80. On the upper wall of the sub-tank 80, an air-vent valve 84 is fixed to bring the inside pressure in the sub-tank 80 to an atmospheric pressure. The inside pressure in the sub-tank 80 is made equal to the atmospheric pressure by opening the air-vent valve 84.

25 Claims, 39 Drawing Sheets

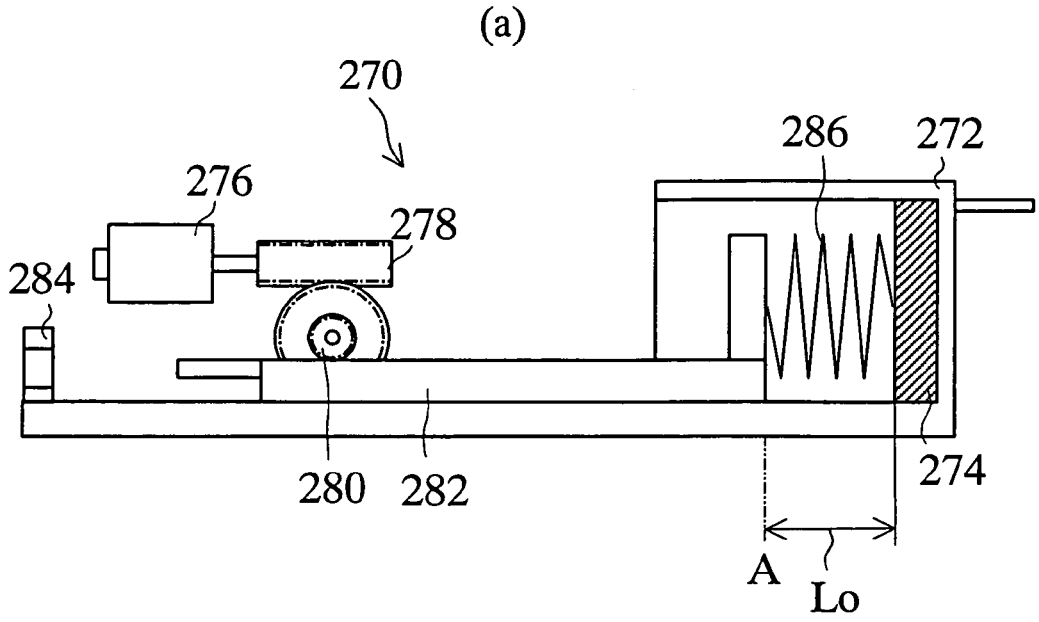
Fig.18
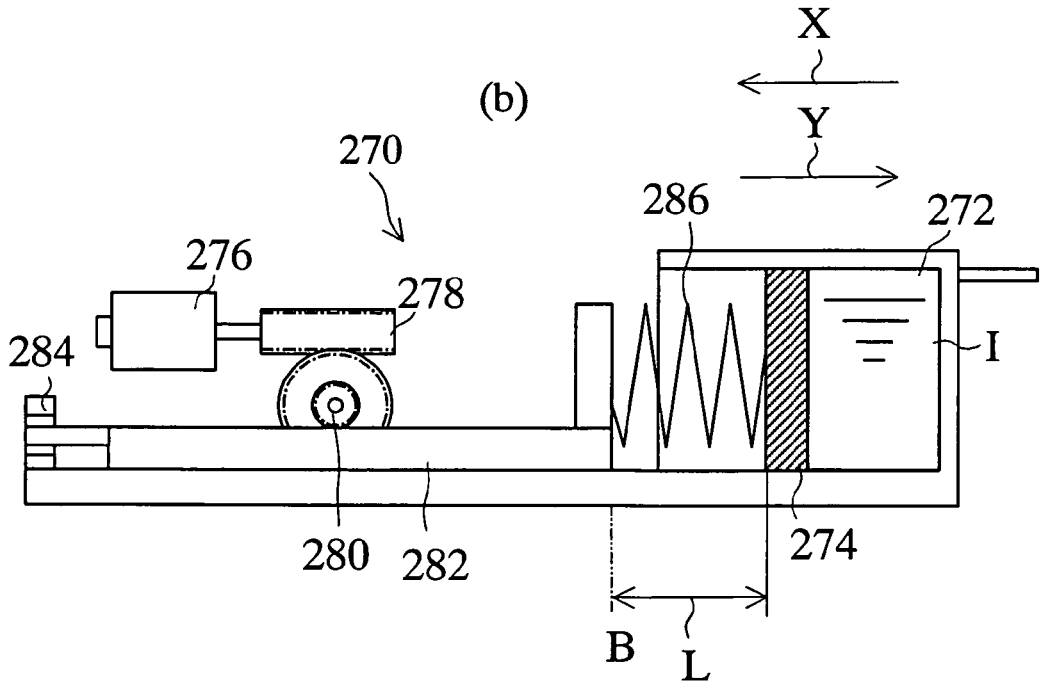

(a)

(b)

(a)

(b)

INK-FEEDING DEVICE AND PRESSURE-GENERATING METHOD

TECHNICAL FIELD

The present invention relates to an ink-feeding device for feeding an ink to a printing head for ejecting an ink, and relates also to a method for generating a pressure in the printing head.

TECHNICAL BACKGROUND

Inkjet types of image-forming apparatuses (inkjet recording apparatuses) are known which form an image by ejecting an ink through a printing head onto a recording medium. Generally, the inkjet image-forming apparatus is capable of forming a highly fine image by employing a small printing head having ink-ejection nozzles in a high nozzle density. The inkjet image-forming apparatus is capable of forming a color image on a recording medium by employing a plurality of the small printing heads and using different color inks for the printing heads with a less expensive smaller constitution. Owing to the above advantages, the inkjet image-forming apparatuses are widely used as various image output apparatuses such as printers, facsimiles, and copying machines for business uses and home uses.

In the above inkjet image-forming apparatuses, it is important to keep the ink in the printing head at a prescribed negative pressure (to keep the pressure exerted on the ink in the printing head to be negative) for stabilizing the ejection operation of the ink through the printing head. For this purpose, generally, a negative pressure-generating means is installed in the ink-feeding system for feeding the ink to the printing head, and the ink kept at the negative pressure by the negative pressure-generating means is fed to the printing head.

A known negative pressure-generating means generates a negative pressure by utilizing capillary action of an ink-absorbing sponge enclosed in the ink tank (e.g., Japanese Patent Application Laid-Open No. 2002-1988). Another known negative pressure-generating means has an energizing means like a spring for energizing outward a flexible member constituting at least a part of an ink tank (e.g., Japanese Patent Application Laid-Open No. 06-155759). A still another known negative pressure-generating means has an ink tank placed below a printing head to apply a negative pressure by utilizing the water head difference (e.g., Japanese Patent Application Laid-Open No. 2003-1844).

The ink kept at a negative pressure by a negative pressure-generating means is fed by suction from the ink tank to a printing head by pressure difference from the negative pressure caused by ink ejection through the printing head. Thereby, the inside of the printing head is kept at a negative pressure constantly.

DISCLOSURE OF THE INVENTION

In the ink-feeding system having the aforementioned negative pressure-generating means, ink ejection from the printing head makes the pressure in the printing head more negative, and the increased negative pressure introduces the ink from an ink tank into the printing head by utilizing the pressure difference. Therefore, when the amount of the ink ejected from the printing head per unit time is increased suddenly, the ink feed cannot follow the increase, which may result in increase of the negative pressure in the printing head (the negative pressure applied to the ink in the printing head becomes more than the prescribed pressure). Conversely, when the amount of the ink ejected from the printing head per unit time is decreased suddenly, the negative pressure can be decreased by inertia of the ink. (The negative pressure applied to the ink in the printing head becomes less than the prescribed pressure.)

Such fluctuation of the negative pressure in the printing head may make instable the ink ejection from the printing head to lower the quality of the recorded image. In particular, in printing apparatuses for industrial uses for printing an image at a high speed on a large recording medium, the amount of the ink ejected from the printing head per unit time varies widely, which can cause fluctuation of the negative pressure in the printing head. Therefore, the fluctuation of the negative pressure in the printing head should be minimized to keep high recording quality.

Similarly, in printing apparatuses for industrial uses for printing an image at a high speed on a large recording medium, to apply a negative pressure by water head difference, generally another ink tank (hereinafter referred to as a sub-tank) is installed at a position between the replaceable ink tank and the printing head and lower than the printing head. However, for utilizing the water head difference, the relative positions of the sub-tank and the printing head are limited as mentioned above, which decreases significantly the freedom degree in constituting the entire apparatus.

Under the aforementioned circumstance, the present invention intends to provide an ink-feeding device in which the pressure acting on an ink in a printing head can be kept within a suitable range irrespectively of relative positions of the ink container and the printing head, and to provide a method for generation of the pressure for the ink-feeding device.

MEANS FOR SOLVING THE PROBLEM

A first embodiment of the ink-feeding device of the present invention, for achieving the above objects comprises an ink container for holding an ink to be fed to a printing head for ejecting an ink, and an ink flow channel for connecting the ink container to the printing head; and feeding the ink from the ink container through the ink flow channel to the printing head, wherein (1) the ink-feeding device has a pressure-adjusting means for adjusting the pressure in the printing head.

(2) A closing valve for closing the ink flow channel may be installed within the ink flow channel.

(3) The ink-feeding device may have a pressure sensor for detecting the pressure applied to the ink in the ink flow channel.

(4) The pressure-adjusting means may adjust the pressure in the printing head depending on the pressure detected by the pressure sensor.

(5) The pressure-adjusting means may adjust the pressure in the printing head depending on the amount of the ink ejected from the printing head per unit time.

(6) The pressure-adjusting means may utilize centrifugal force for applying the pressure to a fluid.

(7) The pressure-adjusting means may have a rotor for generating the above centrifugal force, and (8) may have a controlling means for controlling the rotation frequency of the rotor.

(9) The pressure-adjusting means may adjust the pressure by changing the position of the rotor.

(10) The pressure-adjusting means may have a position-changing means for changing the position of the rotor.

(11) The ink container may be a sub-tank which is placed within an ink-feeding channel connecting an ink tank demountable from the main body of the apparatus to the printing head and serves to hold a prescribed amount of the ink.

(12) The sub-tank may be placed to keep the surface of the ink in the sub-tank higher than the ink ejection outlet of the printing head.

(13) The pressure-adjusting means may be placed inside the sub-tank.

(14) The pressure-adjusting means may be placed inside the printing head.

(15) The pressure-adjusting means may have (15-1) a cylinder connected to the ink container, and (15-2) a piston for changing the volume of the cylinder.

(16) The cylinder may serve to charge or discharge the ink to or from the ink container by displacement of the piston.

(17) The pressure-adjusting means may have a motor for displacing the piston, and

(18) a gear for transmitting the driving force of the motor to the piston.

(19) The cylinder may serve to charge or discharge air to or from the ink container by displacement of the piston.

(20) The ink-feeding device may have a pressure sensor for detecting the pressure applied to the ink in the ink flow channel, and

(21) the pressure-adjusting means may serve to adjust the pressure in the printing head by changing the volume of the cylinder depending on the pressure detected by the pressure sensor.

(22) The pressure-adjusting means may be connected to the printing head.

(23) The pressure-adjusting means may control the pressure in the printing head with the ink flow channel kept unclosed.

A second embodiment of the ink-feeding device of the present invention, for achieving the above objects comprises an ink container for holding an ink to be fed to a liquid chamber of a printing head having a nozzle and communicating with the liquid chamber for ejecting the ink; and feeding the ink from the ink container to the liquid chamber, which comprises

(24) an ink circulation channel for circulating the ink between the ink container and the liquid chamber, and

(25) a circulation pump for circulating the ink through the ink circulation channel.

(26) The circulation pump may be placed within the ink circulation channel.

(27) The ink circulation channel may have (27-1) a first ink circulation channel connecting the ink container with the liquid chamber, and (27-2) a second ink circulation channel connecting the ink container with the liquid chamber at connection positions different from the connection positions of the first ink circulation channel.

(28) The ink-feeding device may have a closing valve for opening and closing the first ink circulation channel.

(29) The circulation pump may be placed in the first ink circulation channel.

(30) The ink-feeding device may have a closing valve for opening and closing the second ink circulation channel.

(31) The circulation pump may serve to circulate the ink in any of normal and reverse directions.

(32) The circulation pump may be a gear pump or a tube pump.

(33) The circulation pump may be capable of changing the flow rate of the ink circulating through the ink circulation channel.

(34) The ink-feeding device may have a pressure sensor for detecting a pressure applied to the ink in the liquid chamber.

(35) The circulation pump may be capable of changing the flow rate of the ink circulating through the ink circulation channel depending on the pressure detected by the pressure sensor.

(36) The circulation pump may be capable of changing the flow rate of the ink circulating through the ink circulation channel depending on the amount of the ink ejected from the printing head per unit time.

(37) The ink container may be placed so as to keep the surface of the ink in the ink container higher than the ink ejection outlet of the printing head.

A third embodiment of the ink-feeding device of the present invention, for achieving the above objects, comprises a tank for holding an ink and being connected to a nozzle of a printing head for ejecting the ink, and feeds the ink to the nozzle, comprising

(38) a pressure-controlling means for controlling the pressure in an upper space in the tank.

(39) An air-vent pipe is attached to the tank for communicating the above upper space with the open air.

(40) The pressure-controlling means may control the pressure in the upper space in the tank by charging or discharging air to or from the upper space.

(41) The pressure-controlling means may be placed in the upper space.

(42) The pressure-controlling means may be connected to the air-vent pipe outside the tank.

(43) The tank may be installed in plurality, and to the respective tanks, an air-vent pipe may be attached.

(44) The one pressure-controlling means may be connected to the respective air-vent pipes attached to the tanks.

(45) The pressure-controlling means may be a turbo type air fan, and may control the pressure of the upper space by changing the rotation frequency.

(46) The printing head may have a liquid chamber formed therein for holding the ink to be fed to the nozzle, and

(47) the tank may be a sub-tank for feeding the ink to the liquid chamber.

(48) The pressure-controlling means may control the pressure in the upper space depending on the amount of the ink ejected from the printing head per unit time during image formation.

(49) The pressure-controlling means may control the pressure in the upper space depending on the pressure detected by the pressure sensor for detecting the pressure in the printing head.

(50) The ink-feeding device may have an ink circulation channel for connecting the liquid chamber and the tank, and

(51) a circulation pump for circulating the ink through the ink circulation channel.

(52) The ink circulation channel may be constituted of two separate ink flow channels connecting the liquid chamber and the tank, and

(53) the circulation pump may be installed within at least one of the two ink flow channels.

(54) The circulation pump may serve to circulate the ink in any of normal and reverse directions.

The pressure-generating method of the present invention, for achieving the above objects of the present invention, for generating a pressure in a printing head of an ink-feeding device which has the printing head constituted of an ink-ejecting nozzle and a liquid chamber communicating to the nozzle, and an ink container for holding an ink to be fed to the liquid chamber; and feeds the ink from the ink container to the liquid chamber:

(55) the method comprising generating a pressure in the printing head by circulating the ink between the ink tank and the liquid chamber.

(56) The generated pressure may be changed by changing the amount of the circulated ink.

(57) The ink circulation channel for circulating the ink may be constituted of a first ink circulation channel connecting the ink container to the liquid chamber, and a second ink circulation channel connecting the ink container to the liquid chamber at positions different from the connecting positions of the first ink circulation channel, and a circulation pump is installed for circulating the ink through the first and the second ink circulation channel, and

(58) the ink is circulated through the first and the second circulation channels by driving the circulation pump.

(59) A pressure sensor may be installed for detecting the pressure applied to the ink in the liquid chamber, and

(60) the amount of the ink circulated through the ink circulation channel is changed depending on the pressure detected by the pressure sensor.

(61) The amount of the ink circulated through the ink circulation channel may be changed depending on the amount of the ink ejected from the printing head per unit time.

In this specification, the term "recording" (also called image formation) not only signifies formation of meaningful letters or figures and realization of information to be visible, but also includes formation of an image, a pattern, or the like and treatment of a medium.

The term "recording medium" (also called a sheet) signifies not only a paper sheet generally used in recording apparatuses, but also includes materials capable of receiving an ink such as cloth, plastics, films, metal plates, glass, ceramics, wood, and leather.

The term "ink" includes a variety of materials similarly as the above definition of the "recording", including liquids capable of forming an image, a pattern, or the like, and capable of fabricating a recording medium, or treating an ink (e.g., solidification or insolubilization of a colorant in an ink).

A first embodiment of the ink-feeding device of the present invention is capable of adjusting the pressure in the printing head by a pressure-adjusting means to adjust arbitrarily the pressure applied to the ink in the printing head irrespective of the placement positions of the ink container and the printing head. The pressure-adjusting means, which is capable of adjusting arbitrarily the pressure applied to the ink in the printing head, keeps the pressure at a constant negative pressure to improve the recording quality. Further, since the relative positions of the ink container and the printing head are not limited, the freedom degree in constructing the entire apparatus is increased.

A second embodiment of the ink-feeding device of the present invention allows an ink to circulate in an ink circulation channel by driving a circulation pump, whereby the ink circulates between an ink container and a liquid chamber. This circulation generates a negative pressure by a pressure loss in the ink circulation channel. The generated negative pressure is applied to the liquid chamber to keep the pressure acting on the ink in the printing head (ink in the nozzle) to be negative within a suitable range to improve the recording quality. Since the relative positions of the ink container and the printing head are not limited, the freedom degree in constructing the entire apparatus is increased. Further, a bubble existing in the ink in the liquid chamber can be removed from the liquid chamber by return of the ink by circulation to the ink container, which stabilizes more the ink ejection.

BRIEF DESCRIPTION OF THE DRAWINGS

FIG. 5(*a*), before start of the wiping operation; FIG. 5(*b*), immediately after end of the wiping operation; and FIG. 5(*c*), standby after the wiping operation.

FIG. 18(*a*) shows schematically a pressure-adjusting unit in a standby state. FIG. 18(*b*) shows schematically the pressure-adjusting unit during image formation.

FIG. 29(*b*) is an enlarged plan view of the space of the sub-tank of FIG. 29(*a*).

FIG. 39(*b*) is a perspective view of a sirocco fan.

BEST MODE FOR CARRYING OUT THE INVENTION

The device and method of the present invention is applicable to an inkjet printer which forms an image by ejecting an ink on a recording medium like a recording paper sheet.

Example 1

An example of the printer which incorporates the ink-feeding device of the present invention is explained by reference to FIG. 1.

Figure 1:
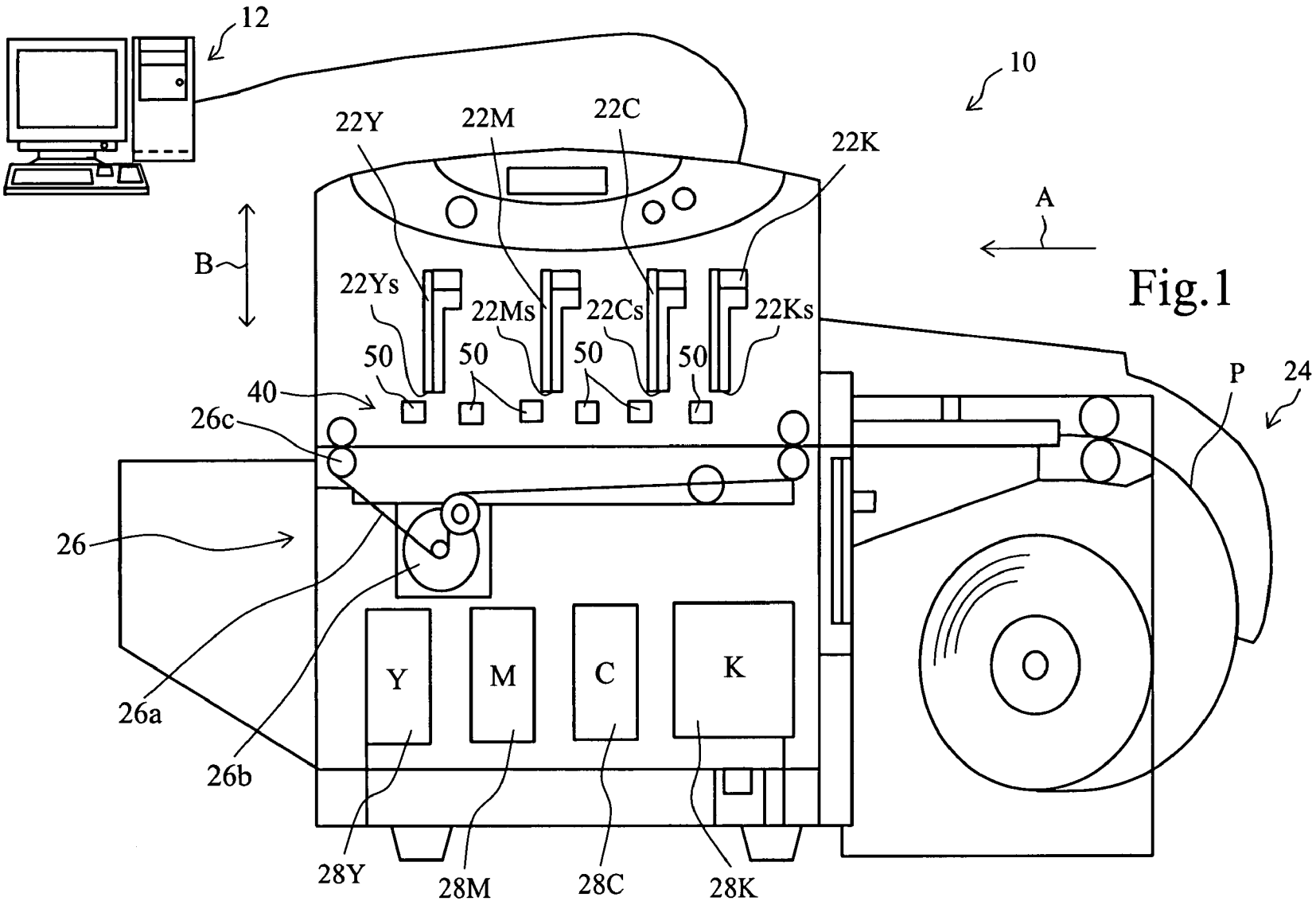
FIG. 1 is a schematic front view of a printer incorporating an ink-feeding device of the present invention.

FIG. 1 is a schematic front view of a printer incorporating an ink-feeding device of the present invention.

A printer 10 is connected to a host PC (personal computer) 12 for transmitting image information to this printer 10. In the printer 10, four printing heads 22K, 22C, 22M, 22Y are installed in a line in a direction (arrow-A direction) of delivery of a recording medium (a rolled paper sheet in this Example). The four printing heads 22K, 22C, 22M, 22Y eject respectively a color ink of black, cyan, magenta, or yellow. The four printing heads 22K, 22C, 22M, 22Y are so-called line-heads extending perpendicular to the paper sheet face of FIG. 1 (perpendicular to the arrow-A direction). The lengths of the four printing heads 22K, 22C, 22M, 22Y (length perpendicular to the paper sheet face of FIG. 1) are a little larger than the largest breadth of the recording medium for printing by the printer 10. These four printing heads 22K, 22C, 22M, 22Y are fixed not to move during the image formation.

For stable ink ejection from the four printing heads 22K, 22C, 22M, 22Y, a recovery unit 40 is incorporated into the printer 10. This recovery unit 40 recovers the initial ink ejection performance of the four printing heads 22K, 22C, 22M, 22Y. The recovery unit 40 has capping mechanisms 50 for removing an ink from ink-ejection outlet faces 22Ks, 22Cs, 22Ms, 22Ys of the four printing heads 22K, 22C, 22M, 22Y. The capping mechanism is installed independently for each of the four printing heads 22K, 22C, 22M, 22Y. In FIG. 1, the capping mechanisms are installed for six colors (i.e., six capping mechanisms 50). Two of the six mechanisms are spares for additional printing heads. The capping mechanism 50 is constituted of a blade, an ink-removing mechanism, a blade-holding member, a cap, and so forth.

A rolled paper sheet P is fed from a roll paper-feeding unit 24, and is delivered in the arrow-A direction by a delivery mechanism 26 incorporated into the printer 10. The delivery mechanism 26 is constituted of a delivery belt 26*a* for delivering the rolled paper sheet P thereon, a delivery motor 26*b* for driving the delivery belt 26*a*, a roller 26*c* for applying a tension to the delivery roller 26*a*, and so forth.

In formation of an image on the rolled paper sheet P, after the record-starting position of the delivered rolled paper sheet P reached the position below the black printing head 22K, selectively a black ink is ejected from the printing head 22K according to the recording data (image information). In the same manner, the respective color inks are ejected successively from printing heads 22C, 22M, 22Y in the named order to form a color image on the rolled paper sheet P. The printer 10 has, in addition to the aforementioned parts and members, main tanks 28K, 28C, 28M, 28Y for storing inks for feed to printing heads 22K, 22C, 22M, 22Y, pumps for feeding the inks to printing heads 22K, 22C, 22M, 22Y or for ink recovery (see FIG. 3), and so forth. The ink-feeding device of the present invention is constituted of the main tanks 28K, 28C, 28M, 28Y, and various pumps.

The electric system of the printer 10 is explained by reference to FIG. 2.

Figure 2:
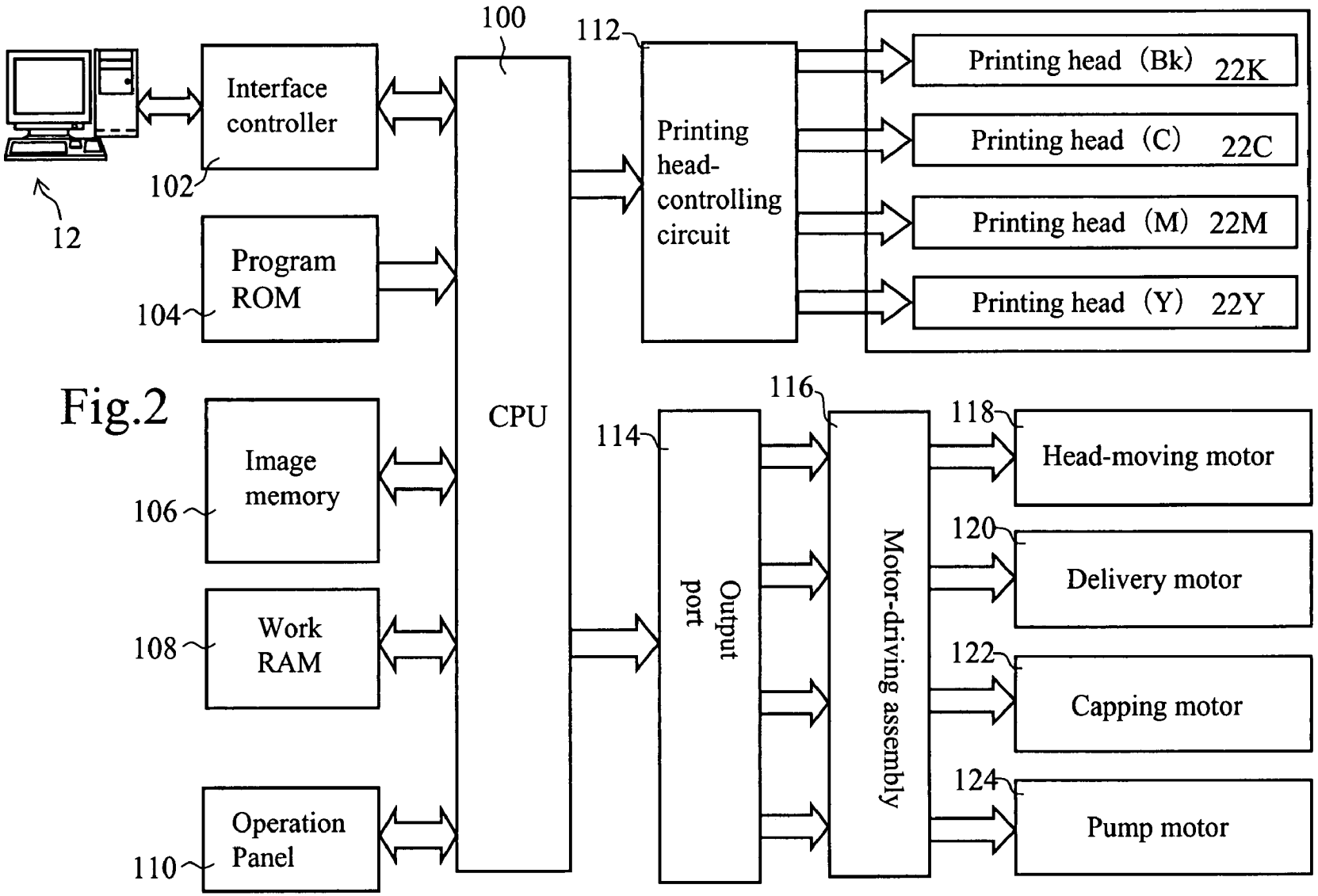
FIG. 2 is a block diagram showing the electric system of the printer shown in FIG. 1.

FIG. 2 is a block diagram showing the electric system of the printer shown in FIG. 1.

A recording data or command transmitted from a host PC 12 is received through an interface controller 102 by a CPU 100. The CPU 100 is an arithmetic processing unit for controlling the entire printer 10 including reception and recording of the data, handling of the rolled paper, and so forth. The CPU 100 analyzes the received command, and the recording data of the color components are developed as a bit map in an image memory for forming an image. Before start of the recording, printing heads 22K, 22C, 22M, 22Y are moved by a capping motor 276 and a head-moving motor 118 through an output port 114 and a motor driving unit 116 to separate from the capping mechanism 50 to a recording position (image-forming position).

Then the rolled paper sheet P is delivered to the recording position by driving, through an output port 114 and a motor driving unit 116, a roll motor (not shown in the drawing) and delivery motor 120 for delivering the rolled paper sheet P at a low speed. The front edge of the rolled paper sheet P is detected by a front edge-detecting sensor (not shown in the drawing) to decide the timing (recording timing) to start ink ejection onto the rolled paper sheet P being delivered at a constant speed. Thereafter, in synchronization with the delivery of the rolled paper sheet P, the CPU 100 reads out successively respective color recording data from an image memory 106. The read-out data are transmitted through a printing head-controlling circuit 112 to four printing heads 22K, 22C, 22M, 22Y.

The CPU 100 is operated according to a processing program memorized in a program ROM 104. The program ROM 104 memorizes a processing program, a table corresponding to the control flow, and the like. A work RAM 108 is used as an operation memory. At the time of cleaning or recovery of the printing heads 22K, 22C, 22M, 22Y, the CPU 100 drives a pump motor 124 through an output port 114 and a motor driving unit 116 to control pressurization or sucking of the ink.

The ink-feeding device incorporated in the printer 10 is explained by reference to FIGS. 3-5.

Figure 3:
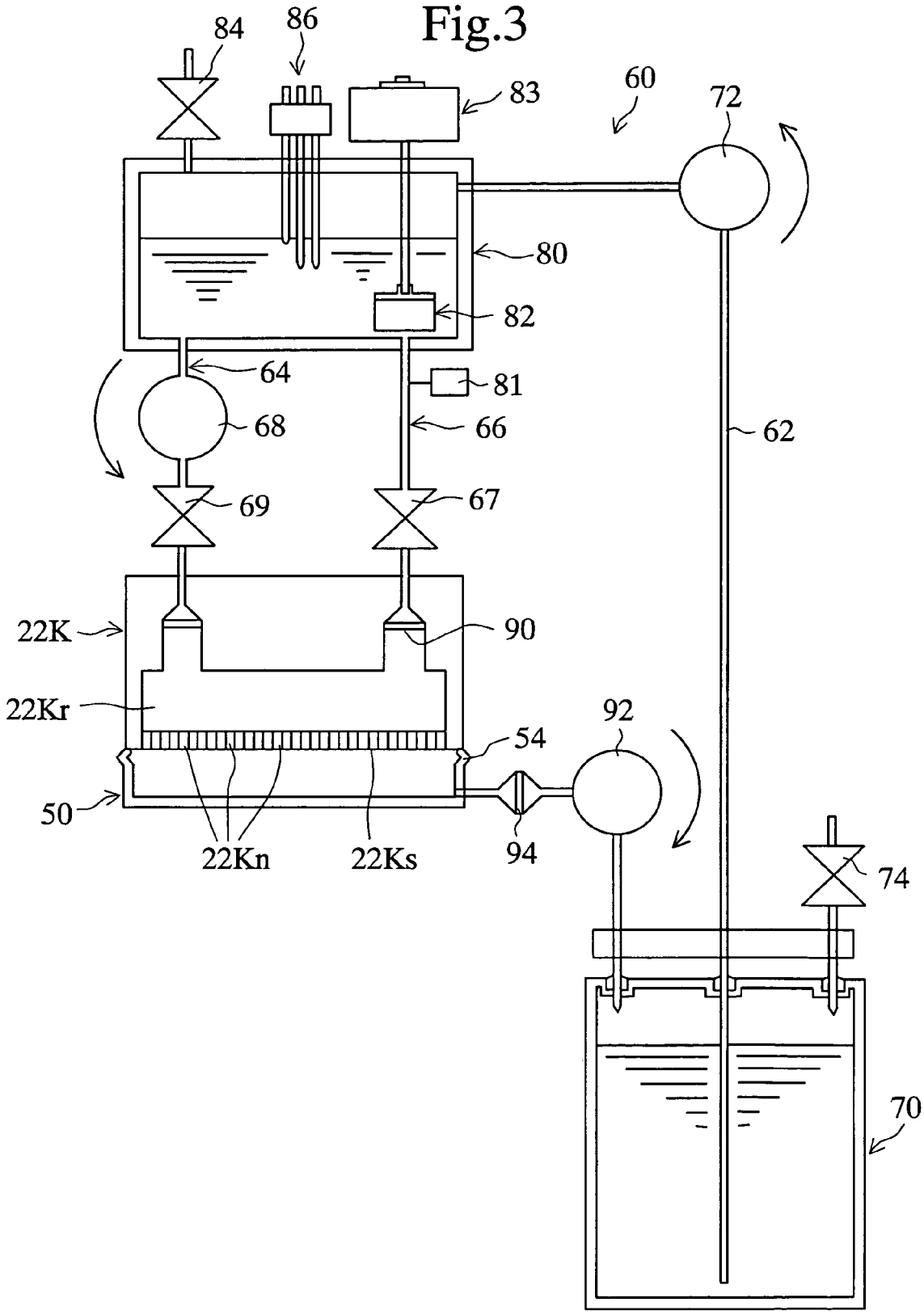
FIG. 3 is a schematic drawing of an ink-feeding device incorporated in an inkjet type image formation apparatus.

FIG. 3 is a schematic drawing of an ink-feeding device incorporated in an inkjet type image formation apparatus. FIG. 4 is a flow chart of a procedure for cleaning a printing head. FIGS. 5(*a*), 5(*b*), and 5(*c*) are schematic drawings showing a procedure for wiping an ink ejection face to remove an ink: FIG. 5(*a*), before start of the wiping operation; FIG. 5(*b*), immediately after end of the wiping operation; and FIG. 5(*c*), standby after the wiping operation. FIG. 3 shows an ink-feeding device for feeding an ink to printing head 22K and recovering the printing head 22K. Other printing heads 22C, 22M, 22Y are also equipped with ink-feeding devices of the same constitution. Incidentally, in FIG. 3 and FIG. 5, the same symbols as in FIG. 1 and FIG. 2 are used to indicate corresponding elements.

The printer 10 (see FIG. 1) incorporates an ink-feeding device 60 for feeding an ink to a printing head 22K. The ink-feeding device 60 has an ink tank 70 demountable from the main body of the printer 10, and a sub-tank 80 placed within an ink feed channel 62 connecting the sub-tank 80 to the printing head 22K. The printing head 22K is placed at a position lower than the sub-tank 80.

The sub-tank 80 and the printing head 22K are connected by two ink flow channels 64,66. The sub-tank 80 is fixed to the main body frame of the printer 10. Portions of the ink flow channels 64,66 are constituted of a flexible tube to enable movement of the printing head 22K as described later. In the ink flow channel 64, are installed a cleaning pump 68 which is driven at the time of cleaning the printing head 22K, a standby valve 69 which opens and closes the ink flow channel 64 at a prescribed timing. On the other hand, within the ink flow channel 66, a pressure valve 67 is installed which opens and closes the ink flow channel 66 at a prescribed timing. Further in the ink flow channel 66, between the pressure valve 67 and the pressure-adjusting pump 82 mentioned below, a pressure sensor 81 is installed to detect the ink pressure in the ink flow channel 66.

Inside the sub-tank 80, a pressure-adjusting pump 82 (an example of the pressure-adjusting means in the present invention) is installed for applying a suitable pressure to many nozzles 22Kn of the printing head 22K. This pressure-adjusting pump 82 is placed a little above the bottom face of the sub-tank 80, apart at a prescribed distance from the bottom face. The pressure-adjusting pump 82 is immersed in the ink in the sub-tank 80. A driving unit 83 for driving the pressure-adjusting pump 82 is placed above the sub-tank 80. This driving unit is controlled by the CPU 100 (FIG. 2). On the ceiling wall of the sub-tank 80, an air-vent valve 84 is placed to keep the inside pressure of the sub-tank 80 at an atmospheric pressure. The inside pressure of the sub-tank 80 is made equal to the atmospheric pressure by opening this air-communicating valve 84.

A conventional usual liquid-level sensor 86 is installed in the sub-tank 80 for detecting the liquid face level of the ink (stored ink) in the sub-tank 80. When the liquid-level sensor 86 detects the ink face level in the sub-tank 80 to be lower than a prescribed level, a feed pump 72 is started to work to suck the ink from the ink tank 70 to feed the ink to the sub-tank 80. On the other hand, when the liquid-level sensor 86 detects the ink face level in the sub-tank 80 to reach a prescribed upper-limit level, the feed pump 72 is stopped to interrupt the ink feed.

In the ink tank 70, a sensor is installed (not shown in the drawing) for detecting the presence of the ink in this ink tank 70. In the air flow path for mounting the ink tank 70 on the main body of the printer 10, an air-vent valve 74 is installed for equalizing the inside pressure of the ink tank 70 to the atmospheric pressure.

Next, the cleaning operation for cleaning the printing head 22K is explained below.

The cleaning operation herein signifies an operation for maintaining the ink ejection performance of the printing head 22K, and this operation is conducted automatically or non-automatically when the lapse of ejection time or the ejection state comes to a predetermined condition or when the image quality becomes abnormal.

Figure 4:
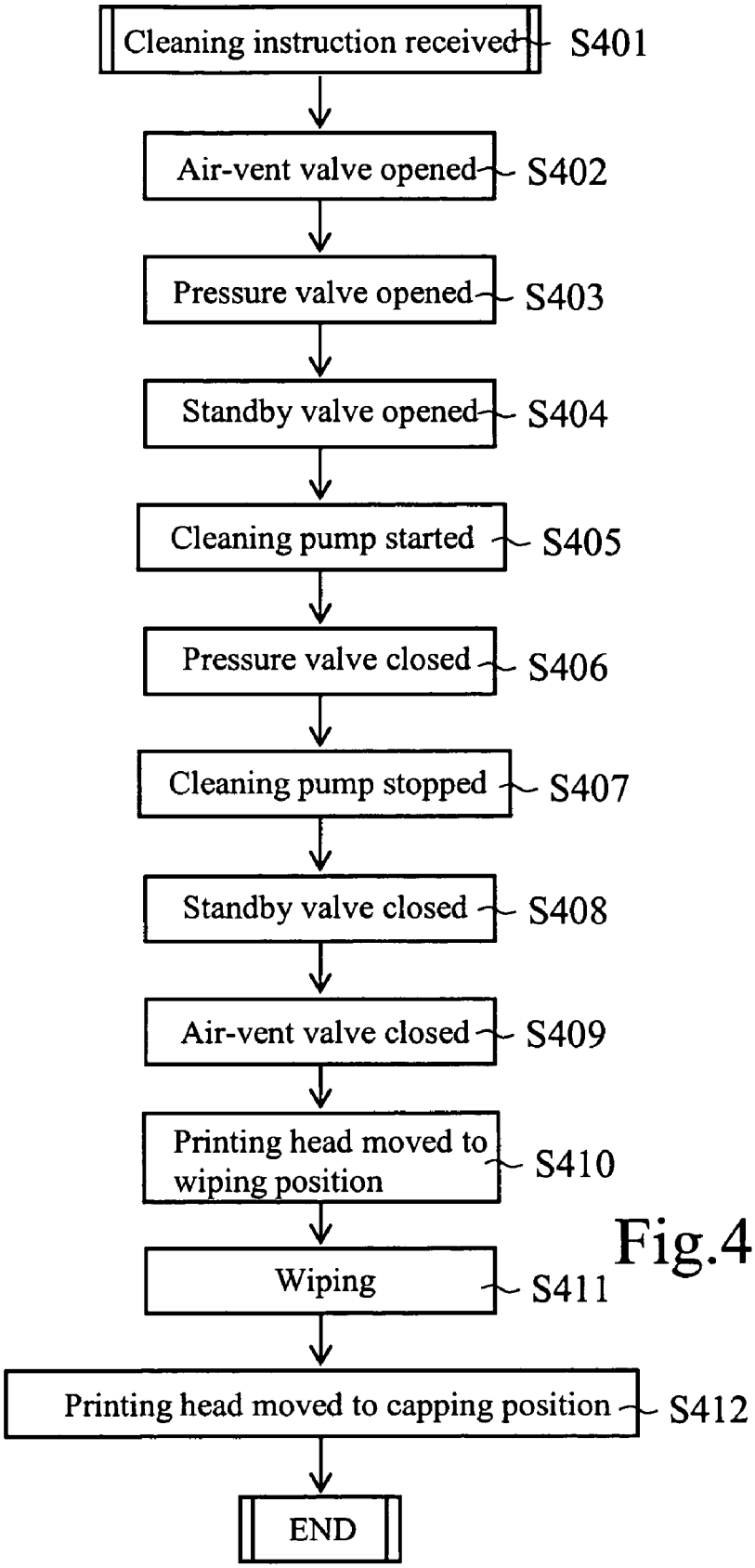
FIG. 4 is a flow chart showing a procedure for cleaning a printing head.
Figure 5:
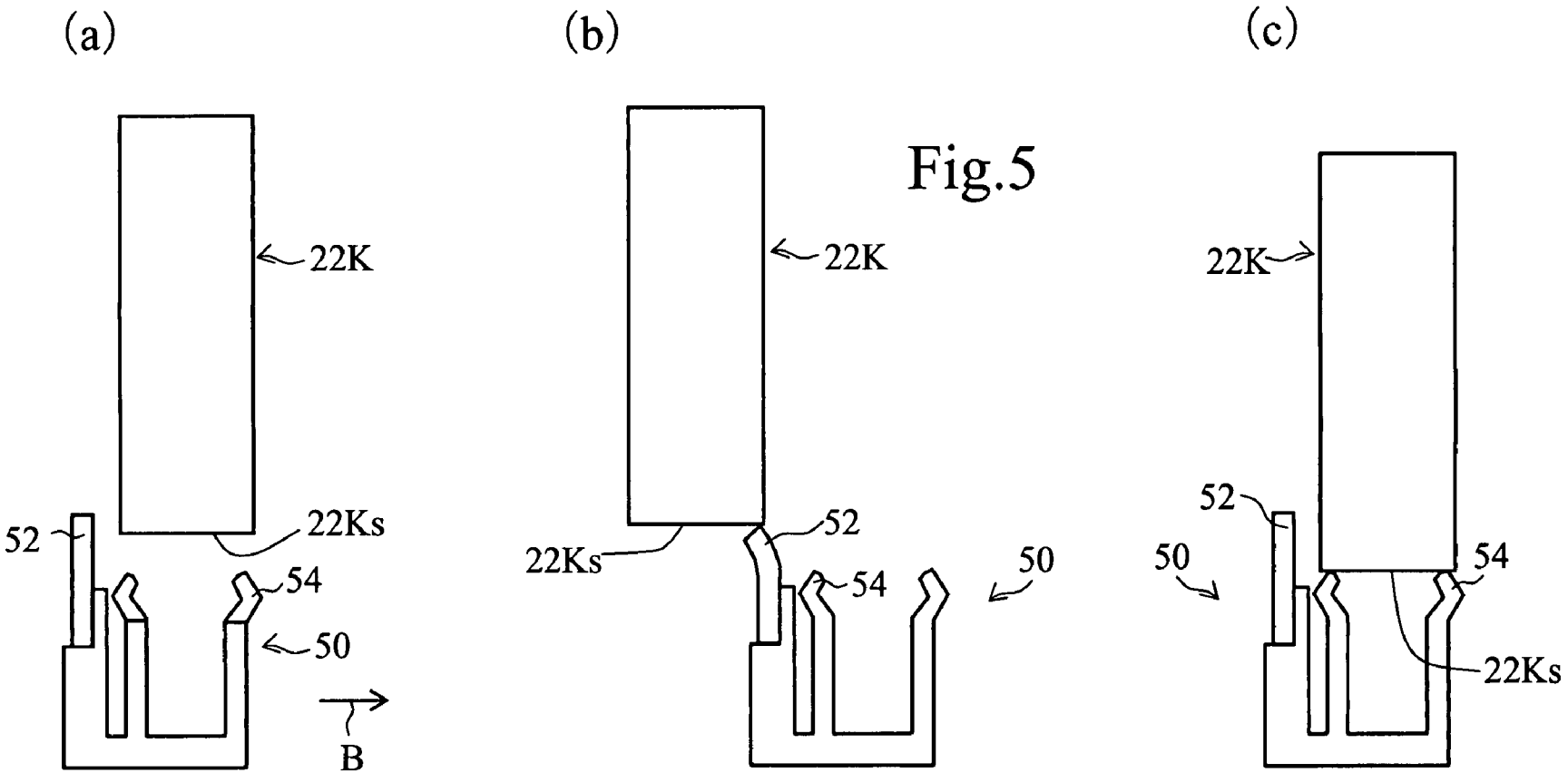
FIGS. 5(*a*), 5(*b*), and 5(*c*) are schematic drawings showing a procedure for wiping an ink ejection face to remove an ink.

As shown by the flow chart in FIG. 4, the cleaning operation is started on reception of cleaning instructions (S401). On receiving the cleaning instructions, the air-vent valve 84, the pressure valve 67, and the standby valve 69 are opened successively (S402-S404). Then the cleaning pump 68 is started (S405) to send the ink by pressure from the sub-tank 80 through the ink flow channel 64 to the printing head 22K. By this ink feed by pressure, a bubble or bubbles formed in the side of the sub-tank 80 of a filter 90 during the recording and other operations are flushed back into the sub-tank 80.

After driving the cleaning pump 68 for a certain time, the pressure valve 67 is closed (S406) to close the ink flow channel 66. Thereby a strong positive pressure is applied to the liquid chamber 22Kr of the printing head 22K. This strong positive pressure discharges the ink through the nozzles 22Kn of the printing head 22K to remove a foreign matter such as bubbles and dirt in and around the nozzle 22Kn.

Further, after a certain time, the cleaning pump 68 is stopped (S407), and the standby valve 69 and the air-vent valve 84 are closed successively (S408, S409). In this state, the face 22Ks of the nozzle 22Kn including the nozzle openings of the printing head 22K is in an uncleaned state soiled by the ink. To remove the soiling matters, the face 22Ks is wiped with a wiper 52 fixed to the capping mechanism 50. In this wiping operation, firstly the printing head 22K is moved above the recovery cap 54 as shown in FIG. 5(*a*) (S410). Then the recovery cap 54 is moved in the arrow-B direction as shown in FIG. 5(*b*) to wipe the soiling matter like an ink adhering to the face 22Ks by a wiper 52 (S411). This operation is called a wiping operation. After the wiping operation, the printing head 22K is brought again to the standby state as shown in FIG. 5(*c*) (S412). The printing head 22K in the standby state is capped at the face 22Ks by a recovery cap 54 to prevent ink viscosity increase in the nozzle 22Kn. The ink discharged from the printing head 22K (waste ink) is received by the recovery cap 54 and is sucked by a suction pump 92 (FIG. 3). This waste ink is filtered (screened) by a filter 94 (FIG. 3) to eliminate the foreign matters and is returned to the ink tank 70. The wiping operation only may be conducted at a suitable timing.

A technique for adjusting the pressure in the printing head 22K by a pressure-adjusting pump 82 is explained below by reference to FIGS. 6-8.

Figure 6:
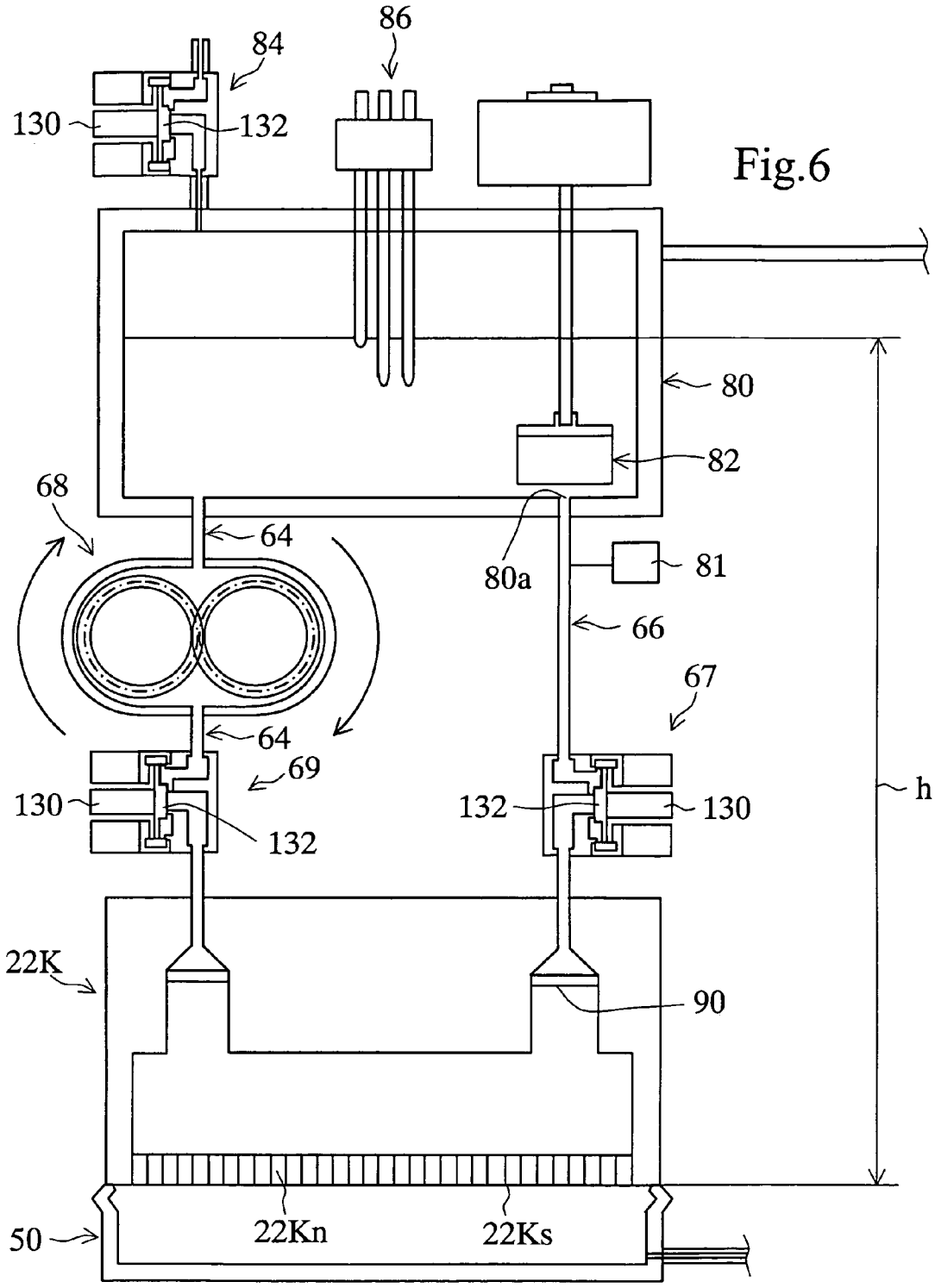
FIG. 6 is an enlarged drawing showing a sub-tank and a printing head in detail.
Figure 7:
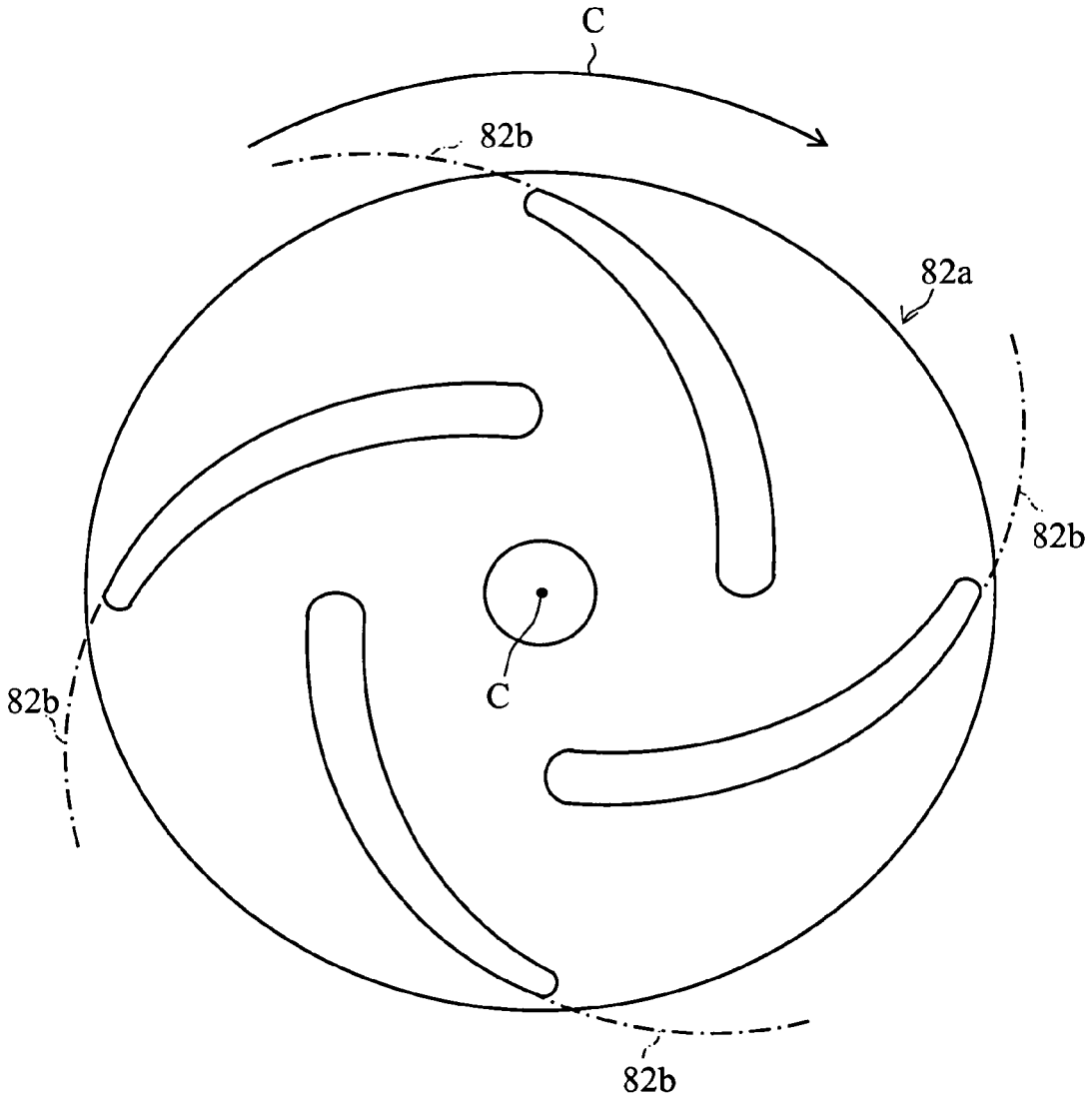
FIG. 7 is a plan view showing a blade of a pressure-adjusting pump.

FIG. 6 is an enlarged drawing showing a sub-tank and a printing head in detail. FIG. 7 is a plan view showing vanes of a pressure-adjusting pump. FIG. 8 is a graph showing a relation between a rotation frequency of the vanes shown in FIG. 7 and a pressure applied to an ink in a printing head. In these drawings, the same reference numbers and symbols as in FIG. 3 are used for indicating corresponding elements.

The aforementioned pressure valve 67, the standby valve 69, and the air-vent valve 84 are, as shown in FIG. 6, respectively an electromagnetic valve which intercepts the ink flow channel by a valve sheet 132 integrated with a solenoid plunger 130. However, any type of the valve may be used in the present invention without limiting thereto.

In the recording, a suitable negative pressure should be applied to the printing head 22K. (That is, a pressure is applied to the ink to form a meniscus of the ink at the ink ejection openings (nozzle outlets) of the printing head 22K). For the negative pressure application, the pressure valve 67 and the air-vent valve 84 are opened, and the standby valve 69 is closed. In this state, the pressure-adjusting pump 82 is driven to rotate its blade 82*a* (rotor in the present invention) of the pressure-adjusting pump 82 to apply a centrifugal force from the centre C of the blade 82*a* along the vane faces 82*b*. Thereby, the portion of the center rotation axis (at and around the center C) of the pressure-adjusting pump 82 is subjected to a relatively negative pressure, and the negative pressure can be applied through suction opening 80*a* of the sub-tank 80 and the ink flow channel 66 to the printing head 22K. The suction opening 80*a* is formed on the bottom wall of the sub-tank 80, and the pressure-adjusting pump 82 is placed at a certain distance above the suction opening 80*a*. The rotation frequency of the blade 82*a* is controlled by the CPU 100 (FIG. 2)

As described above, the pressure-adjusting pump 82 is driven to rotate the blade 82*a* in the arrow-C direction to generate a centrifugal force. Thereby the ink in the printing head 22K is pulled through the ink flow channel 66 and the suction opening 80*a* toward the sub-tank 80 (actually, only a little amount of the ink is transferred by the suction) to apply a negative pressure (a pressure lower than the atmospheric pressure outside the ink ejection opening) to the ink in the printing head 22K to form a meniscus of the ink at the ink ejection opening. Otherwise, by driving reversely the pressure-adjusting pump 82 to rotate in the direction reverse to the arrow-C direction with a slight modification of the blade 82*a*, a slight pressure can be applied in the direction reverse to the above negative pressure. Thereby, the ink in the sub-tank 82 can is pushed out of the suction opening 80*a* to apply a positive pressure (a pressure higher than the atmospheric pressure outside the ink ejection opening) to the ink in the printing head 22K, and the ink can be discharged from the ink discharge outlet.

Figure 8:
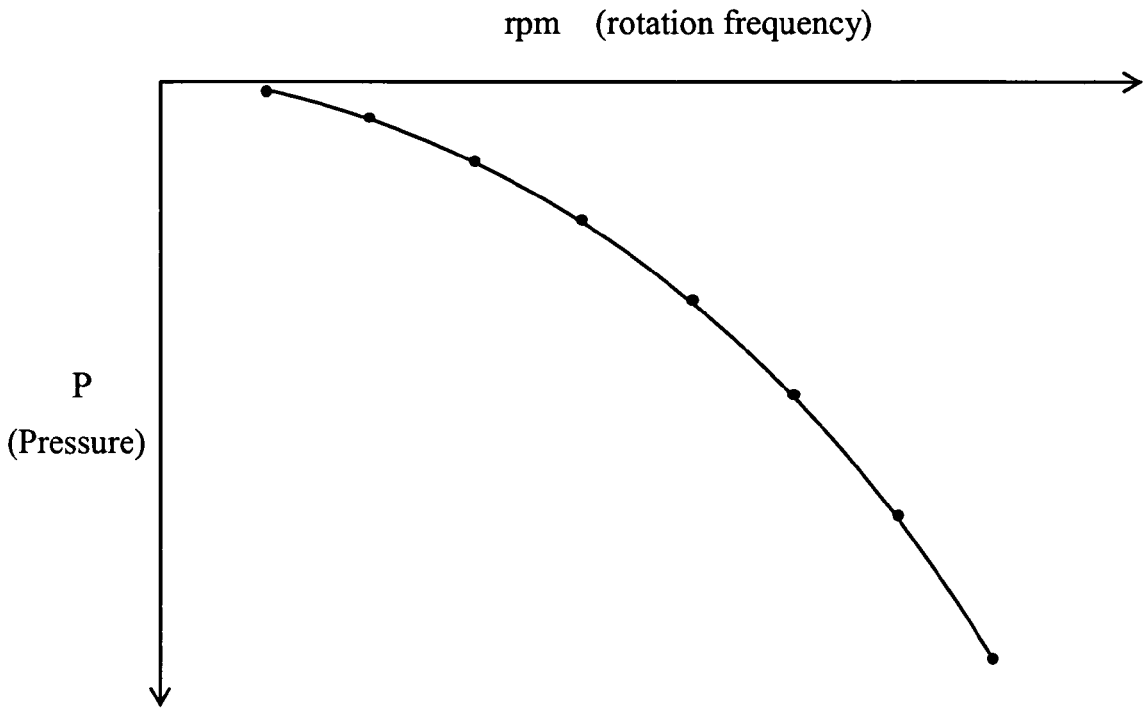
FIG. 8 is a graph showing a relation between a rotation frequency of the blade shown in FIG. 7 and a pressure applied to an ink in a printing head.

The strength of the negative pressure generated by the pressure-adjusting pump 82 varies depending on the rotation frequency of the blade 82*a* of the pressure-adjusting pump 82 rotating in the arrow-C direction as shown in FIG. 8. The higher the rotation frequency of the blade 82*a* in the arrow-C direction (larger the rotation number per unit time), the higher is the generated negative pressure. This higher negative pressure tends to suck the ink from the printing head 22K to the sub-tank 82 to apply a higher negative pressure to the ink in the printing head 22K. Conversely, the lower the rotation frequency of the blade 82*a* in the arrow-C direction (smaller the rotation number per unit time), the lower is the generated negative pressure. This lower negative pressure tends to suck the ink at a lower attraction force from the printing head 22K to the sub-tank 82 to apply a lower negative pressure to the ink in the printing head 22K. Thus, the strength of the negative pressure applied to the printing head 22K can be controlled by the rotation frequency of the pressure-adjusting pump 82, so that the pressure in the printing head 22K can be adjusted by driving the pressure-adjusting pump 82 with the ink flow channel 66 kept opened.

The pressure-adjusting pump 82 is preferably a usual turbo type of pump. The turbo type pump includes centrifugal type pumps, diagonal flow type pumps, and axial flow type pumps. Such a pump can generate a pressure without closing the ink flow channel (liquid flow channel). Therefore the ink can pass through the pump depending on the pressure difference. For example, ejection of the ink from the printing head 22K decreases the amount of the ink in the printing head 22K, thus decreasing the pressure between the printing head 22K and the pressure-adjusting pump (centrifugal pump) 82. Owing to this pressure decrease, the ink in the sub-tank 80 is supplied through the ink flow channel 66 to the printing head 22K. In contrast, a volume type pump such as a piston pump, as the pressure-adjusting pump 82, shuts the ink flow channel 66 for sending the ink by pressure, which prevents free movement of the ink through the piston pump and is liable to suck the outside air through the ink ejection outlet of the printing head 22K.

The procedure for the recording operation starting from the standby mode is explained by reference to FIGS. 9 and 10.

Figure 9:
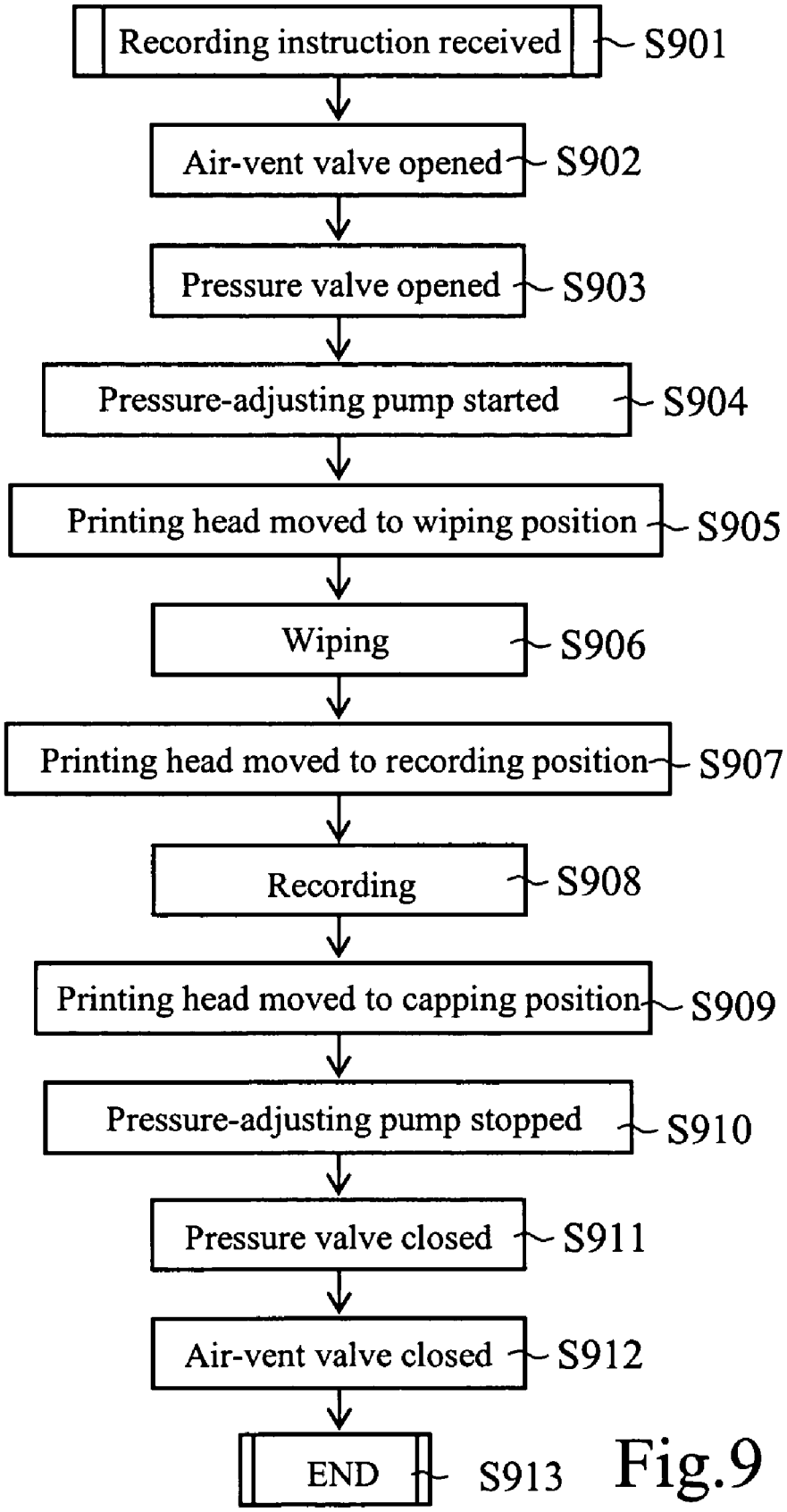
FIG. 9 is a flow chart showing a procedure from a standby mode to recording operation.
Figure 10:
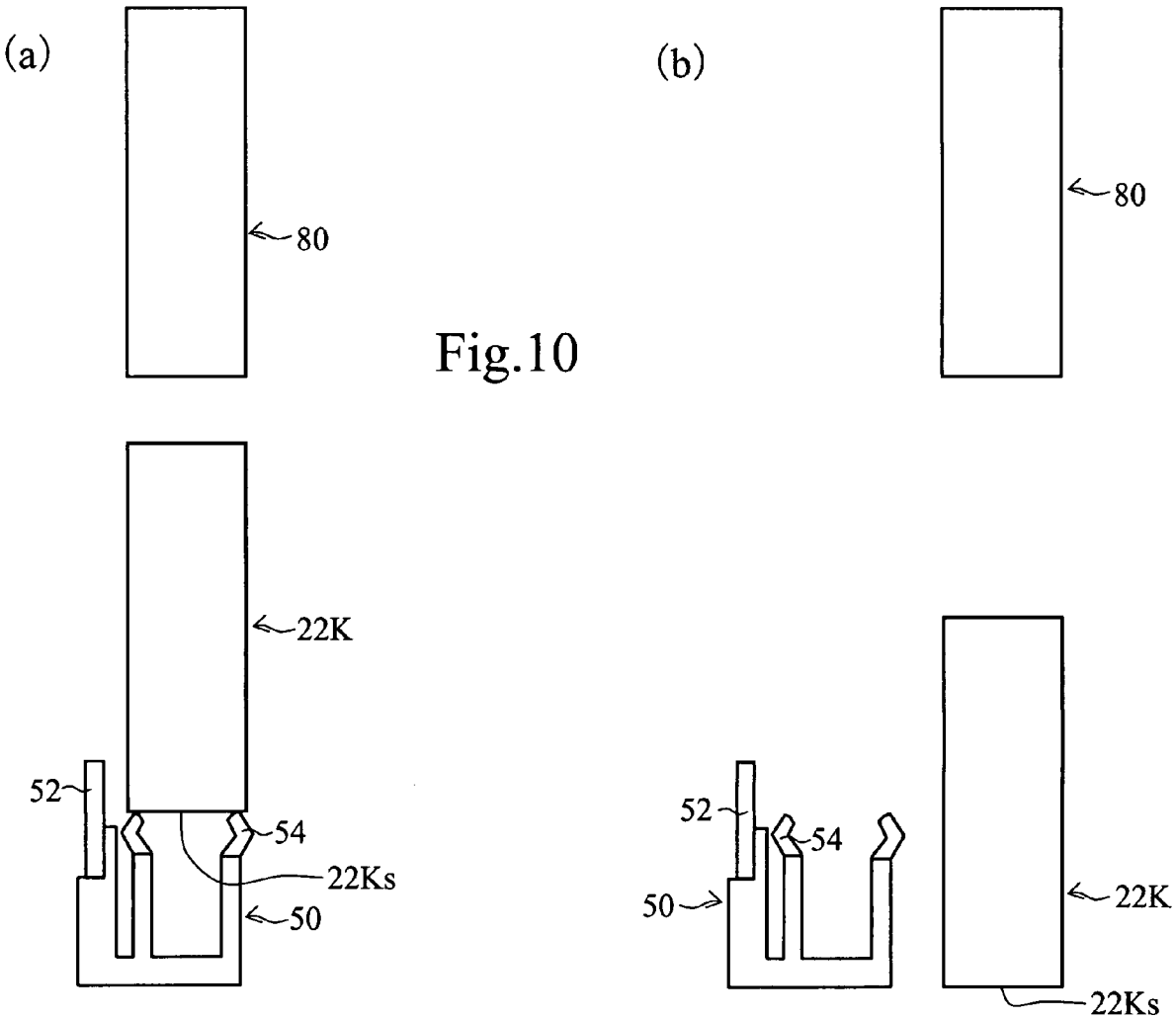
FIG. 10(*a*) is a schematic drawing of a printing head capped with a recovery cap, and FIG. 10(*b*) is schematic drawing showing a position of the printing head during recording operation.

FIG. 9 is a flow chart showing the procedure for the recording operation starting from the standby mode. FIG. 10(*a*) is a schematic drawing of a printing head capped with a recovery cap, and FIG. 10(*b*) is a schematic drawing showing a position of the printing head during the recording operation.

On receiving instructions for printing in the standby mode (S901), the air-vent valve 84 is opened (S902). Successively, the pressure valve 67 is opened to open the ink flow channel 66 (S903). In this Example, a sub-tank 80 is placed higher than the printing head 22K. Therefore, opening of the air-vent valve 84 and the pressure valve 67 applies a water head pressure h (FIG. 6) to the nozzle 22Kn of the printing head 22K, and ink tends to flow from the sub-tank 80 through ink flow channel 66 to the printing head 22K. In this state, the pressure-adjusting pump 82 is started (S904) to generate the aforementioned negative pressure to cancel the water head pressure h (FIG. 6) and to apply negative pressure to the nozzle 22Kn of the printing head 22K. Consequently as mentioned above, a negative pressure is applied to the ink in the printing head 22K to form a meniscus of the ink at the ink ejection outlet.

The wiping operation is conducted (S906) in a manner as described before by reference to FIGS. 4 and 5. Then as shown in FIG. 10(*b*), the printing head 22K is lowered to the recording position (S907). As described above, the sub-tank 80 is fixed to the main body frame of the printer 10, and the ink flow channels 64,66 are made of flexible tubes. Therefore, the ink flow channels 64,66 are kept open even when the printing head 22K is lowered. The lowering of the printing head 22K can cause further additional positive pressure on the nozzle 22Kn of the printing head 22K. However, the negative pressure is already generated by driving the pressure-adjusting pump 82 for canceling the estimated increase of the positive pressure to keep the negative pressure in the nozzle 22Kn.

After the printing head 22K is lowered to reach the recording position, the recording operation (image formation) is conducted (S908). After the end of the recording operation, the printing head 22K is raised and capped with the recovery cap 54 (S909). Then the pressure-adjusting pump 82 is stopped (S910), and successively the pressure valve 67 is closed (S911) and the air-vent valve 84 is closed (S912) to bring the system to the standby mode again to end the flow of the procedure (S913).

During the recording operation, ink is ejected from the nozzle 22Kn. This ink ejection causes increase of the negative pressure in the nozzle 22Kn, attracting the ink by the pressure difference caused by the increase of the negative pressure to feed the ink from the sub-tank 80 to the nozzle 22 Kn. Therefore, when the amount of the ink ejected from the nozzle 22Kn per unit time (ink consumption) is increased suddenly, the ink feed from the sub-tank 80 cannot follow the increase of the ink ejection, which tends to increase the negative pressure in the nozzles 22Kn. Conversely, when the amount of the ink ejected from the nozzle 22Kn per unit time (ink consumption) is decreased suddenly, the negative pressure can be decreased by inertia of the ink. Such fluctuation of the negative pressure (pressure variation) can be prevented by control of the rotation frequency of the pressure-adjusting pump 82. This control is explained below.

To meet the decrease of the amount of the ink ejected from the nozzle 22Kn per unit time, the rotation frequency of the pressure-adjusting pump 82 is increased. Thereby ink is sucked up more strongly from the printing head 22K toward the sub-tank 80 to increase the negative pressure in the printing head 22K (i.e., negative pressure in the nozzle 22Kn). Thus the decrease of the negative pressure in the printing head 22K caused by decrease of the ink ejection can be prevented to keep constant the negative pressure in the printing head 22K.

On the other hand, to meet the increase of the amount of the ink ejected from the nozzle 22Kn per unit time, the rotation frequency of the pressure-adjusting pump 82 is decreased, or to meet the remarkable increase of the ink ejection per unit time, the rotation of the pressure-adjusting pump 82 is stopped or reversed. Thereby ink is sucked up less from the printing head 22K toward the sub-tank 80 (in some cases, the ink tends to move from the sub-tank 80 to the printing head 22K) to decrease the negative pressure in the printing head 22K (i.e., negative pressure in the nozzle 22Kn). Thus the excessive negative pressure in the printing head 22K can be prevented to keep the negative pressure in the nozzle 22Kn at a suitable level.

For the above described control, one method is to install a pressure sensor 81 in the ink flow channel 66 for detecting the change of the pressure in the printing head 22K and to feed back the pressure detected by the pressure sensor 81 to the driving circuit of the pressure-adjusting pump 82. That is, the rotation frequency of the pressure-adjusting pump 82 is controlled according to the pressure detected by the pressure sensor 81 to adjust the pressure in the printing head 22K. This adjustment is explained in detail by reference to FIGS. 11 and 12.

In one method of the adjustment, an optimum driving table for the pressure-adjusting pump 82 is prepared preliminarily from formed images and ink ejection frequencies, and the pressure-adjusting pump 82 is driven according to this driving table. That is, the rotation frequency of the pressure-adjusting pump 82 is controlled depending on the amount of the ink ejected from the printing head 22K per unit time to adjust the pressure in the printing head 22K. When the fluctuation of the ink ejection state is within the allowable range for the quality of the formed image in practical use, the pressure-adjusting pump 82 may be driven under constant driving conditions.

Figure 11:
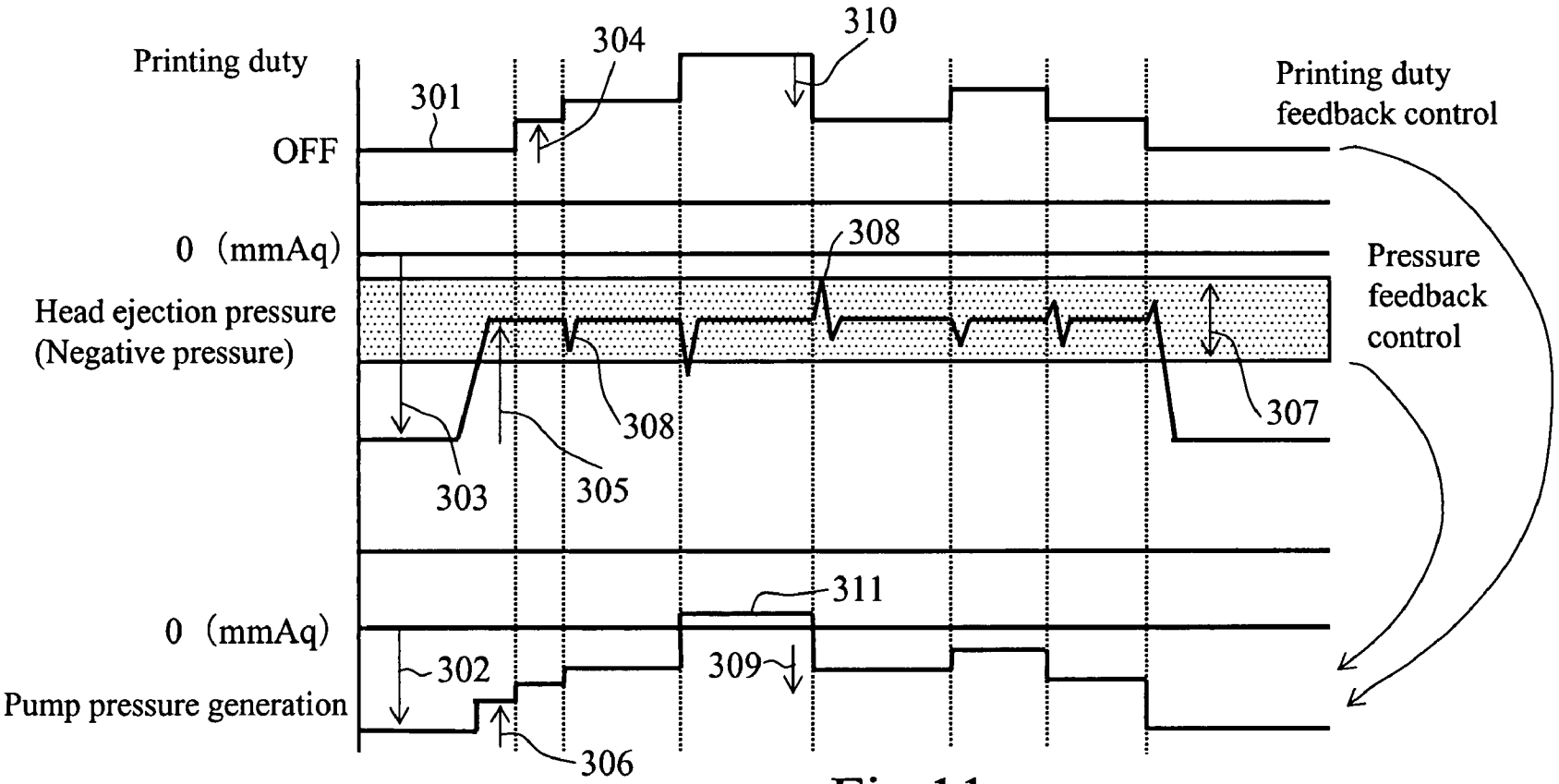
FIG. 11 shows a time chart of operation of the ink-feeding device shown in FIG. 6.
Figure 12:
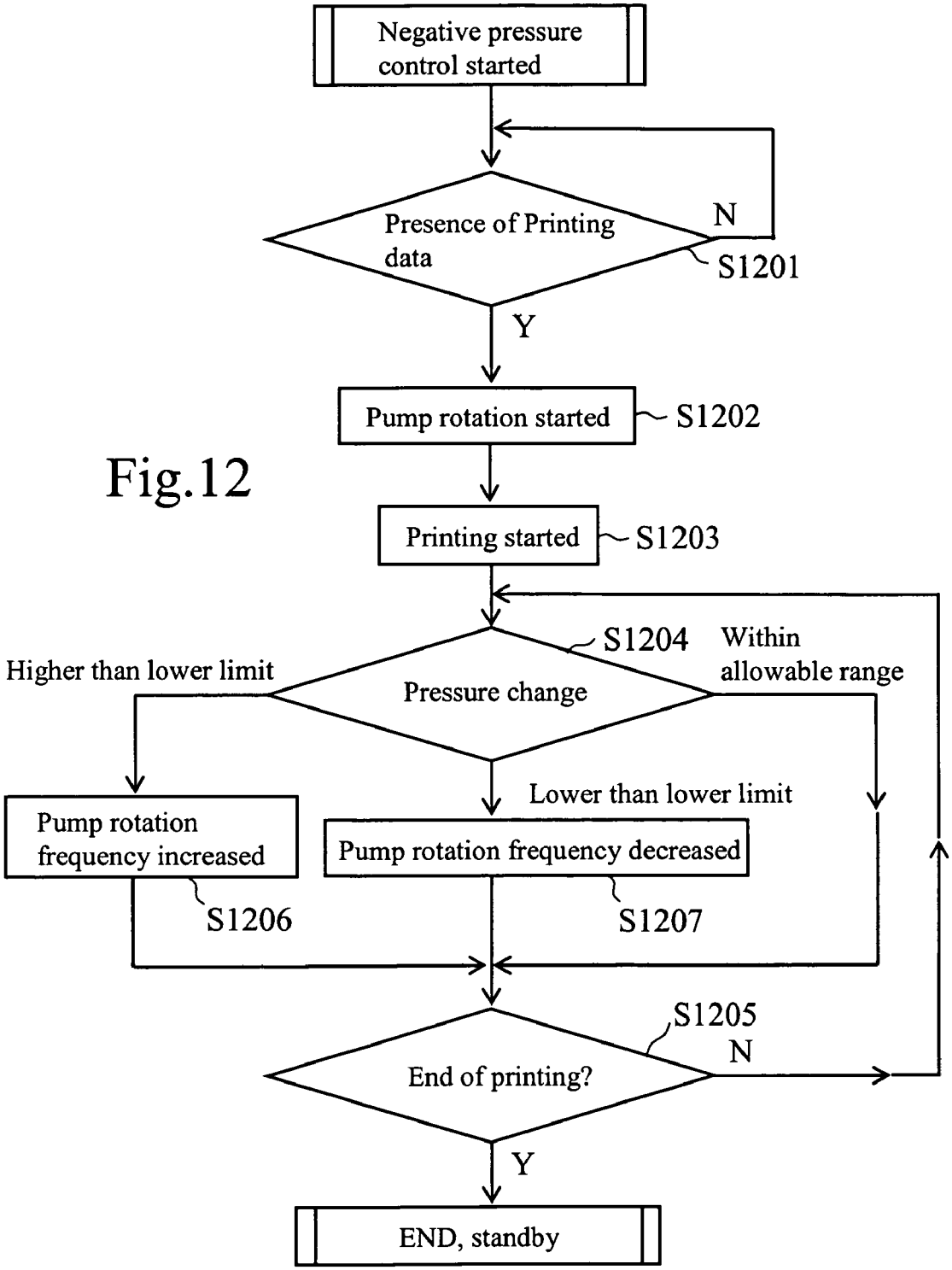
FIG. 12 is a flow chart showing a procedure for operating the ink-feeding device shown in FIG. 6.

The technique is explained in detail for adjusting the pressure in the printing head 22K by controlling the rotation of the pressure-adjusting pump 82 according to the pressure detected by the pressure sensor 81 by reference to FIGS. 11 and 12.

FIG. 11 is a time chart of operation of the ink-feeding device shown in FIG. 6. FIG. 12 is a flow chart showing a procedure for operating the ink-feeding device shown in FIG. 6. The operation of the ink-feeding device shown in FIG. 6 is explained by reference to FIG. 11 in view of the printing duty of the printing head 22K and the pressure applied to the printing head.

In the non-ejection state (printing duty: OFF) 301 in which no ink is ejected from the printing head 22K, the pressure-adjusting pump 82 is controlled to generate a prescribed pressure as shown by the reference number 302 to control the pressure generated by the pressure-adjusting pump 82 as shown by the reference number 303 to make the printing head 22K ready for ink ejection. To start the ink ejection from the printing head 22K (ref. no.: 304), the pressure generated by the pressure-adjusting pump 82 is preliminarily brought to about the atmospheric pressure (0 mmAq) prior to the ink ejection (ref. nos.: 306,305) (decrease of the negative pressure). After start of the printing, the pressure generated by the pump is adjusted to follow the change of the printing duty to decrease the pressure fluctuation of the ink ejection to keep the negative pressure within the ink ejection-enabling range 307. When the pressure cannot be brought to be in the ink ejection-enabling range 307 by bringing the negative pressure near the atmospheric pressure, the rotation of the pressure-adjusting pump 82 is stopped. Otherwise, the rotation of the pressure-adjusting pump 82 may be reversed (rotation in the direction of ink feed) with modification of the shape of the blade of the pressure-adjusting 82 pump to keep the pressure slightly higher than the atmospheric pressure (positive pressure) 311. Conversely, when the printing duty decreases (ref. nos.: 310), the pressure generated by the pump is made negative (ref. no.: 309).

As described above, the drive of the pressure-adjusting pump 82 is controlled depending on the printing duty. Thereby the negative pressure can generally be controlled to be within the ink ejection-enabling region although an irregular pressure change (ref. no.: 308) may appear by delay of the response caused by inertia of the ink.

An example of the procedure for pressure control is explained by reference to FIG. 12. In the constitution of the printer control system shown in FIG. 2, this procedure is conducted by the CPU 100 according to a program or the like contained in the ROM 104.

Firstly the presence of the printing data is confirmed (S1201). In the presence of the printing data, the pressure-adjusting pump 82 is started to rotate (S1202), and the printing is started (S1203). During the printing, the pressure is detected by the pressure sensor 81 (S1204). The printing is conducted with the pressure-adjusting pump 82 rotating, insofar as the detected pressure is within a prescribed range. The end of the printing is judged (S1205). When the printing is judged to be ended, this flow is finished, whereas when the printing is judged to be continued, the flow is returned to the step S1204 and the pressure is detected again by the pressure sensor 81 (S1204).

When the pressure detected in the step S1204 is higher than the prescribed lower limit, since the pressure in the printing head 22K can become higher than the atmospheric pressure, the pressure in the printing head 22K is controlled to be within the prescribed range by increasing the rotation frequency of the pressure-adjusting pump 82 (S1206) and the end of the printing is judged (S1205). When the printing is judged to be ended, this flow is finished, whereas when the printing is judged to be continued, the flow is returned to the step S1204 and the pressure is detected by the pressure sensor 81 (S1204).

When the pressure detected in the step S1204 is lower than the prescribed lower limit, since the pressure in the printing head 22K can become much lower than the atmospheric pressure to prevent the ink ejection, the pressure in the printing head 22K is controlled to be within the prescribed range by decreasing the rotation frequency of the pressure-adjusting pump 82 (S1207) and the end of the printing is judged (S1205). When the end of the printing is judged to be ended, this flow is finished, whereas when the printing is judged to be continued, the flow is returned to the step S1204 and the pressure is detected again by the pressure sensor 81 (S1204).

In another method, without utilizing the aforementioned software processing, a counter for counting the bits constituting the image data, and a means for controlling the motor for driving the pressure-adjusting pump 82 based on the count number can be constituted by a hardware. In still another method, instead of conducting the control to meet the printing duty change during the progress of the printing, the pump may be controlled in a feed-forward manner according to a pump-control curve preliminarily formed based on printing data. In still another method, the pump may be controlled by a local feedback loop according to the detection output of the pressure sensor for detecting the actual head pressure (if the pressure in the sub-tank is considered to be practically equal to the head pressure, the pressure sensor may be used for detection of this pressure).

Example 2

In Example 1, the sub-tank 80 is placed higher than the printing head 22K, but the placement is not limited thereto in the present invention. In this Example, an ink-feeding device 160 is explained in which the sub-tank 80 is placed lower than the printing head 22K by reference to FIG. 13.

Figure 13:
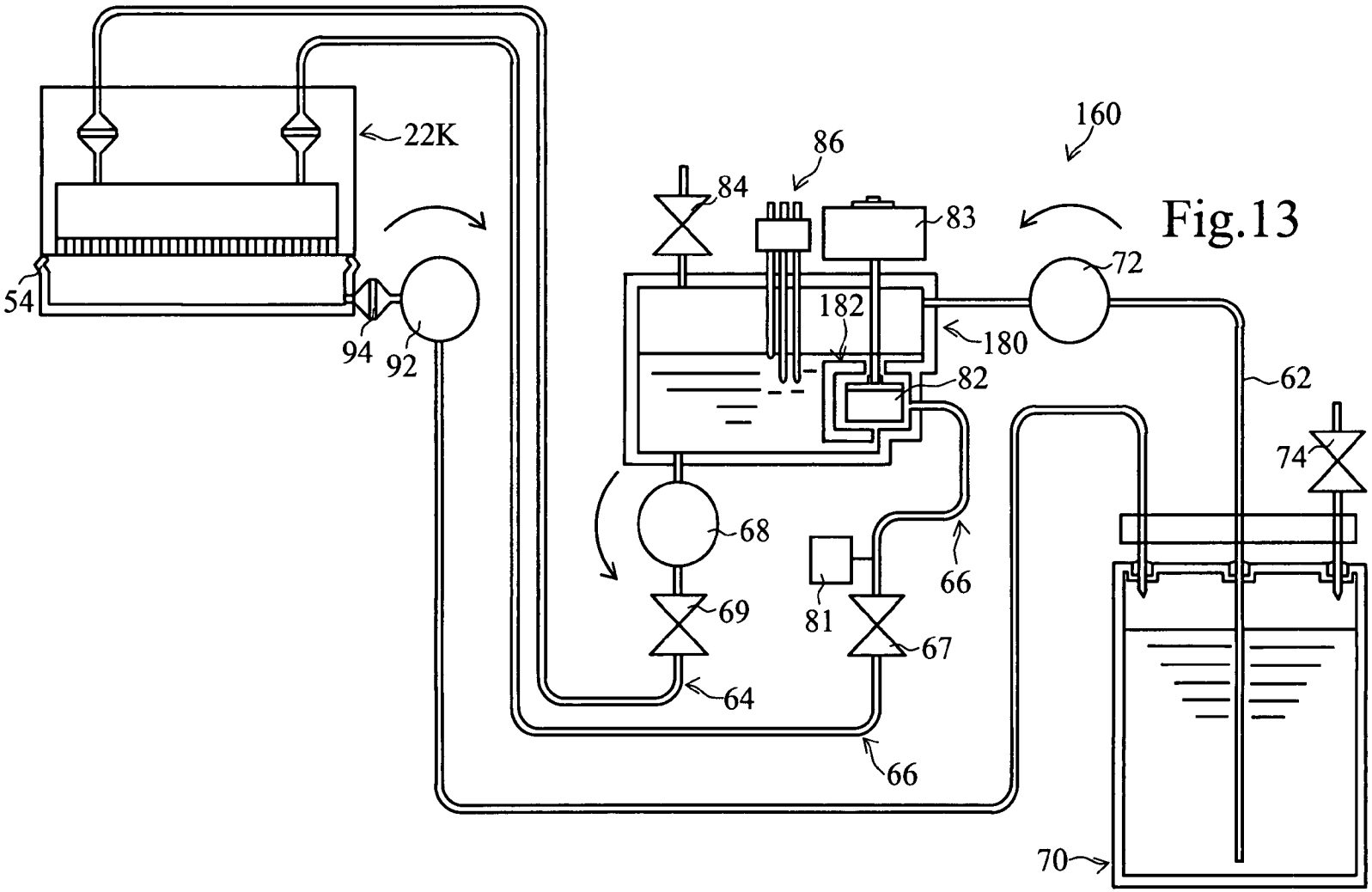
FIG. 13 shows schematically the ink-feeding device of Example 2.

FIG. 13 illustrates schematically the ink-feeding device of this Example 2. In this FIG. 13, the same reference numbers and symbols as in FIG. 3 are used for indicating corresponding elements.

In the ink-feeding device 160 in this Example 2, sub-tank 80 is placed lower than the printing head 22K. Even in such a positional relation, a pressure-adjusting pump 82 is useful for applying a positive pressure from the outside to keep a suitable negative pressure in the printing head 22K. In this Example, a centrifugal pump is used as the pressure-adjusting pump 82. The shape of the sub-tank 80 shown in FIG. 3 is not suitable for the centrifugal pump to apply sufficient positive pressure to the printing head 22K. Therefore, in this Example 2, a small casing 182 is provided for housing the pressure-adjusting pump 82 in the sub-tank 180. The ink in the sub-tank 180 can flow into this casing 182 or flow out therefrom. Onto a portion of the side wall of the casing 182, the ink flow channel 66 is connected directly. With this structure, a centrifugal pump or an axial flow pump are useful as the pressure-adjusting pump 82 for applying a positive pressure from the outside to keep inside pressure of the printing head 22K at a suitable negative pressure.

As described above, irrespective of the relative positions of the printing head 22K and the sub-tank 80, the inside of the printing head 22K can be kept at a suitable negative pressure by the pressure-adjusting pump 82. This increases the freedom degree in designing the device without restriction of the placement position of the sub-tank 80 in comparison with the conventional device utilizing water head difference. Incidentally in Examples 1 and 2, the pressure-adjusting pump 82 is placed in the sub-tank 80, but the same effect can be achieved by placing the pressure-adjusting pump 82 inside the printing head 22K.

Example 3

Example 3 is explained by reference to FIG. 14.

Figure 14:
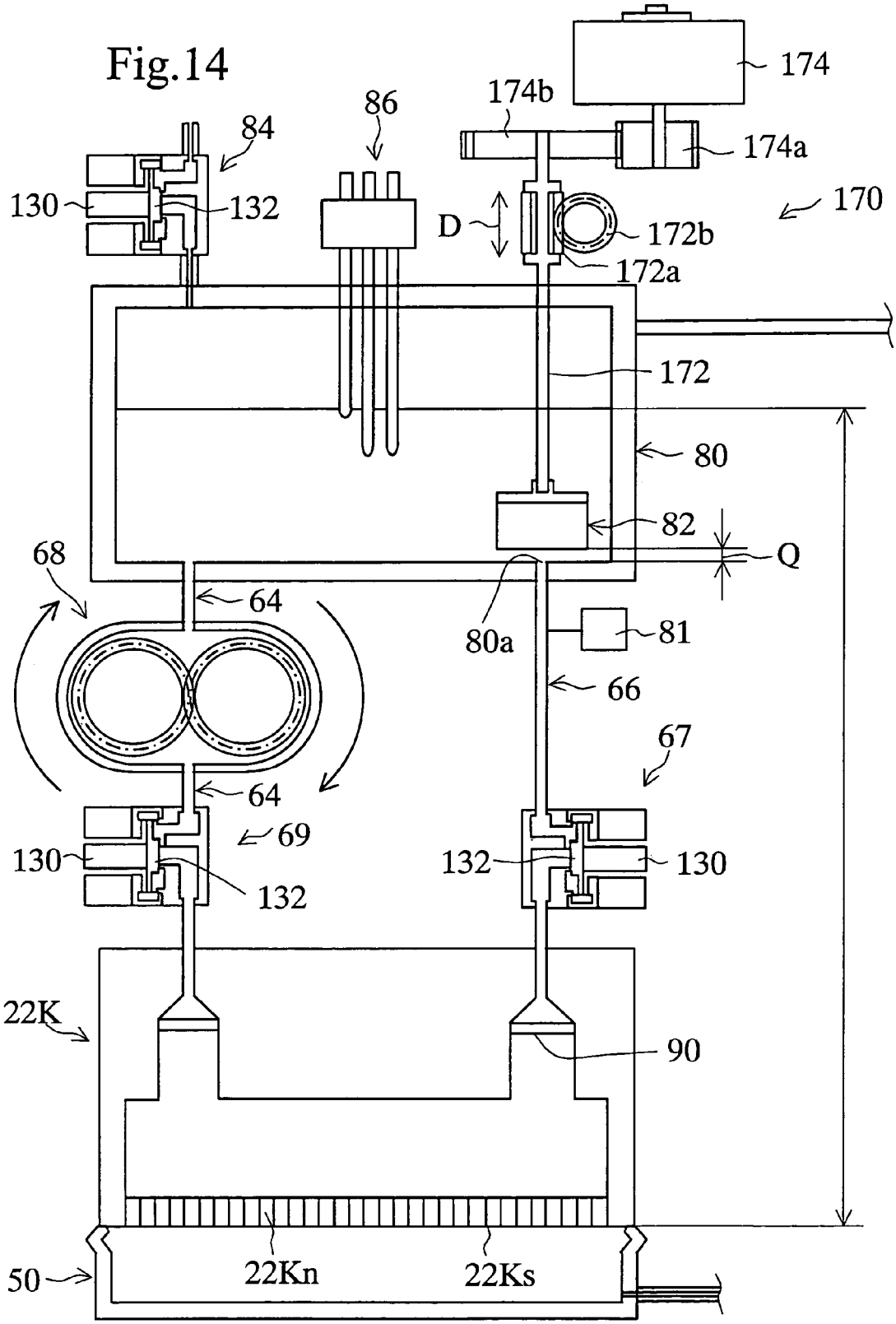
FIG. 14 shows schematically the ink-feeding device of Example 3.

FIG. 14 is a schematic drawing of the ink-feeding device of this Example 3. In this drawing, the same reference numbers and symbols as in FIG. 6 are used for indicating corresponding elements.

In the above Example 1, the rotation frequency of the blade 82*a* (FIG. 7) of the pressure-adjusting pump 82 is changed for controlling the negative pressure in the printing head 22K. In contrast, in the ink-feeding device 170 of this Example 3, the shaft 172 is made movable vertically (in the arrow-D direction) with the blade 82*a* of the pressure-adjusting pump 82 fixed to the shaft 172. The pressure is controlled by changing the position of the blade 82*a*: the blade 82*a* is rotated at a constant rotation frequency by a driving unit 174.

The shaft 172 has a rack 172*a*. A pinion gear 172*b* is engaged with the rack 172*a*. The rotation of the pinion gear 172*b* is controlled by a CPU (FIG. 2). The driving force of the driving unit 174 is transmitted through gears 174*a*, 174*b*, and so forth to the shaft 172.

In this Example 3, the negative pressure in the printing head 22K is controlled by changing the pitch Q between the blade 82*a* and the suction opening 80*a* (interval between the blade 82*a* and the suction opening 80*a*). With rotation of the blade 82*a* at a constant rotation frequency, a smaller pitch Q gives a strong force to suck the ink from inside the printing head 22K toward the sub-tank 80 to generate a stronger negative pressure in the printing head 22K, whereas a larger pitch Q gives a weak force to suck the ink from inside the printing head 22K to generate a weaker negative pressure in the printing head 22K. Thus, by adjusting the pitch Q to be larger or smaller, the negative pressure in the printing head 22K can be kept constant.

Example 4

Example 4 is explained by reference to FIGS. 15-18.

Figure 15:
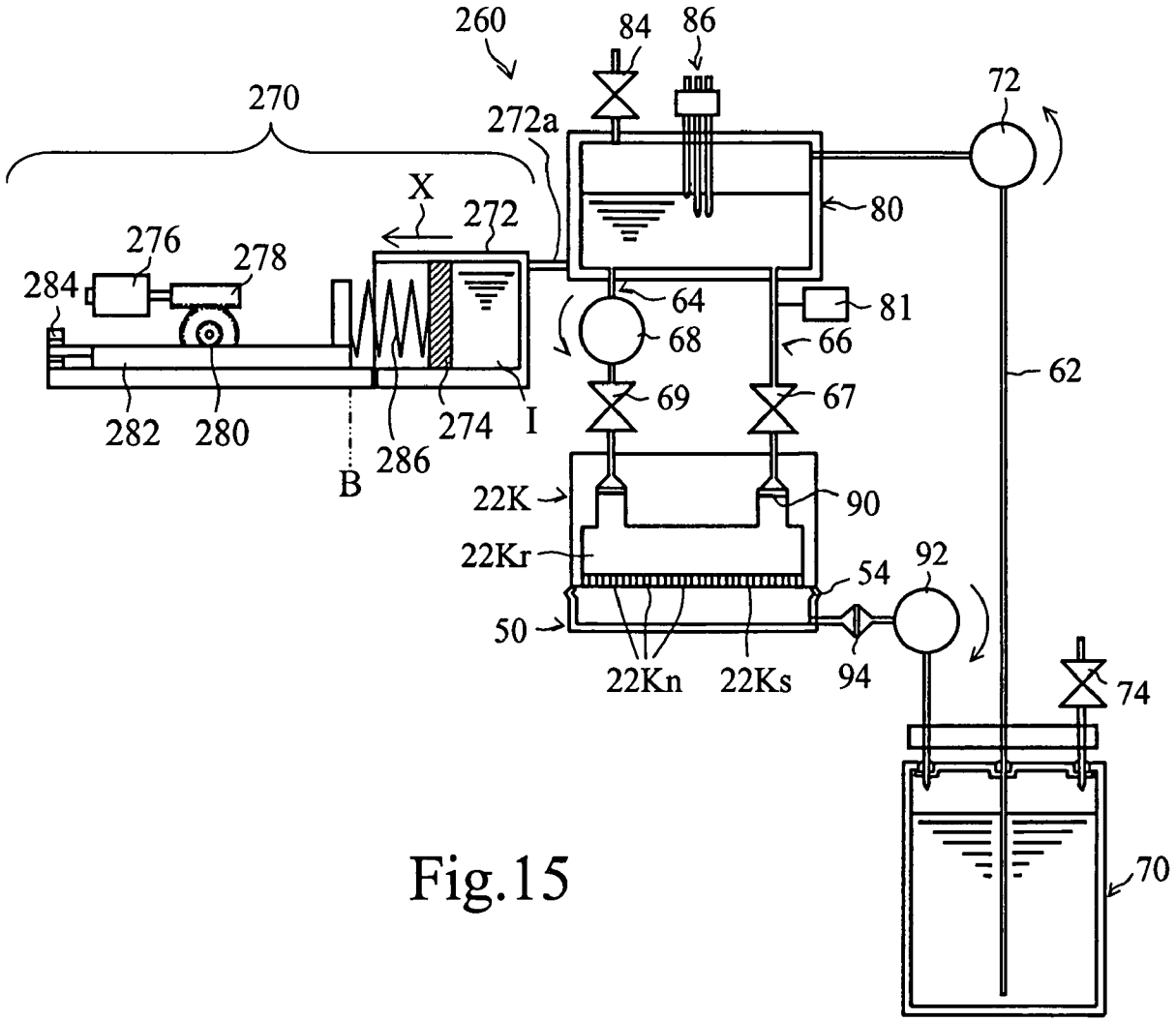
FIG. 15 is a schematic drawing of an ink-feeding device incorporated in an inkjet type image formation apparatus of Example 4.
Figure 16:
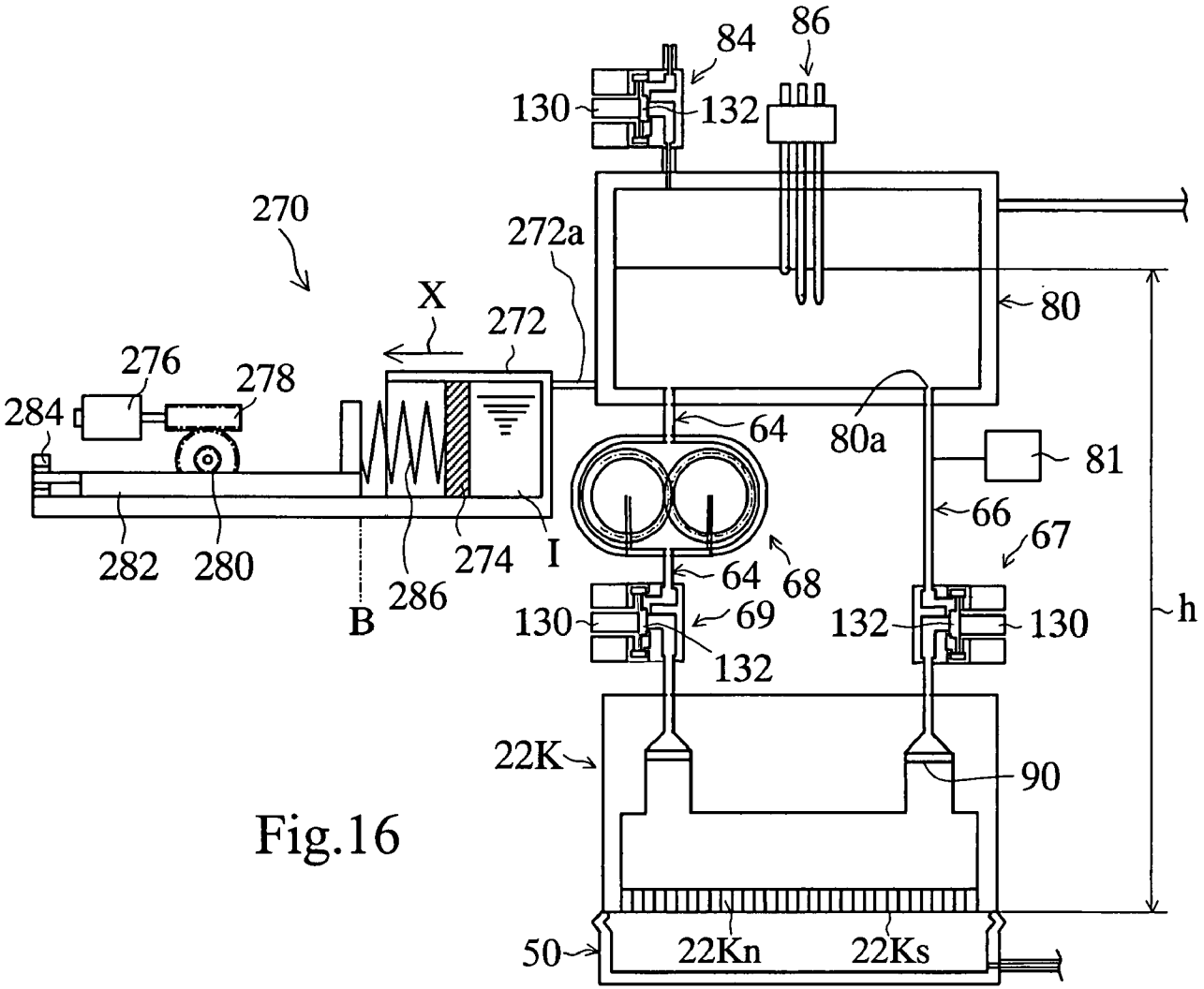
FIG. 16 is an enlarged drawing illustrating the pressure-adjusting unit and the sub-tank in FIG. 15 in detail.

FIG. 15 is a schematic drawing of the ink-feeding device of this Example 4. FIG. 16 is an enlarged view illustrating a sub-tank and a printing head in detail. In the drawings, the same reference numbers and symbols as in FIGS. 3 and 6 are used for indicating corresponding constitutional elements.

The ink-feeding device 260 of this Example 4 employs a pressure-adjusting unit 270 having a cylinder 272 and a piston 274 in place of the pressure-adjusting pump 82 employed in the above examples. The pressure-adjusting unit 270, which communicates with a sub-tank 80, serves to adjust the pressure in the printing head 22K. The ink is allowed to flow between the cylinder 272 of the pressure-adjusting unit 270 and the sub-tank 80 to adjust the pressure in the printing head 22K.

The pressure-adjusting unit 270 is constituted of a cylinder 272 communicating with the sub-tank 80, a piston 274 moving in the cylinder 272, a driving motor 276 for moving the piston 274, a worm gear 278 for transmitting the driving force of a motor 276, a pinion 280 engaging with the worm gear 278, a rack 282 engaging with the pinion 280, a photo-interrupter 284 for detection of the position of the rack 282, and a spring 286 transmitting the movement of the rack 282 to the piston 274. The cylinder 272 and the sub-tank 80 are connected by an ink flow channel 272*a*. The piston 274 and the cylinder 272 form a closed space for holding the ink flowing to or from the printing head 22K.

During image formation (during recording), a suitable negative pressure should be applied to the printing head 22K. In a state that the front face of the rack 282 (the face of the rack 282 nearest to the piston 274) is placed at the position B in FIG. 16, the pressure valve 67 is opened and a standby valve 69 and an air-vent valve 84 are closed to form a closed flow channel including the printing head 22K. In this state, when the rack 282 is moved in the arrow-X direction as shown in FIG. 16, the piston is moved together in the arrow-X direction. Thereby the pressure in the above closed flow channel is reduced to move the ink in the printing head backward, forming an arc-shaped meniscus in the nozzle of the printing head 22K. A fine adjustment of the pressure is possible owing to the presence of compressible air in the sub-tank 80 not filled with an incompressible fluid. The negative pressure to be applied to the printing head 22K is controlled by displacement of the piston 274.

The procedure for the recording operation starting from the standby mode is explained by reference to FIGS. 17 and 18.

Figure 17:
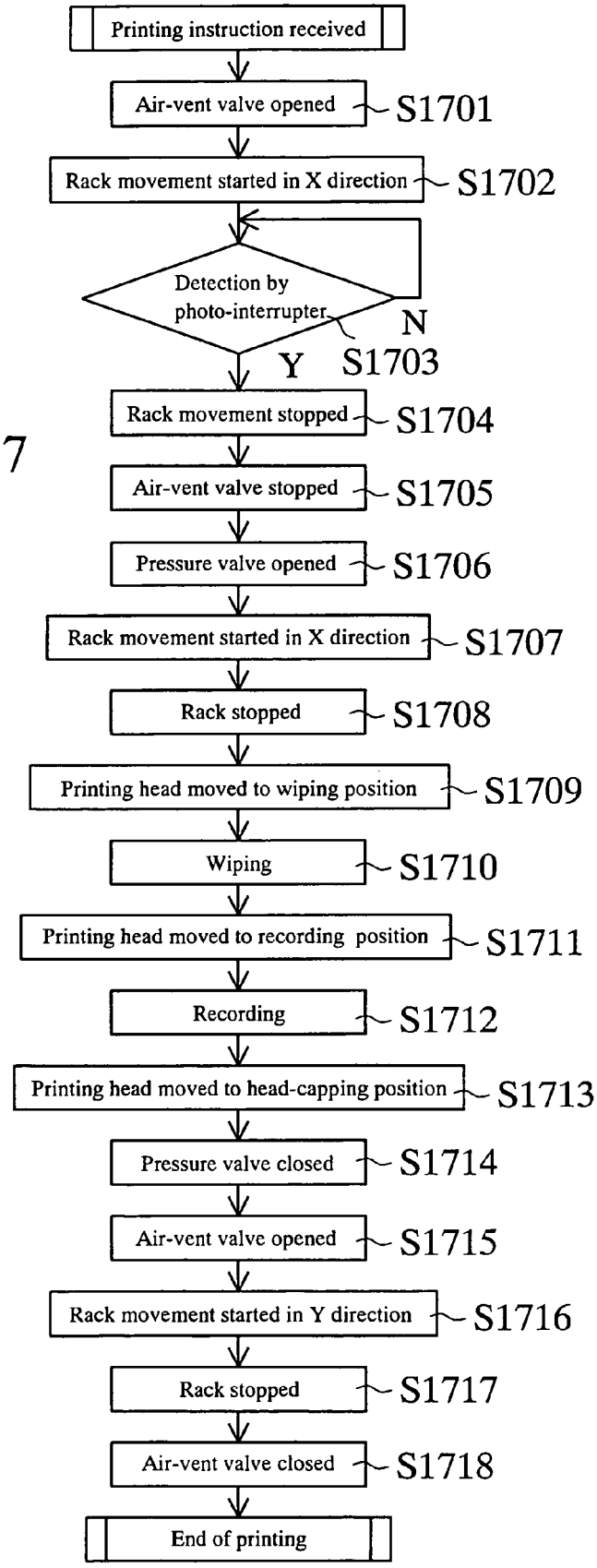
FIG. 17 is a flow chart showing a procedure for recording operation starting from a standby mode.

FIG. 17 is a flow chart showing a procedure for recording operation starting from a standby mode. FIG. 18(*a*) shows schematically a pressure-adjusting unit in a standby state. FIG. 18(*b*) shows schematically the pressure-adjusting unit during image formation.

In the standby state, the front face of the rack 282 is at position as shown in FIG. 18*a*, and the piston 274 is in contact with the innermost wall of the cylinder 272. In this standby state, the waiting valve 69, pressure valve 67, and the air-vent valve 84 are closed. In FIG. 17, the flow is started by receiving the instruction for printing. Firstly, the air-vent valve 84 is opened (S1701), and simultaneously the motor 276 is started. The started motor 276 moves the rack 282 in the arrow-X direction (S1702). This movement pulls the spring 286 to move the piston 274 also in the arrow-X direction to fill an ink I in the cylinder 272.

On detection of the front face of the rack 282 at the position B in FIG. 18(*b*) by the photo-interrupter (S1703), the motor 276 is stopped to stop the movement of the rack 282 (S1704). Thereby the spring 286 deformed by the above movement of the rack 282 tends to return to a certain length (the length without a load on the spring 286) to pull the piston 274 in the arrow-X direction. As the result, the spring 286 comes to have a length L as shown in FIG. 18(*b*). Then the air-vent valve 84 is closed (S1705), and the pressure valve 67 is opened (S1706) to form a closed liquid flow channel circuit including the printing head 22K. Withdrawal of the rack 282 to the position B allows generation of the negative pressure. As the gear for transmitting the driving force of the motor 276, a worm gear 278 is used to stop the movement of the gear caused by the movement of the piston 274 after the stop of the motor 276 in this example. However, any type of the mechanism may be used without limitation.

In the above state, the rack 282 is moved further in the arrow-X direction (S1707). This movement generates a negative pressure in the nozzle of the printing head 22K according to the above-described negative pressure-generation mechanism. The movement of the rack 282 is stopped at a position to generate a suitable negative pressure (S1708). In this state, the printing head 22K is moved to a wiping position (S1709) to conduct the wiping (S1710). After the end of the wiping, the printing head 22K is moved to the recording position (S1711). After this movement, the recording is conducted (S1712).

During the recording, ejection of the ink makes negative the pressure in the nozzles of the printing head 22K, which elongate the spring 286 to be longer than the length L. The length of the spring 286 is detected continuously by a sensor (not shown in the drawing), and the motor 276 is controlled to move the rack 282 to keep spring 286 at the length L when the length deviates from the length L. This control adjusts the pressure change by printing (change of the negative pressure applied to the ink in the nozzles) to keep the negative pressure constant in the nozzles in the printing head 22K. In this example, the length L of the spring 286 is detected (monitored) to adjust the position of the rack 282. The adjustment is not limited thereto. For instance, a movement table is preliminarily prepared for the dependence of the change of the negative pressure on the consumed amount of the ink; the consumed amount of the ink is detected by counting the dots; and the rack 282 is moved according to detected ink consumption on the basis of the movement table to keep the negative pressure constant in the nozzles in the printing head 22K.

Normally, the printing is controlled as above. However the amount of the ink ejected in a unit time from the printing head 22K can increase suddenly, or conversely decreased suddenly. Sudden increase of ink ejection render the ink feed insufficient (shortage of the ink) to the printing head 22K, tending to cause increase of the negative pressure in the nozzles in the printing head 22K (more negative than a prescribed level). Conversely, sudden decreases of ink ejection tends to decrease the negative pressure in the nozzles in the printing head 22K (less negative than a prescribed level) owing the inertia of the ink. The fluctuation of the negative pressure (pressure fluctuation) can be controlled by adjusting the position of the rack 282 to adjust the length L of the spring 286.

When the amount of the ink ejected per unit time (ink ejection) is increasing, the rack 282 is moved in the arrow-Y direction as shown in FIG. 18(*b*). Conversely when the amount of the ink ejected per unit time is decreasing, the rack 282 is moved in the arrow-X direction as shown in FIG. 18(*b*). In the case where the amount of the ink ejected per unit time is remarkably large, the air-vent valve 84 is opened to feed (send) the ink positively by a water head difference h (FIG. 16) to the nozzle of the printing head 22K without causing an excessively negative pressure. By the control as above, a suitable negative pressure is invariably applied to nozzles of the printing head 22K without excessive negative pressure application.

For the above control, in one method, an optimum pressure table regarding formed images and ink ejection frequencies is prepared preliminarily. The position of the rack 282 is controlled according to this pressure table. For instance, in continuous printing, the amount of the ink to be used for the next image formation is compared with the amount of the ink held in the cylinder 272, and when the shortage of the ink in the printing is estimated preliminarily, the rack 282 is moved to the position shown in FIG. 18(*a*) and then the rack 282 is moved to the position shown in FIG. 18(*b*) to fill the ink for printing.

In another method for the control, the displacement of the rack 282 can be controlled by feeding back a signal regarding the pressure of the ink in the flow channel 66 (FIG. 16) detected by the pressure sensor 81 to the driving circuit of the motor 276. In this method, when the fluctuation of the ink ejection is within an allowable range and causes no problem in the formed image quality, the length L of the spring 286 is kept constant by the control. After the recording operation in the step S1712, the printing head 22K is again raised and is capped (S1713). Then the pressure valve 67 is closed (S1714), cir-communication valve 84 is opened (S1715), the rack 282 is moved to the position shown in FIG. 18(*a*) (S1716) and is stopped at the prescribed position (S1717), and the air-vent valve 84 is closed (S1718) to bring the system to the standby mode.

As described above, irrespective of the relative positions of the printing head 22K and the sub-tank 80, the inside of the printing head 22K can be kept at a suitable negative pressure by the pressure-adjusting unit 270. This increases the freedom degree in designing the device without restriction of the placement position of the sub-tank 80 in comparison with the conventional device utilizing water head difference. Incidentally in this Example 4, the pressure-adjusting unit 270 is connected to the sub-tank 80, but the same effect can be achieved by connecting the pressure-adjusting unit 270 to the inside of the printing head 22K. The pressure-adjusting unit 270 may be connected to the upper space of the sub-tank 80 to control the compressive air. The pressure-adjusting unit 270 need not be separately provided, but may be integrated with the sub-tank 80. The pressure-adjusting unit 270 is not limited to be constituted of a piston 274, a spring 286, and the like, but may comprise a volume-changing means for changing the volume of the cylinder 272 and a means for changing the volume in accordance with ink consumption by printing.

Example 5

Example 5 is explained by reference to FIG. 19.

Figure 19:
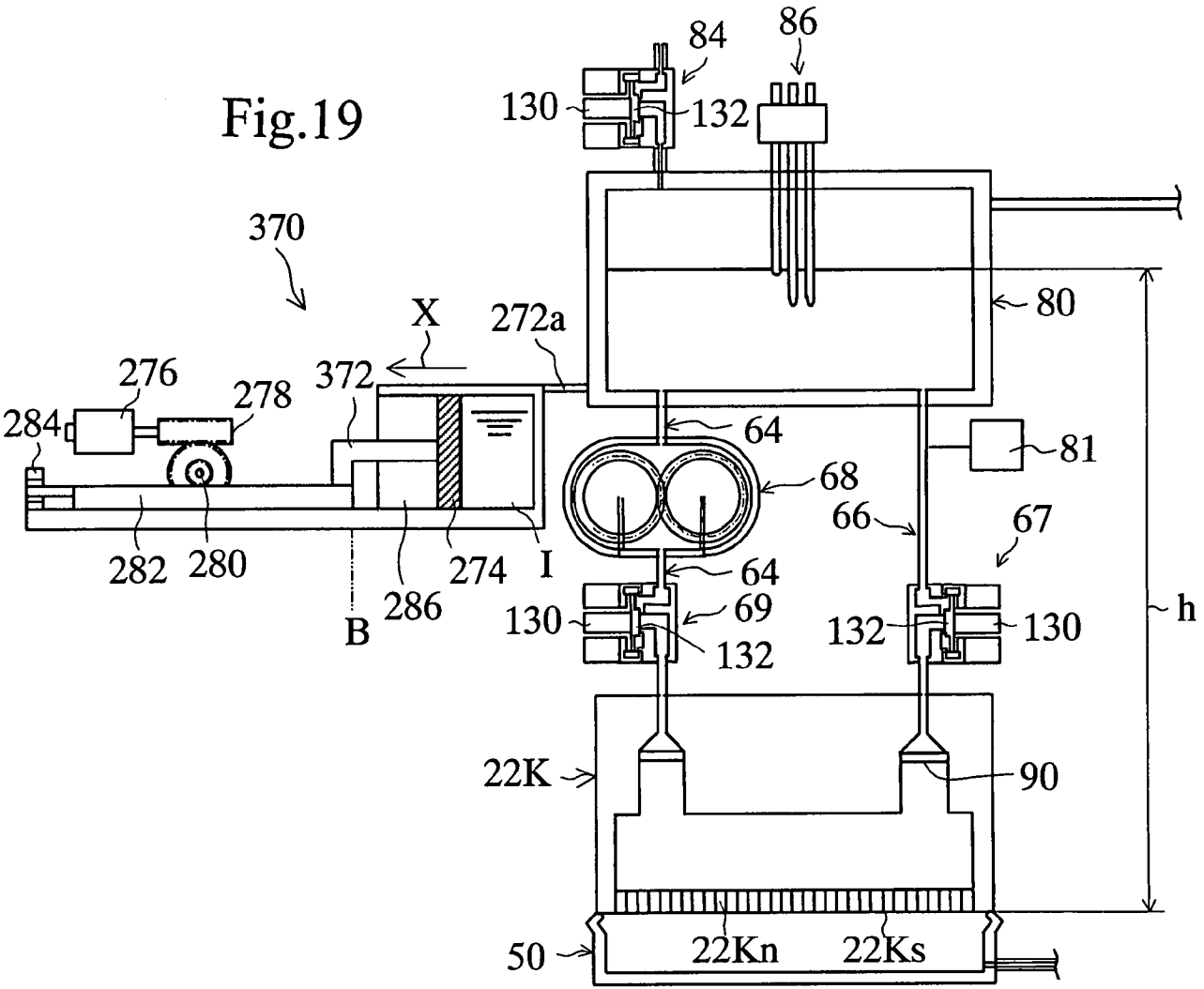
FIG. 19 shows schematically the ink-feeding device of Example 5.

FIG. 19 is a schematic drawing of the ink-feeding device of this Example 5. In FIG. 19, the same reference numbers and symbols as in FIG. 16 are used for indicating corresponding elements.

In the ink-feeding device 370 of Example 5, a connecting rod 372 connects directly the piston 274 with the rack 282. This is different from Example 4 in which the piston 274 and the rack 282 are connected by the spring 286 (FIG. 16) to keep the negative pressure constant by moving the rack 282 by deformation (length change) of the spring 286 by displacement of the piston 274 following the printing. Without the spring 286, the negative pressure can be controlled by controlling strictly the amount of the air in the sub-tank 80 with the piston 274 and the rack 282 joined directly by the connecting rod 372 of the ink-feeding device 370, and thereby controlling the amount of the ink in the sub-tank 80. The pressure can be controlled more precisely by utilizing the pressure sensor 81.

Example 6

Example 6 is explained by reference to FIG. 20.

Figure 20:
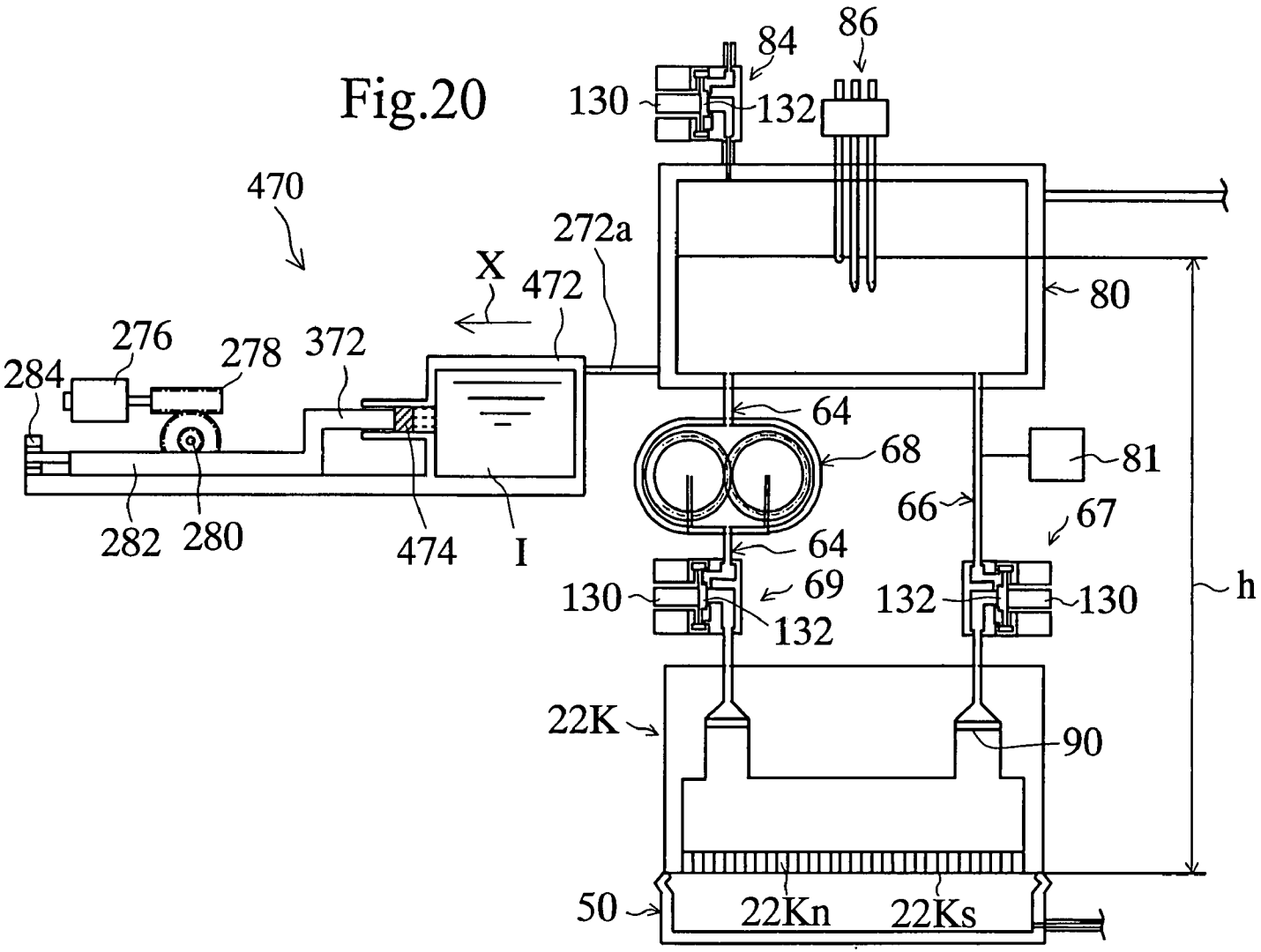
FIG. 20 shows schematically the ink-feeding device of Example 6.

FIG. 20 is a schematic drawing of the ink-feeding device of this Example 6. In FIG. 20, the same reference numbers and symbols as in FIG. 19 are used for indicating corresponding elements.

In the ink-feeding device 470 of Example 6, the diameter of the cylinder 472 is made smaller. Into the small-diameter portion of the cylinder, a piston 474 having a suitable diameter is fit. The smaller diameter of the cylinder like the cylinder 472 enables further fine adjustment of the pressure in the printing head 22K. The pressure can be more precisely controlled by utilizing the pressure sensor 81.

Example 7

Another example of the ink-feeding device incorporated in the printer 10 is explained by reference to FIGS. 4, 5, and 21. In this Example, the "cleaning pump" in FIG. 4 should be read as a "circulation pump" in this Example.

Figure 21:
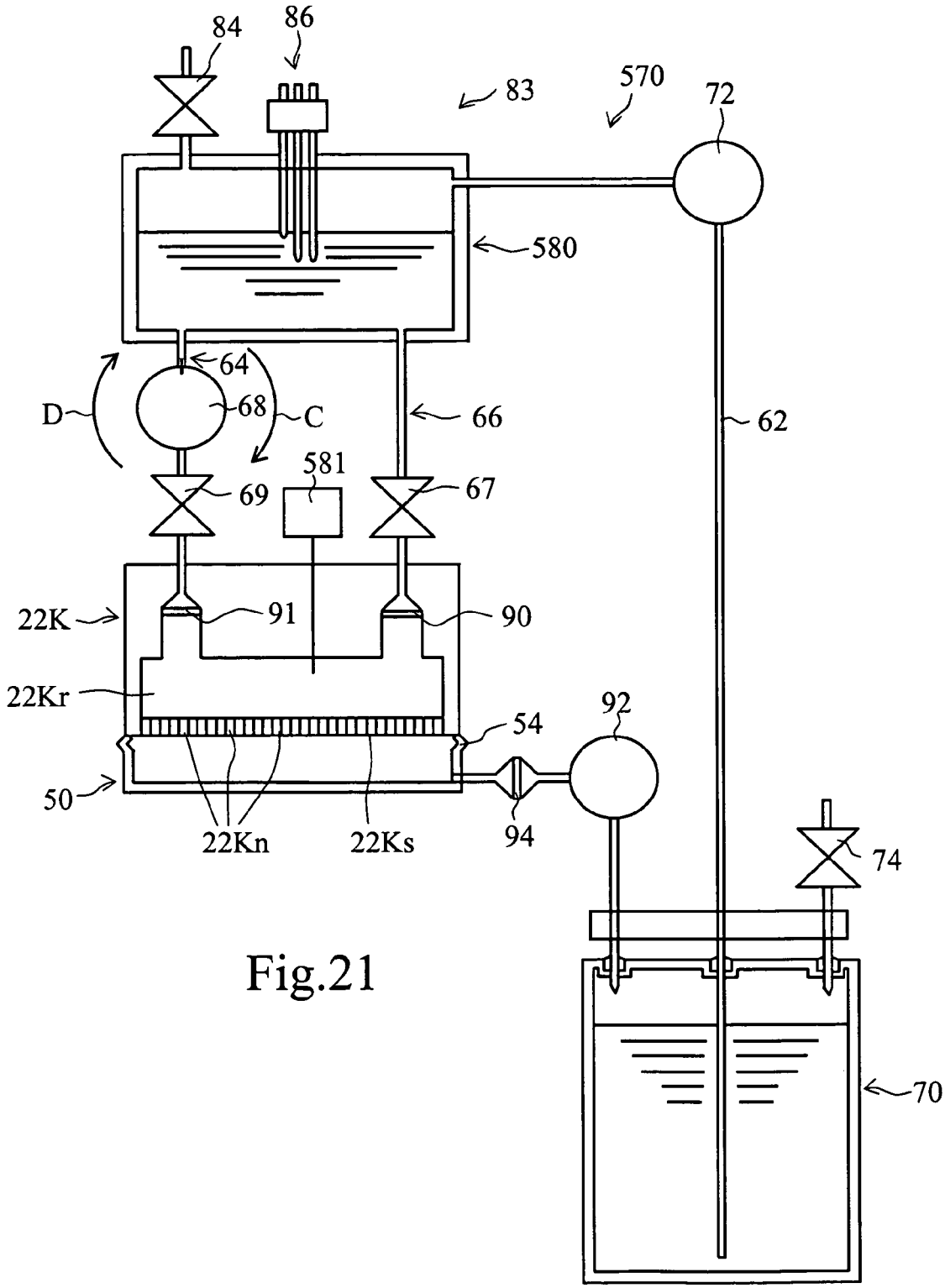
FIG. 21 shows schematically the ink-feeding device of Example 7.

FIG. 21 illustrates schematically the ink-feeding device of Example 7 incorporated into an inkjet type image-forming device. FIG. 21 shows an ink-feeding device for feeding an ink to the printing head 22K and recovering the printing head 22K. In other printing heads 22C, 22M, and 22Y also, ink-feeding devices of the same constitution are installed. In FIG. 21, the same reference numbers and symbols as in FIGS. 1 and 2 are used for indicating corresponding elements.

The printer 10 (FIG. 10) incorporates an ink-feeding device 570 for feeding an ink to the printing head 22K. The ink-feeding device 570 has a replaceable ink tank 70 demountable from the main body of the printer 10, and a sub-tank 580 placed within the ink-feeding channel 62 connecting the ink tank 70 with the printing head 22K. The printing head 22K is placed below the sub-tank 580. The liquid face of the ink held in the sub-tank 580 is higher than the ink ejection openings of the nozzles 22Kn.

The sub-tank 580 and the printing head 22K are connected by two ink flow channels 64,66. The ink flow channel 64 is an example of the first ink circulation channel in the present invention, and the ink flow channel 66 is an example of the second circulation channel in the present invention. The sub-tank 580 and the printing head 22K are fixed to the same frame (not shown in the drawing). Therefore, the sub-tank 580 and the ink flow channels 64,66 move together with the printing head 22K.

The ink flow channel 64 connects the bottom of the sub-tank 580 and the upper portion of the liquid chamber (ink-holding chamber) 22Kr of the printing head 22K. The ink flow channel 66 connects also the bottom of the sub-tank 580 and the upper portion of the liquid chamber (ink-holding chamber) 22Kr of the printing head 22K at connection positions different from the connecting positions of the ink flow channel 64.

In the ink flow channel 64, a circulation pump (cleaning pump) 68 is installed for circulating the ink between the sub-tank 580 and the liquid chamber 22Kr. The circulation pump 68 is driven to circulate the ink from the sub-tank 580 through the ink flow channel 64, the liquid chamber 22Kr, and the ink flow channel 66 to return to the sub-tank 580, repeatedly. The circulation pump 68 rotated reversely causes ink circulation from the sub-tank 580 through the ink flow channel 66, the liquid chamber 22Kr, and the ink flow channel 64 to the sub-tank 580, repeatedly. Since the circulation pump can be rotated reversely, the ink can be circulated in two directions. The circulation pump 68 is used also for cleaning the printing head 22K.

In the ink flow channel 64, a standby valve 69 is installed for opening and closing the ink flow channel 64 at a predetermined timing. In the ink flow channel 66, a pressure valve 67 is installed for opening and closing the ink flow channel 66 at a predetermined timing. In the printing head 22K, a pressure sensor 581 is installed for detecting the ink pressure in the liquid chamber 22Kr.

On the ceiling wall of the sub-tank 580, an air-vent valve 84 is installed for equalizing the inside pressure in the sub-tank 580 to the atmospheric pressure. The air-vent valve 84, when opened, equalizes the inside pressure of the sub-tank 580 to the atmospheric pressure. In the sub-tank 580, a conventional liquid-level sensor 86 is installed for detecting the liquid level of the ink (stored ink) in the sub-tank 580. When the liquid-level sensor 86 detects the liquid level in the sub-tank 580 lower than a certain level, the feed pump 72 is started to suck up the ink from the ink tank 70 to feed the ink to the sub-tank 580. On the other hand, when the liquid-level sensor 86 detects the liquid level in the sub-tank 580 to reach a predetermined upper-limit level, the feed pump 72 is stopped to interrupt the ink feed.

In the ink tank 70, a sensor is installed (not shown in the drawing) for detecting the presence of the ink in this ink tank 70. In the air flow path for mounting the ink tank 70 on the main body of the printer 10, an air-vent valve 74 is installed for equalizing the inside pressure of the ink tank 70 to the atmospheric pressure.

The operation of cleaning the printing head 22K is explained below.

The cleaning operation herein signifies an operation for maintaining the ink ejection performance of the printing head 22K, and this operation is conducted automatically or non-automatically when the lapse of ejection time or the ejection state comes to a predetermined condition or when the image quality becomes abnormal.

As shown by the flow chart in FIG. 4 mentioned above, the cleaning operation is started on reception of cleaning instructions (S401). On receiving the cleaning instructions, the air-vent valve 84, the pressure valve 67, and the standby valve 69 are opened successively (S402-S404). Then the cleaning pump 68 is started (rotated in the arrow-C direction) (S405) to send the ink by pressure from the sub-tank 580 through the ink flow channel 64 to the printing head 22K. This ink feed by pressure flushes a bubble or bubbles staying at a filter 90 in the side of the sub-tank 580 during the recording and other operations back into the sub-tank 580.

After driving the cleaning pump 68 for a certain time, the pressure valve 67 is closed (S406) to close the ink flow channel 66. Thereby a strong positive pressure is applied to the liquid chamber 22Kr of the printing head 22K. This strong positive pressure discharges the ink from the nozzles 22Kn of the printing head 22K to remove a foreign matter such as bubbles and dirt in and around the nozzle 22Kn.

Further, after a certain time, the circulation pump 68 is stopped (S407), and the standby valve 69 and the air-vent valve 84 are closed successively (S408, S409). In this state, the face 22Ks of the nozzles 22Kn including the nozzle outlets of the printing head 22K is in an uncleaned state soiled by the ink. To remove the soiling matters, the face 22Ks is wiped with a wiper 52 fixed to the capping mechanism 50. In this wiping operation, the printing head 22K is moved up above the recovery cap 54 as shown in FIG. 5(*a*) (S410). Then the recovery cap 54 is moved in the arrow-B direction as shown in FIG. 5(*b*) to wipe the soiling matter like an ink adhering to the face 22Ks by a wiper 52 (S411). This operation is called a wiping operation. After the wiping operation, the printing head 22K is capped and brought again to the standby state as shown in FIG. 5(*c*) (S412). The printing head 22K in the standby state is capped at the face 22Ks by a recovery cap 54 to prevent ink viscosity increase in the nozzle 22Kn. The ink discharged from the printing head 22K (waste ink) is received by the recovery cap 54 and is sucked by a suction pump 92 (FIG. 21). This waste ink is filtered (screened) by a filter 94 (FIG. 21) to eliminate the foreign matters and is returned to the ink tank 70. The wiping operation only may be conducted at a suitable timing.

The adjustment of the pressure in the printing head 22K by a circulation pump 68 is explained below by reference to FIGS. 22 and 23.

Figure 22:
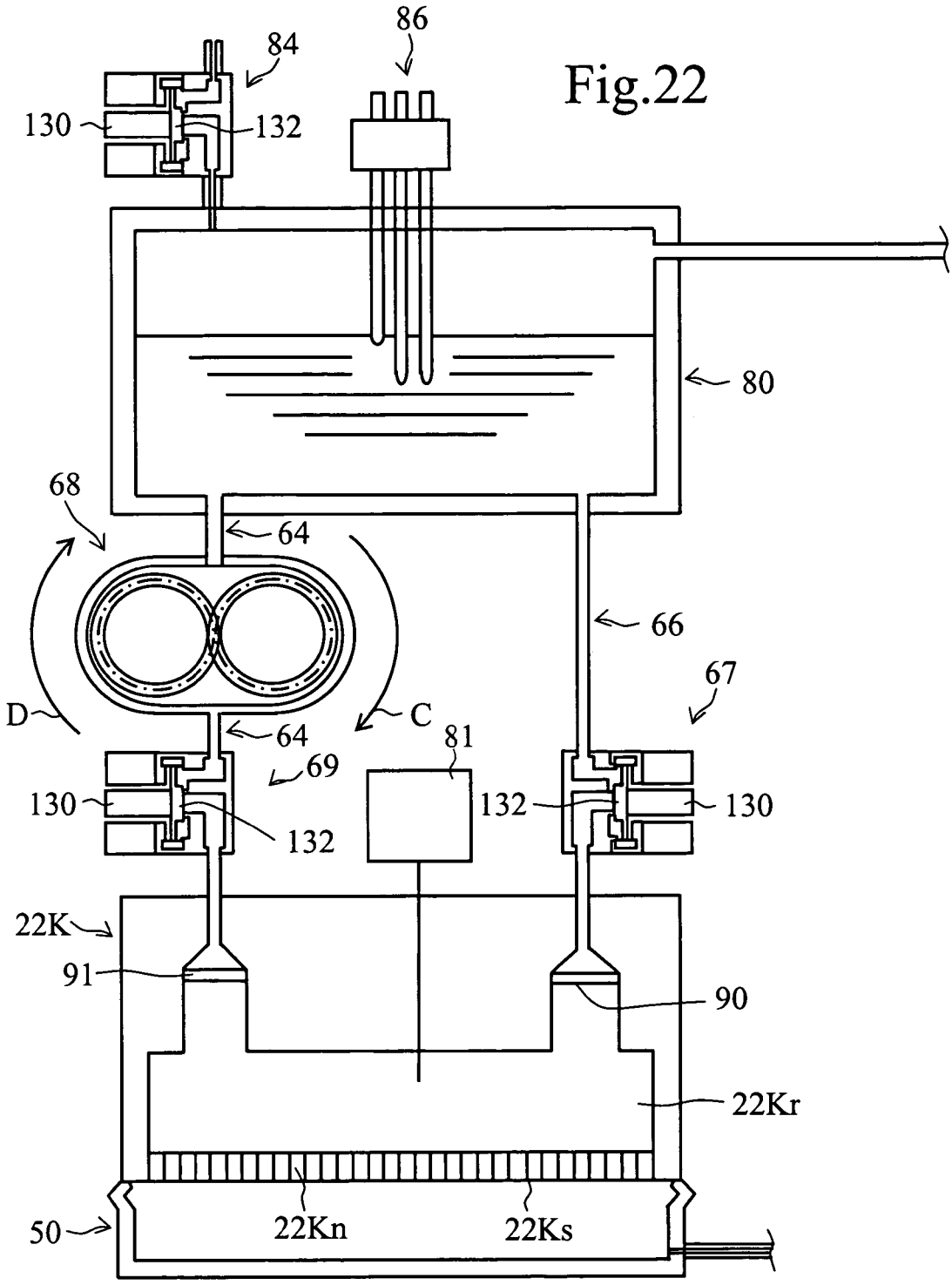
FIG. 22 is an enlarged drawing showing an ink-feeding device.

FIG. 22 is an enlarged drawing showing an ink-feeding device. FIG. 23 is a pressure distribution diagram showing change of the ink pressure in the circulation path of the ink. In these drawings, the same reference numbers and symbols as in FIG. 21 are used for indicating corresponding elements. The pressure distribution diagram of FIG. 23 shows the pressures at the sections in the ink circulation path spread in a plane including the circulation pump 68. Further, in FIG. 23, the symbols (numbers) on the upper side of the arrows indicate the members (e.g., the number 68 indicates the circulation pump), the symbols on the left side of the arrow (e.g., 68IN for circulation pump 68) showing the pressure at the ink inlet side, and the symbols at the right side of the arrow (e.g., 68OUT for circulation pump 68) showing the pressure at the ink outlet side.

The aforementioned pressure valve 67, the standby valve 69, and the air-vent valve 84 are, as shown in FIG. 22, respectively an electromagnetic valve which intercepts the ink flow channel by a valve sheet 132 integrated with a solenoid plunger 130. However, any type of valve may be used in the present invention without limiting thereto. The circulation pump 68 is a gear pump in this example, but may be a tube pump, or another type of pump.

In the recording, a suitable negative pressure should be applied to the printing head 22K. (That is, a pressure is applied to the ink to form a meniscus of the ink at the ink ejection opening (nozzle outlet) of the printing head 22K). For the negative pressure application, the pressure valve 67, standby valve 69, and the air-vent valve 84 are opened. In this state, the circulation pump 68 is driven to rotate in the arrow-D direction. Thereby, the ink in the sub-tank 580 is allowed to flow from the sub-tank 580 through the pressure valve 67, filter 90, liquid chamber 22Kr of the printing head 22K, the filter 91, the standby valve 69, and the circulation pump 68 to return to the sub-tank 580.

The pressure of the ink circulated as above at the portions (e.g., the ink suction side 68IN and the ink discharging side 68OUT of the circulation pump 68) in the ink circulation path becomes more and more negative by passing through the members causing pressure loss to the maximum negative pressure at the ink suction side 68IN of the circulation pump 68. The ink is made to be at a positive pressure by the circulation pump 68 and is returned to the sub-tank 580 by the pressure.

Figure 23:
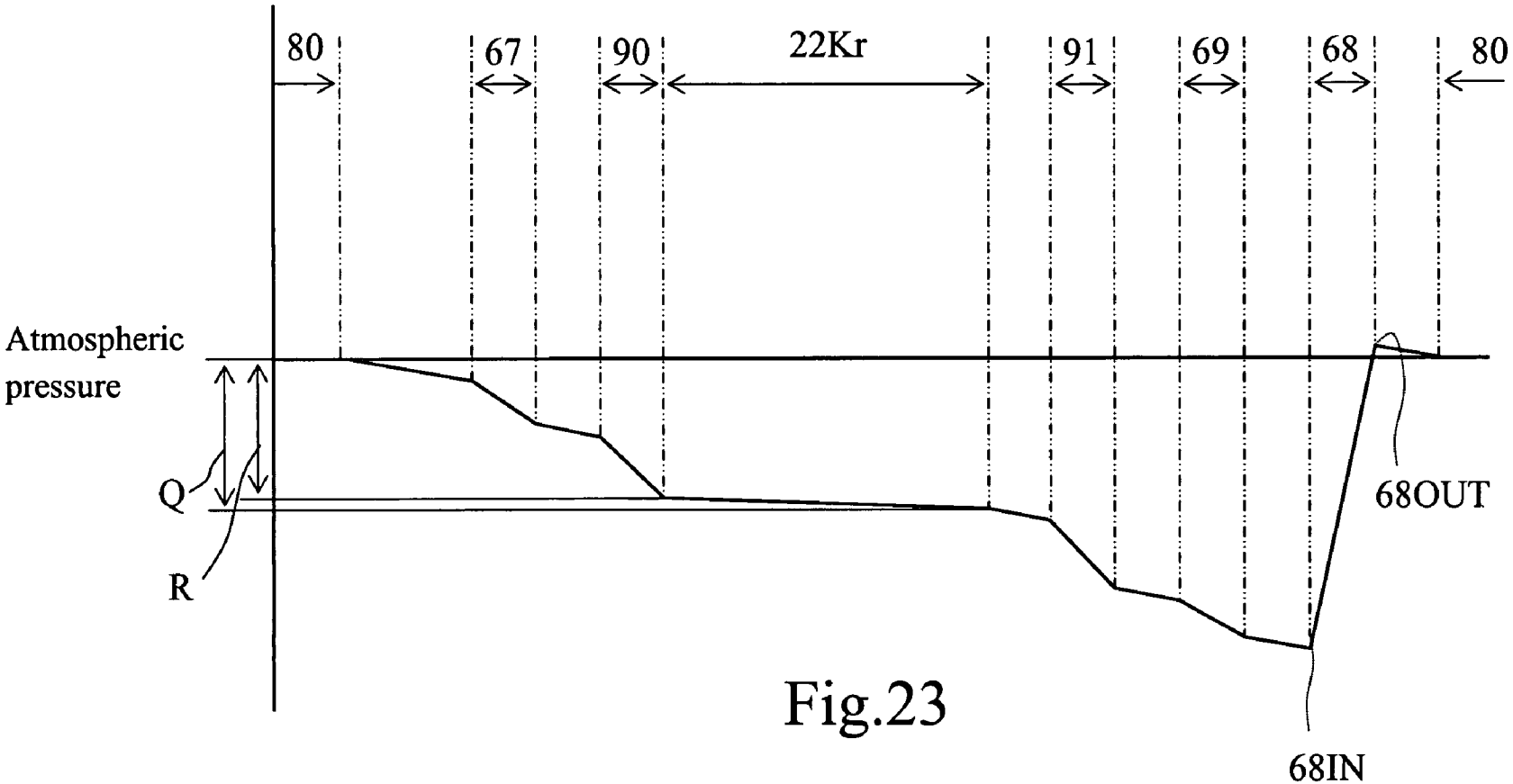
FIG. 23 shows distribution of the pressure in an ink circulation channel.

The pressures (negative pressure) shown in FIG. 23, a pressure distribution diagram, are nearly proportional to the flow rate of the circulation of the ink caused by the circulation pump 68 (the flow rate of the circulating ink). Therefore, the pressure exerted (applied) to the printing head 22K (the negative pressure within the range from Q to R in FIG. 23) can be controlled by controlling this ink flow rate. The pressure loss (Q minus R) in the liquid chamber 22Kr can be made smaller by enlargement of the sectional area of the flow path in the liquid chamber 22Kr, or a like method. Therefore, the pressure (negative pressure) applied to the ink can be uniformized throughout the nozzles communicating with the liquid chamber 22Kr.

The procedure for the recording operation starting from the standby mode is explained by reference to FIGS. 10, 24, 25, and 26.

Figure 24:
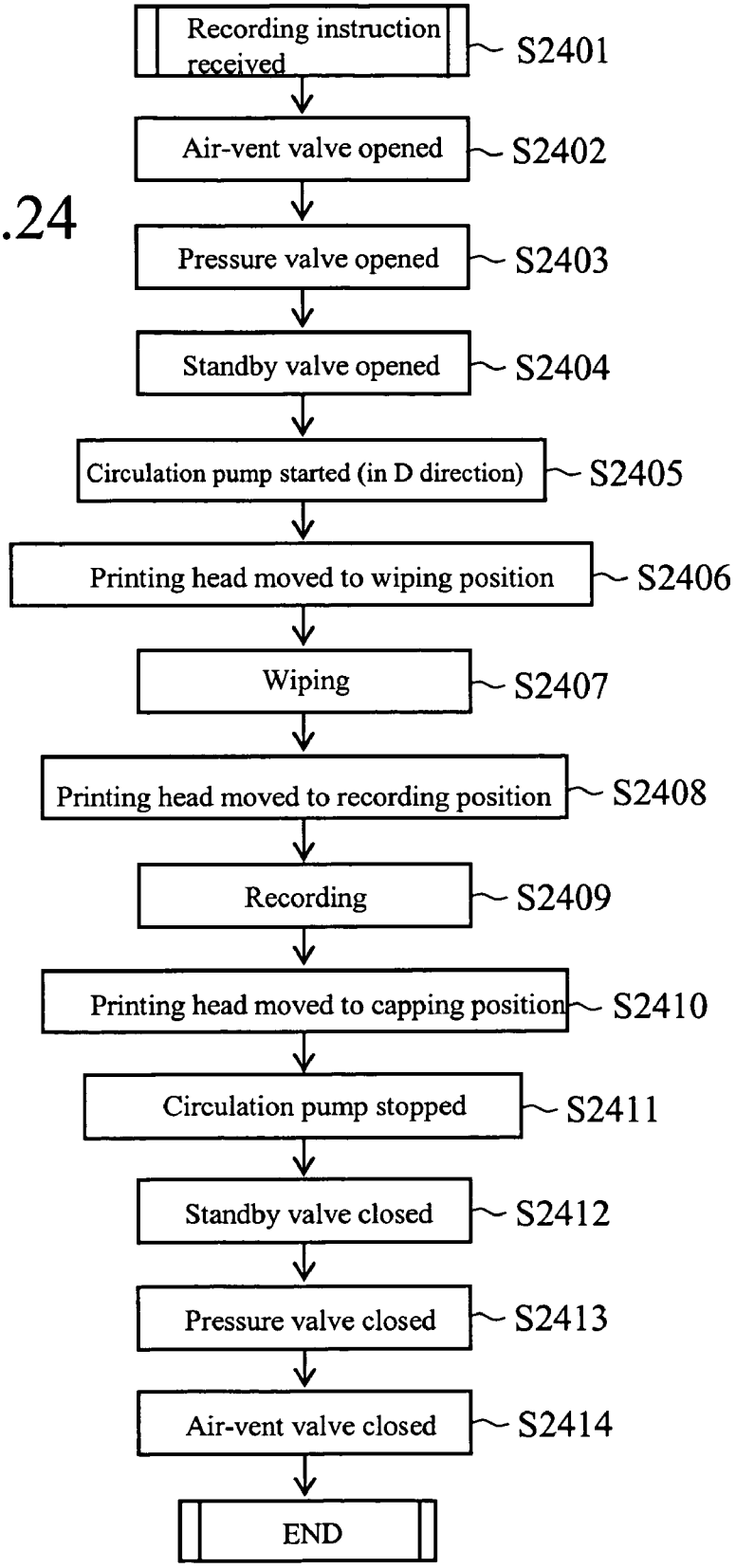
FIG. 24 is a flow chart showing a procedure for recording operation starting from a standby mode.
Figure 25:
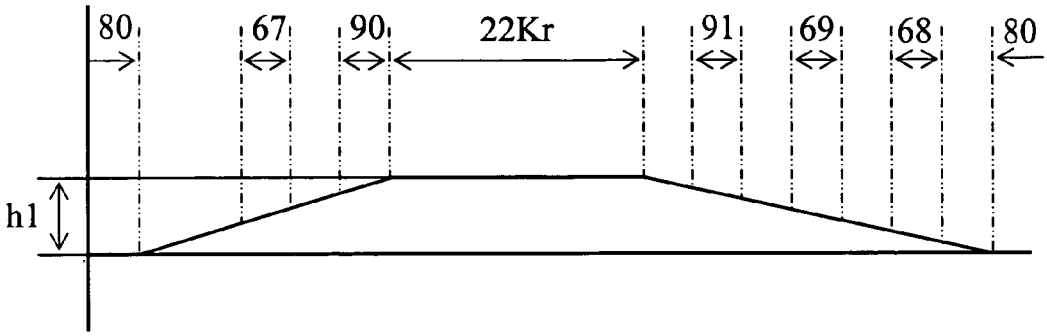
FIG. 25(*a*) is a graph showing the pressure in an ink circulation channel caused only by water head difference, and FIG. 25(*b*) is a graph showing the pressure in the ink circulation channel with a circulation pump driven.
Figure 25:
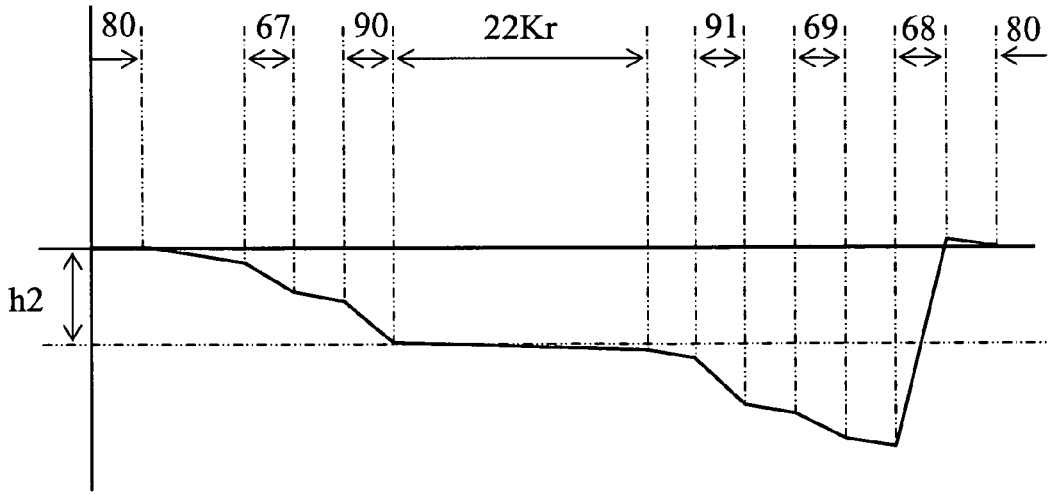
Figure 26:
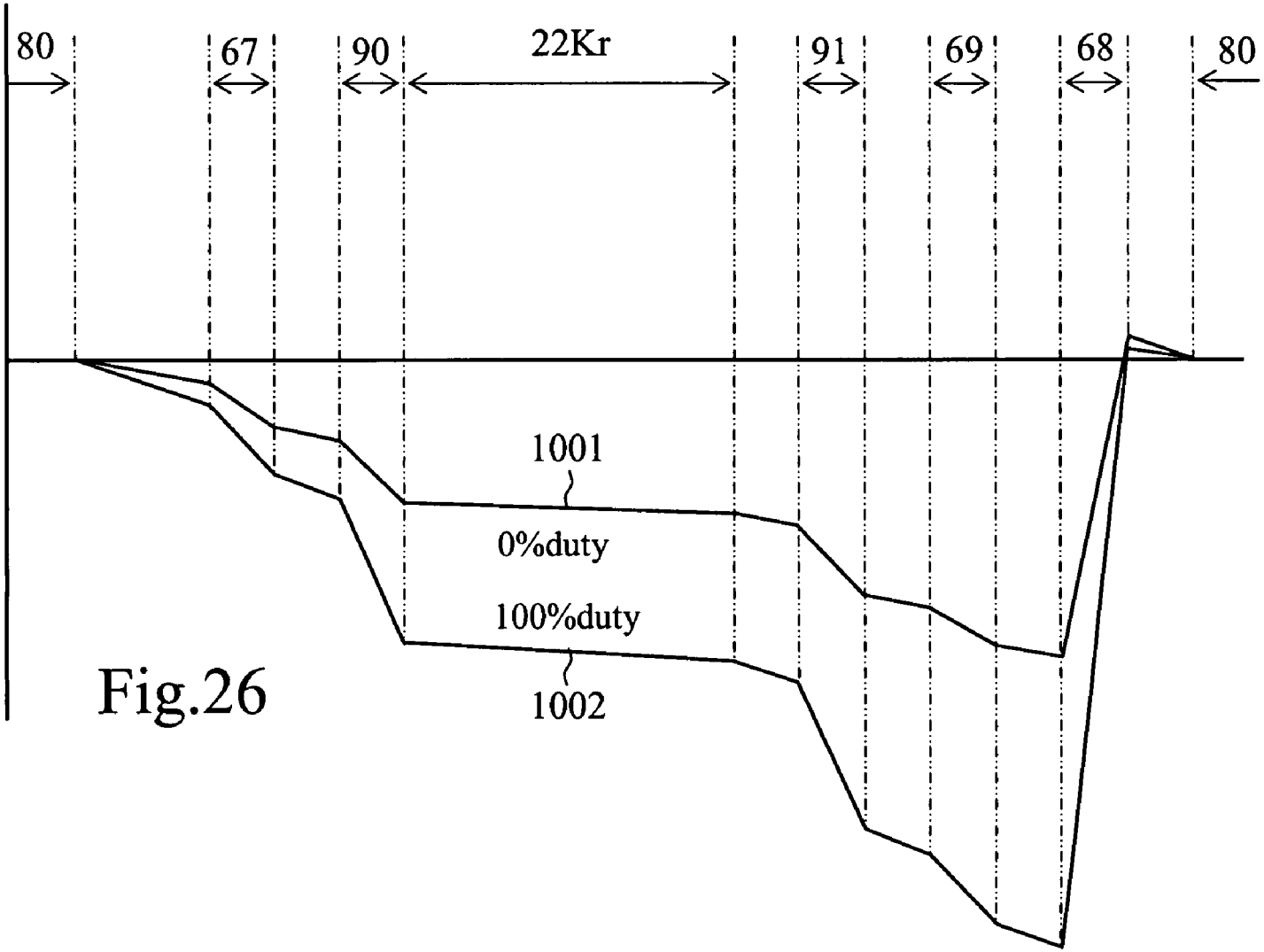
FIG. 26 is a graph showing the pressure in an ink circulation channel at printing duty (ejection duty) of 0% and 100%.

FIG. 24 is a flow chart showing the procedure for the recording operation starting from the standby mode. FIG. 25(*a*) is a graph showing the pressure caused only by water head difference in the ink circulation path. FIG. 25(*b*) is a graph showing the pressure with the circulation pump driven. FIG. 26 is a graph showing the pressure in the ink circulation path at 0% and 100% printing duty (ejection duty). In FIGS. 25 and 26, the same numbers and symbols as in FIG. 23 are used for indicating corresponding members.

On receiving instructions for printing in the standby mode (S2401), the air-vent valve 84 is opened (S2402). Successively, the pressure valve 67 is opened to open the ink flow channel 66 (S2403). In this Example, a sub-tank 580 is placed higher than the printing head 22K. Therefore, opening of the air-vent valve 84 and the pressure valve 67 applies a water head pressure h1 (FIG. 25(*a*)) to the nozzle 22Kn of the printing head 22K, and ink tends to flow from the sub-tank 580 through ink flow channel 66 into the printing head 22K. In this state, the standby valve 69 is opened (S2404) and the circulation pump 68 is driven (S2405) to generate the aforementioned negative pressure. Thereby the water head pressure h1 (FIG. 25(*a*)) is canceled and a negative pressure h2 is applied to the nozzle 22Kn of the printing head 22K. Consequently as mentioned above, a negative pressure is applied to the ink in the printing head 22K to form a meniscus of the ink at the ink ejection outlet.

Then the printing head 22K is moved to the wiping position (S2406), and the wiping operation is conducted in a manner as described before by reference to FIGS. 4 and 5 (S2407). Then the printing head 22K is lowered as shown in FIG. 10(*b*) to the recording position (S2408). As described above, the sub-tank 580, the ink flow channels 64,66, and the printing head 22K are fixed to the same frame. Therefore, even when the printing head 22K is lowered, the ink flow channels 64,66 are retained with the aforementioned negative pressure h2 kept applied to the printing head 22K. In the case where the above members are not fixed commonly to the same frame the negative pressure h2 can be maintained by keeping the relative positional relation thereof.

After the printing head 22K is lowered to reach the recording position, the recording operation (image formation) is conducted (S2409). After the end of the recording operation, the printing head 22K is raised and capped with the recovery cap 54 as shown in FIG. 10(*a*) (S2410). Then the circulation pump 68 is stopped (S2411), successively the standby valve 69 is closed (S2412) and the pressure valve 67 is closed (S2413), and air-vent valve 84 is closed (S2414) to bring the system to the standby mode again to end the flow of the procedure.

During the recording operation, ink is ejected from the nozzles 22Kn incessantly and the ink is replenished from the liquid chamber 22Kr to the nozzles 22Kn, decreasing the amount of the ink in the liquid chamber 22Kr. In the printing operation, the flow rate of the ink through the ink circulation path (ink channels 64,66) varies depending on the ejection frequency of the printing head 22K and ratio of the ejecting nozzle to the entire nozzles (printing duty) changing with the recording speed (printing speed). This variation of the ink flow rate causes variation of the pressure in the nozzles 22Kn of the printing head 22K.

Assuming ink ejection at a constant ejection frequency, the pressure in the nozzle 22Kn of the printing head 22K varies within the range surrounded by the pressure distribution line 1001 for a non-ejection printing duty 0% (ink is ejected from none of the nozzles) and the pressure distribution line 1002 for a printing duty 100% (ink is ejected from all of the nozzles). This pressure variation will affect the ink ejection state of the printing head 22K. This pressure variation can be prevented by controlling the flow rate of the ink circulated by the circulation pump 68. This control is explained below.

To meet the decrease of the amount of the ink ejected from the nozzle 22Kn per unit time, the rotation frequency of the circulation pump 68 is increased to increase the amount of the circulated ink (ink flow rate). This increases the negative pressure in the liquid chamber 22Kr (i.e., negative pressure in the nozzle 22Kn). Thus the decrease of the negative pressure in the printing head 22K caused by decrease of the ink ejection can be prevented to keep the negative pressure in the printing head 22K.

On the other hand, to meet the increase of the amount of the ink ejected from the nozzles 22Kn per unit time, the rotation frequency of the circulation pump 68 is decreased to decrease the amount of the ink circulated (ink flow rate), or to meet the remarkable increase of the ink ejection per unit time, the rotation of the circulation pump 68 is stopped or reversed. Thereby the negative pressure in the liquid chamber 22Kr (i.e., negative pressure in the nozzle 22Kn) is decreased. Thus the excessive negative pressure in the printing head 22K can be prevented to keep the negative pressure in the nozzle 22Kn at a suitable level.

For the above-described control, one method is to install a pressure sensor 581 (FIG. 21) in the liquid chamber 22Kr for detecting the change of the pressure in the printing head 22K and to feed back the pressure detected by the pressure sensor 581 to the driving circuit of the circulation pump 68. That is, the rotation frequency of the circulation pump 68 is controlled according to the pressure detected by the pressure sensor 581 to adjust the pressure in the printing head 22K. This adjustment is explained later by reference to FIGS. 27 and 28. The pressure sensor 581 may be placed in another position in the circulation path, provided that the relation between the detected pressure and the actually applied pressure to the liquid chamber 22Kr is known and it is reflected in the control table.

In one method of the adjustment, an optimum driving table for the circulation pump 68 is prepared preliminarily from formed images and ink ejection frequencies, and the circulation pump 68 is driven according to this driving table. That is, the rotation frequency of the circulation pump 68 is controlled depending on the amount of the ink ejected from the printing head 22K per unit time to adjust the pressure in the printing head 22K. When the fluctuation of the ink ejection state is within the allowable range for the quality of the formed image in practical use, the circulation pump 68 may be driven under constant driving conditions.

Figure 27:
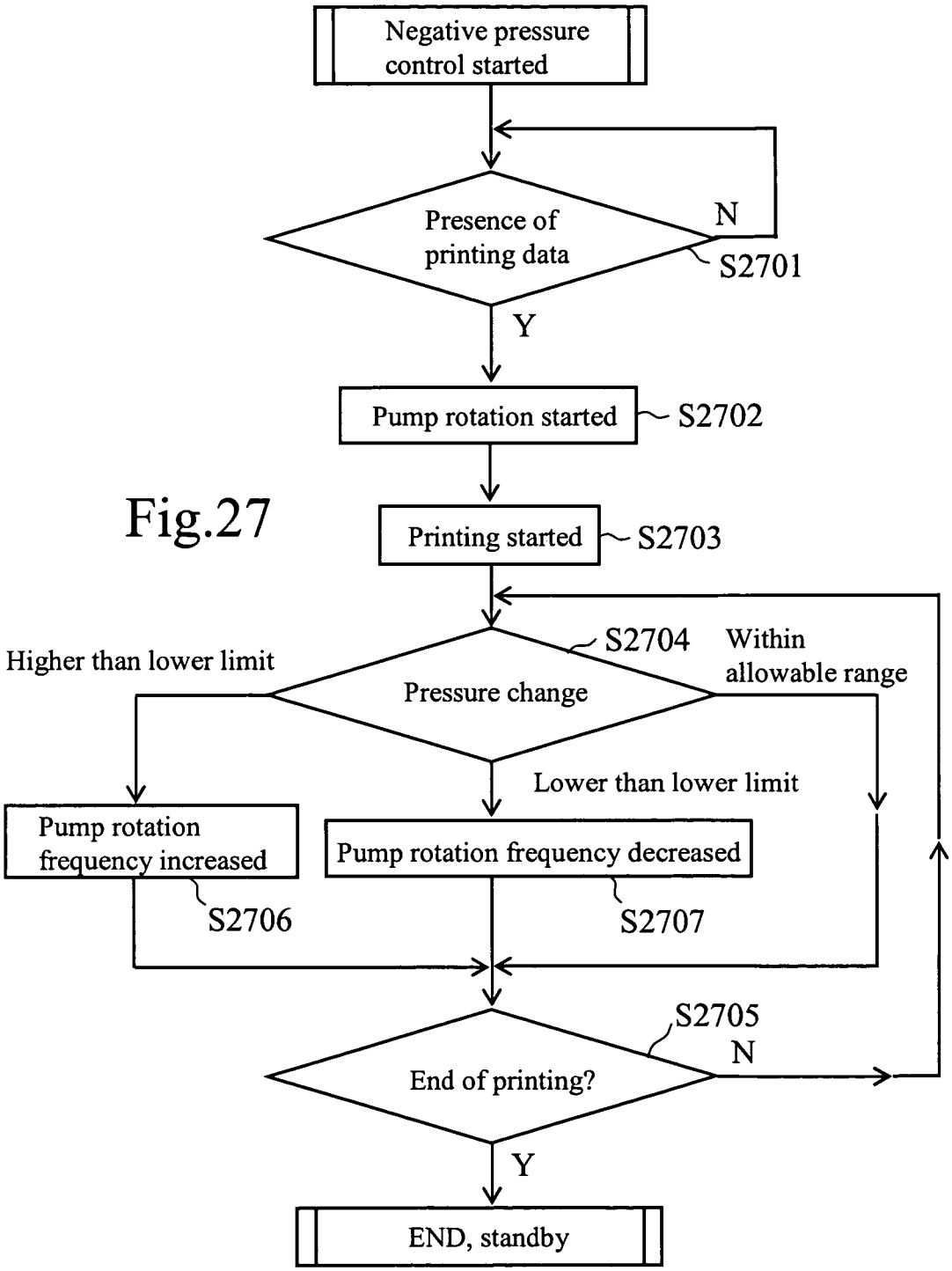
FIG. 27 is a flow chart showing a procedure for operating the ink-feeding device shown in FIG. 22.

The technique is explained in detail for adjusting the pressure in the printing head 22K by controlling the rotation frequency of the circulation pump 68 depending on the pressure detected by the pressure sensor 581 by reference to FIGS. 11 and 27.

FIG. 27 is a flow chart showing an example of the procedure for operation of the ink-feeding device shown in FIG. 22.

Firstly the operation of the ink-feeding device shown in FIG. 22 is explained by reference to FIG. 11 in view of the printing duty of the printing head 22K and the pressure applied to the printing head 22K.

In the non-ejection state (printing duty: OFF (0%)) 301 in which no ink is ejected from the printing head 22K, the circulation pump 68 is controlled to generate a prescribed pressure as shown by the reference number 302 to make the printing head 22K ready for ink ejection. To start the ink ejection from the printing head 22K (ref. no.: 304), the pressure generated by the circulation pump 68 is preliminarily brought to about the atmospheric pressure (0 mmAq) prior to the ink ejection (ref. nos.: 306,305) (decrease of the negative pressure). After start of the printing, the pressure generated by the pump is adjusted to follow the change of the printing duty to decrease the pressure fluctuation of the ink ejection to keep the negative pressure within the preferred ink ejection-enabling range 307. When the pressure cannot be brought to be in the ink ejection-enabling range 307 by bringing the negative pressure near the atmospheric pressure, the rotation of the circulation pump 68 is rotated normally (rotated in the ink feed direction) to keep the pressure higher than the atmospheric pressure (positive pressure) 311. Conversely, when the printing duty decreases (ref. nos.: 310), the pressure generated by the pump is made negative (ref. no.: 309).

As described above, the drive of the circulation pump 68 is controlled according to the printing duty. Thereby the negative pressure can generally be controlled to be within the ink ejection-enabling region 307 although some irregular pressure change (ref. no.: 308) may appear by delay of the response caused by inertia of the ink.

An example of the procedure for pressure control is explained by reference to FIG. 27. In the constitution of the printer control system shown in FIG. 2, this procedure is conducted by the CPU 100 according to a program or the like contained in the ROM 104.

Firstly the presence of the printing data is confirmed (S2701). In the presence of the printing data, the circulation pump 68 is started to rotate (S2702), and the printing is started (S2703). During the printing, the pressure is detected by the pressure sensor 581 (S2704). The printing is conducted with the pressure-adjusting pump 82 kept rotating, insofar as the detected pressure is within a prescribed range. The end of the printing is judged (S2705). When the printing is judged to be ended, this flow is finished, whereas when the printing is judged to be continued, the flow is returned to the step S2704 and the pressure is detected again by the pressure sensor 581 (S2704).

When the pressure detected in the step S2704 is found to be higher than the prescribed lower limit, since the pressure in the printing head 22K can become higher than the atmospheric pressure, the pressure in the printing head 22K is controlled to be within the prescribed range by increasing the rotation frequency of the circulation pump 68 (S2706) and the end of the printing is judged (S2705). When the printing is judged to be ended, this flow is finished, whereas when the printing is judged to be continued, the flow is returned to the step S2704 and the pressure is detected again by the pressure sensor 581 (S2704).

When the pressure detected in the step S2704 is found to be lower than the prescribed lower limit, since the pressure in the printing head 22K can become much lower than the atmospheric pressure to prevent the ink ejection, the pressure in the printing head 22K is controlled to be within the prescribed range by decreasing the rotation frequency of the circulation pump 68 (S2707) and the end of the printing is judged (S2705). When the end of the printing is judged to be ended, this flow is finished, whereas when the printing is judged to be continued, the flow is returned to the step S2704 and the pressure is detected again by the pressure sensor 581 (S2704).

In another method, without utilizing the aforementioned software processing, a counter for counting the bits constituting the image data, and a means for controlling the motor for driving the circulation pump 68 based on the count number can be constituted by a hardware. In still another method, instead of conducting the control to meet the printing duty change during the progress of the printing, the pump may be controlled in a feed-forward manner according to a pump-control curve preliminarily formed based on printing data.

Generally, in a printing head of a bubble jet recording system utilizing thermal energy generated by a heater element for ink ejection, or of another ink type ink ejection system (e.g., a piezo element system), a residue of the bubble formed in the nozzle in the ink ejection or dissolved gas in the ink may remain in the liquid chamber or the like to adversely affect the ink ejection. However, in the present invention, the gas bubble is removed with circulation of the ink through the ink flow channel including the liquid chamber 22Kr of the printing head 22K and is caught by filters 90,91, carried to the sub-tank 580, and separated from the ink in the sub-tank 580. Therefore, the ink is ejected stably continuously without accumulation of bubble or the like in the liquid chamber 22Kr.

As described above, in the ink-feeding device 570, the ink is circulated through the ink flow channel 64,66 between the sub-tank 580 and the liquid chamber 22Kr by driving the circulation pump 68. The ink circulation causes a negative pressure by the pressure loss in the ink flow channels 64,66. This negative pressure is exerted on the liquid chamber 22Kr to keep the pressure applied to the ink in the printing head 22K (ink in the nozzles 22Kn) in the suitable pressure range. As the result, the recording quality is improved. Further the freedom degree in constituting the apparatus is increased since the positional relation between the sub-tank 580 and the printing head 22K is not limited. Furthermore, the bubble in the ink in the liquid chamber 22Kr is removed from the liquid chamber 22Kr by circulation of the ink between the liquid chamber 22Kr and the sub-tank 580. As the result, the ink ejection is stabilized more.

Example 8

In the above Example 7, the sub-tank 580 is placed higher than the printing head 22K, but the present invention does not limit the placement thereto. An example of the ink-feeding device 160 is explained in which the sub-tank 580 is placed lower than the printing head 22K by reference to FIG. 28.

Figure 28:
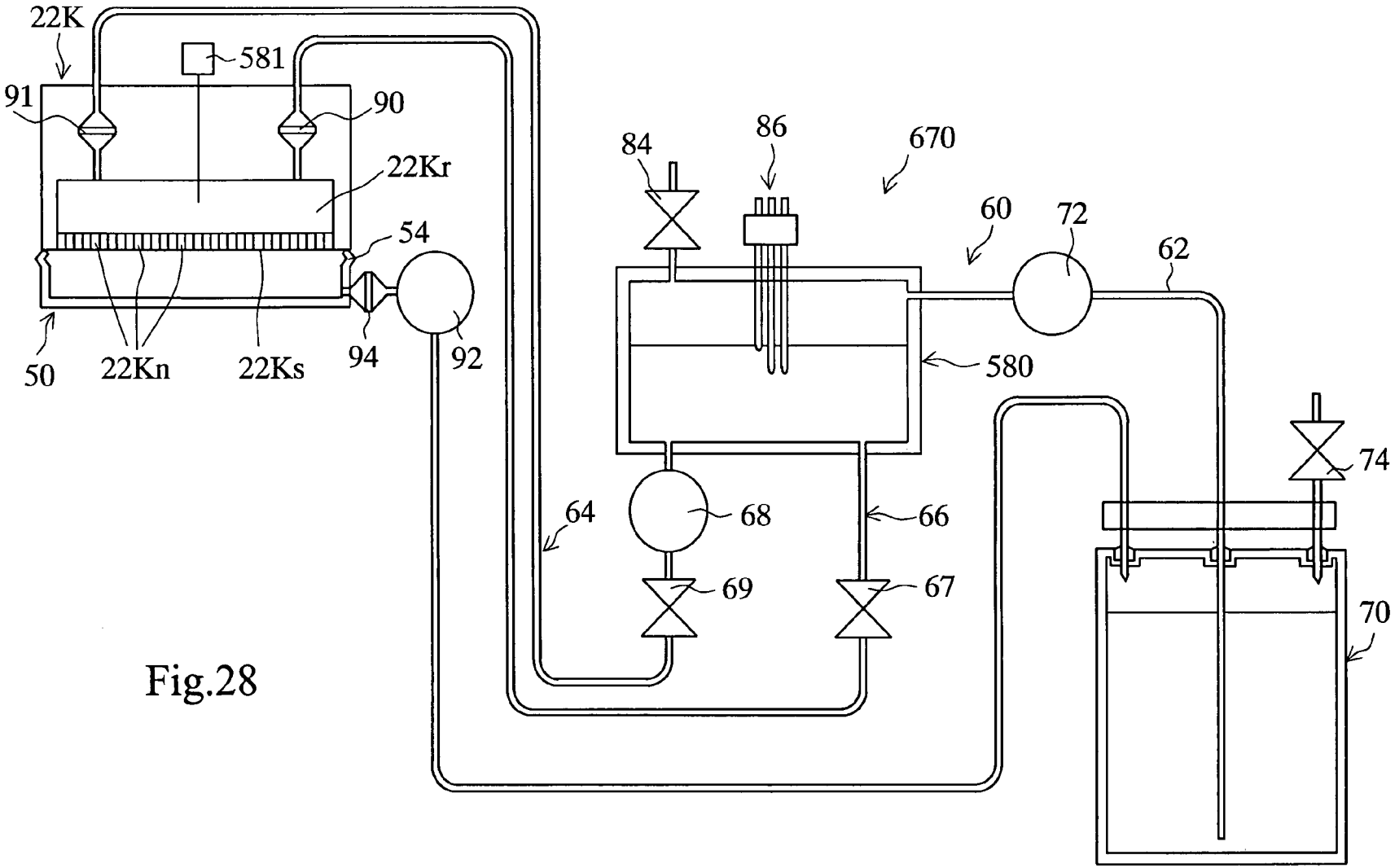
FIG. 28 shows schematically the ink-feeding device of Example 8.

FIG. 28 illustrates schematically the ink-feeding device of Example 8. In FIG. 28, the same reference numbers and symbols as in FIG. 21 are used for indicating corresponding elements.

In the ink-feeding device 670 in this Example 8, the sub-tank 580 is placed lower than the printing head 22K. In such a positional relation, the circulation pump 68 is useful for applying a positive pressure from the outside to keep a suitable negative pressure in the printing head 22K.

The inside of the printing head can be kept at a suitable negative pressure by the circulation pump 68 irrespective of the positional relation between the printing head 22K and the sub-tank 580. Therefore the placement of the sub-tank 580 is not limited, so that the freedom degree in designing the device is increased in comparison with a conventional device which utilizes a water head difference.

Example 9

In the above Example 7, the pressure applied to the printing head 22K is controlled by driving the circulation pump 68 to change the ink flow rate circulating between the sub-tank 80 and the liquid chamber 22Kr. However, the pressure applied to the printing head 22K can be controlled by changing the pressure loss in the ink flow channels 64,66 in the present invention.

Specifically, in the constitution of the device in Example 7, as the pressure valve 67 (FIG. 22), a proportional electromagnetic valve is used which changes the stroke size of a plunger 130 (FIG. 22) by applied voltage. At one end of the plunger 130, a valve sheet is attached. The sectional area of the ink flow channel 66 is controlled by controlling the stroke size of the valve as a variable flow resistor to control the negative pressure applied to the liquid chamber 22Kr of the printing head 22K. With this constitution, the pressure can be controlled with the flow rate kept constant by the circulation pump 68. The pressure may be controlled by using both of the circulation pump 68 and the pressure valve 67 (proportional electromagnetic valve). With such a constitution, the same affect can be achieved as in Example 7.

Example 10

An ink-feeding device (Example 10) of the printer 10 is explained by reference to FIGS. 29 and 30.

Figure 29:
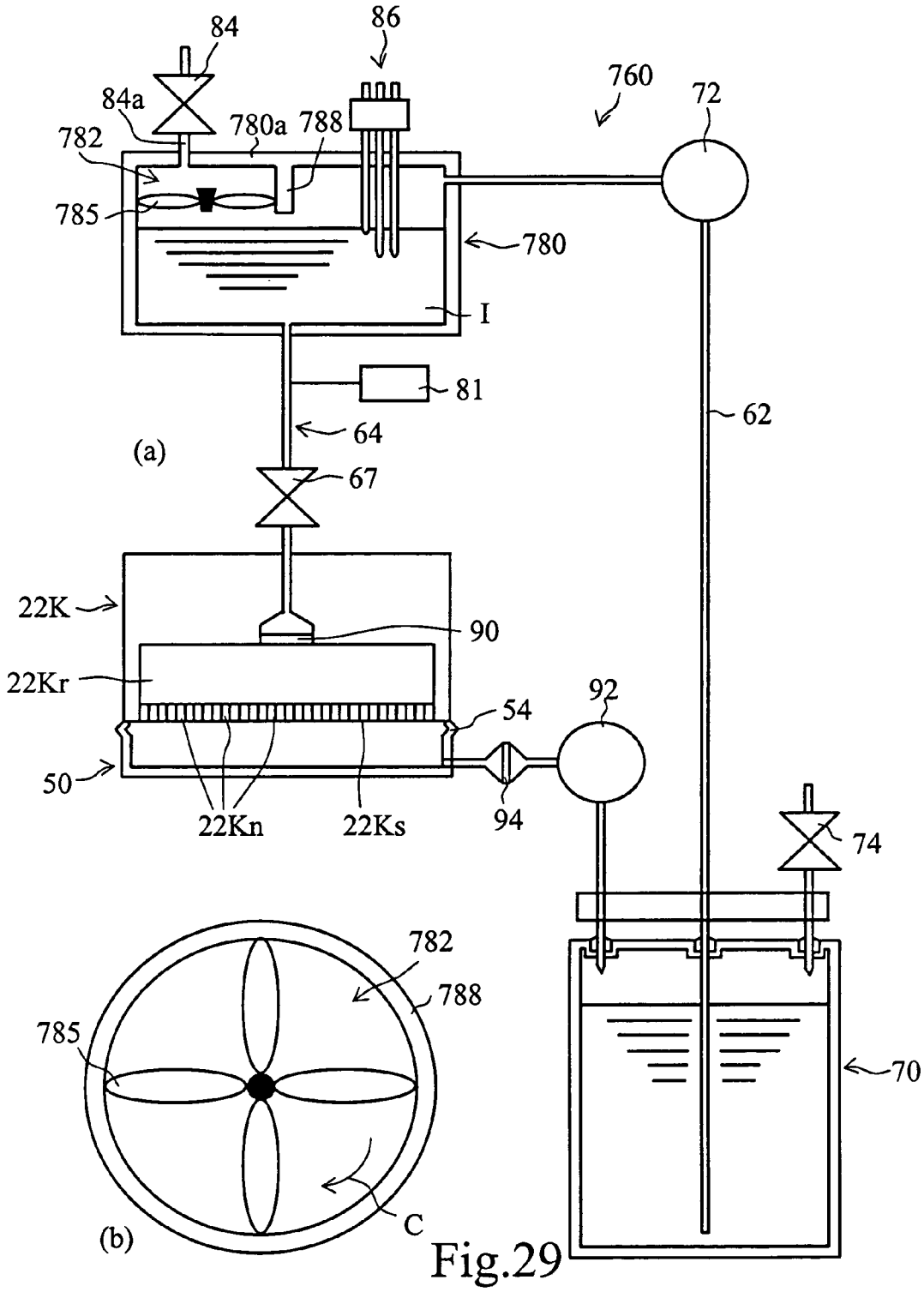
FIG. 29(*a*) is a schematic drawing of an ink-feeding device incorporated in an inkjet type image formation apparatus.

FIG. 29(*a*) illustrates schematically an ink-feeding device of Example 10 employed in an inkjet type image-forming apparatus. FIG. 29(*b*) is an enlarged plan view of the inside space of the sub-tank of FIG. 29(*a*). FIG. 30 is a flow chart showing the procedure for cleaning the printing head. FIG. 29 shows an ink-feeding device serving to feed an ink to the printing head 22K and to recover the printing head 22K. An ink-feeding device of the same constitution is installed in each of the printing heads 22C, 22M, and 22Y. In FIG. 29, the same reference numbers and symbols as in FIGS. 1 and 2 are used for indicating corresponding members.

The printer 10 (FIG. 1) incorporates an ink-feeding device 760 for feeding an ink to the printing head 22K. The ink-feeding device 760 has a replaceable ink tank 70 demountable from the main body of the printer 10, and a sub-tank 780 placed within the ink-feeding channel 62 connecting the ink tank 70 with the printing head 22K. The printing head 22K is placed below the sub-tank 780. The liquid face of the ink held in the sub-tank 580 is higher than the ink ejection outlets of the nozzles 22Kn.

The sub-tank 780 and the printing head 22K are connected by an ink flow channel 64. The sub-tank 780 and the printing head 22K are fixed to the same frame (not shown in the drawing). Therefore, the sub-tank 780 and the ink flow channel 64 move together with the printing head 22K. However, the sub-tank 780 and the printing head 22K may be fixed to separate frames without impairing the effect of the present invention, which will be made clear later.

The ink flow channel 64 connects the bottom of the sub-tank 780 and the upper portion of the liquid chamber (ink-holding chamber) 22Kr of the printing head 22K. In the ink flow channel 64, a standby valve 67 is installed to open and close the ink flow channel 64 in a prescribed timing. Further in the ink flow channel 64 between the standby valve 67 and the sub-tank 780, a pressure sensor is installed for detecting the pressure of the ink in the ink flow channel 64.

The sub-tank 780 is in a cuboid shape as a whole. In the upper space of the sub-tank 780, a circular air room 782 is partitioned. The ink does not fill this circular room 782. The ink is held in the lower portion of the sub-tank 780. The room 782 is surrounded by the ceiling wall 780*a* of the sub-tank 780 and a circular inner wall 788. In the partitioned portion (room 782), a turbo type air fan 785 is installed (an example of the pressure-controlling means in the present invention).

On the ceiling wall 780*a* of the sub-tank 780, an air-vent pipe 84*a* is installed to communicate the room 782 with the atmosphere (connecting the room 782 to the outside air). This air-vent pipe 84*a* has an air-vent valve 84 for opening and closing the air-vent pipe 84*a*. The room 782 is connected to the outside air by opening the air-vent valve 84 and the air-vent pipe 84*a* is closed by closing the air-vent valve 84. When the printer 10 is not working, the air-vent pipe 84*a* is closed to prevent evaporation of the ink in the sub-tank 780. In the sub-tank 780, a conventional liquid level sensor 86 is installed to detect the liquid level of the ink (stored ink) in the sub-tank 780.

Rotation of the air fan 785 in the normal direction (rotation in arrow-C direction in FIG. 29(*b*)), with the air-vent valve 84 opened, discharges a part of the air in the room 782 outside through the air-vent pipe 84*a*. Thereby, the pressure in the room 782 becomes lower than the atmospheric pressure. The lower pressure is exerted to the ink I in the sub-tank 780, to the ink in the ink flow channel 64, to the ink in the liquid chamber 22Kr, and to the ink in the nozzles 22Kn to apply a negative pressure to the ink (a lower pressure is applied). Conversely, rotation of the air fan 785 in the reverse direction (rotation in the direction reverse to the arrow-C in FIG. 29(*b*)), with the air-vent valve 84 opened, introduces outside air through the air-vent pipe 84*a* into the room 782. Thereby, the pressure in the room 782 becomes higher than the atmospheric pressure. The higher pressure is exerted to the ink I in the sub-tank 780, to the ink in the ink flow channel 64, to the ink in the liquid chamber 22Kr, and to the ink in the nozzles 22Kn to apply a pressure higher than a prescribed pressure to the ink. In such a manner, the pressure in the room 782 is controlled by discharging or introducing the air from or to the room 782 through the air-vent pipe 84*a* by rotating the air fan 785. Thereby the negative pressure applied to the ink in the nozzles 22Kn is controlled. The pressure in the room 782 can also be controlled by the rotation frequency of the air fan 785.

In the ink tank 70, a sensor is installed (not shown in the drawing) for detecting the presence of the ink in this ink tank 70. In the air flow path for mounting the ink tank 70 on the main body of the printer 10, an air-vent valve (tank valve) 74 is installed for equalizing the inside pressure of the ink tank 70 to the atmospheric pressure. When the sensor detects the ink level to be lower than a prescribed level, the tank valve 74 is opened and a feed pump 72 is driven to suck up the ink from the ink tank 70 to feed the ink to the sub-tank 780. When the sensor detects the ink level to be at a prescribed upper level limit, the feed pump 72 is stopped and the tank valve 74 is closed to stop the feed of the ink. The feed pump 72 is a tube pump, which intercepts the flow channel when the pump is not driven (the flow channel is intercepted between the ink tank 70 and the sub-tank 780).

The operation of cleaning the printing head 22K is explained below.

The cleaning operation herein signifies an operation for maintaining the ink ejection performance of the printing head 22K, and this operation is conducted automatically or non-automatically when a prescribed ejection time has elapsed or the ejection state comes to a predetermined condition or when the image quality becomes abnormal.

Figure 30:
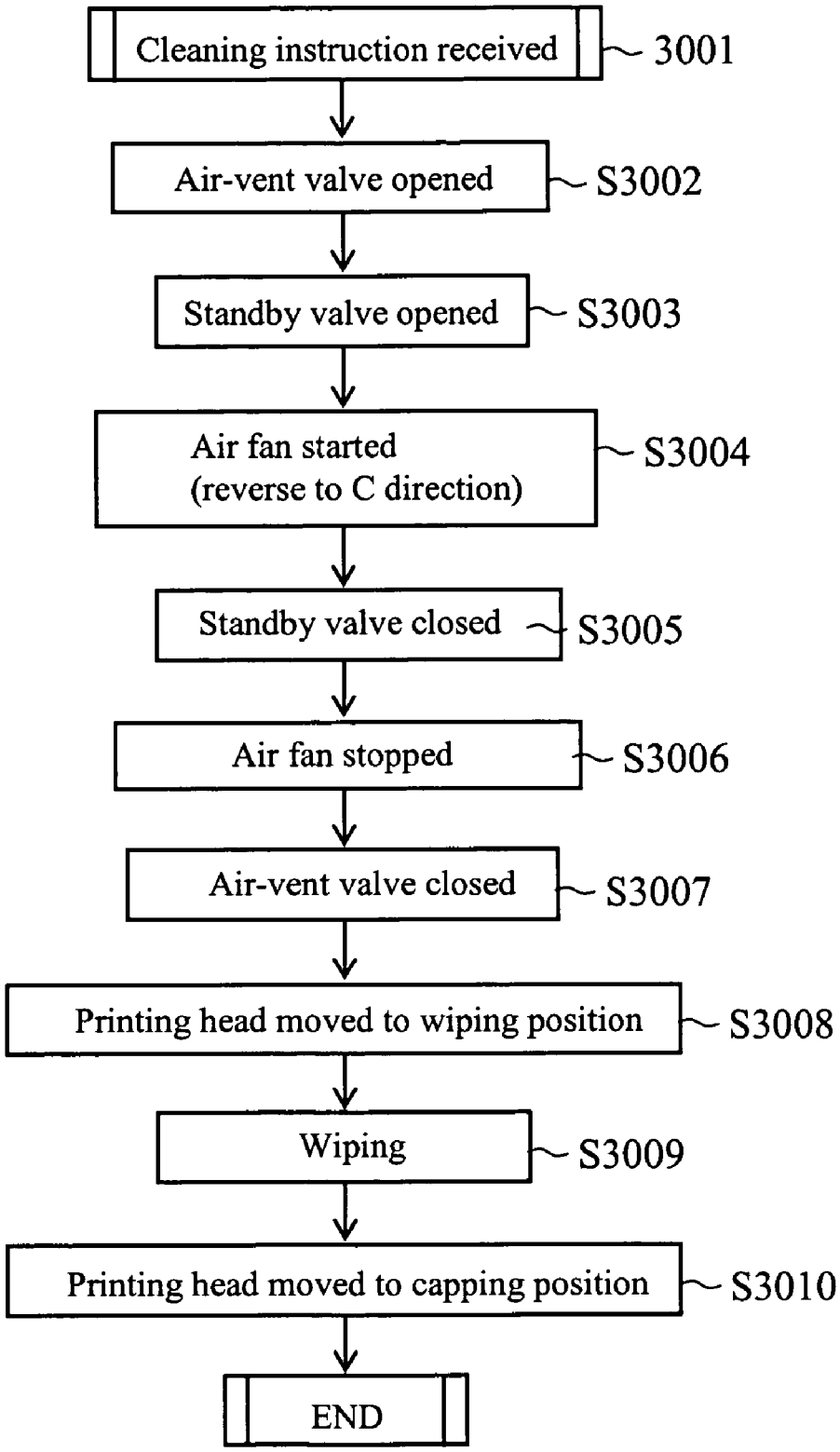
FIG. 30 is a flow chart showing a procedure for cleaning a printing head.

As shown by the flow chart in FIG. 30, the cleaning operation is started on reception of cleaning instructions (S3001). On receiving the reception of the cleaning instructions, the air-vent valve 84 and the standby valve 69 are opened successively (S3002-S3003). Then the air fan 785 is rotated in the direction to pressurize the air in the sub-tank (reverse to the arrow-C direction) (S3004). Thereby the sub-tank 780 is pressurized to send the ink having been filtered by a filter 90 from the sub-tank 780 through the ink flow channel 64 to the printing head 22K. The ink flow by pressure discharges and removes a bubble or bubbles accumulated in the printing head 22K during the recording operation or staying in the periphery of the nozzle 22Kn of the printing head 22K, or a foreign matter like dirt.

Further, after a certain time, the standby valve 67 is closed, the air fan is stopped, and the air-vent valve 84 is closed (S3005-S3007). In this state, the face 22Ks of the nozzles 22Kn including the outlets of the nozzles 22Kn of the printing head 22K is in an uncleaned state soiled by the ink. To remove the soiling matters, the face 22Ks is wiped with a wiper 52 fixed to the capping mechanism 50. In this wiping operation, the printing head 22K is moved above the recovery cap 54 as shown in FIG. 5(*a*) (S3008). Then the recovery cap 54 is moved in the arrow-B direction as shown in FIG. 5(*b*) to wipe the soiling matter like an ink adhering to the face 22Ks by a wiper 52 (S3009). This operation is called a wiping operation. After the wiping operation, the printing head 22K is brought again to the standby state by capping as shown in FIG. 5(*c*) (S3010). The printing head 22K in the standby state is capped at the face 22Ks by a recovery cap 54 to prevent ink viscosity increase in the nozzle 22Kn. The ink discharged from the printing head 22K (waste ink) is received by the recovery cap 54 and is sucked by a suction pump 92 (FIG. 29). This waste ink is filtered (screened) by a filter 94 (FIG. 3) to eliminate the foreign matters and is returned to the ink tank 70. The wiping operation only may be conducted at a suitable timing.

The pressure in the printing head 22K is adjusted by the air fan 85 as explained below by reference to FIG. 31.

Figure 31:
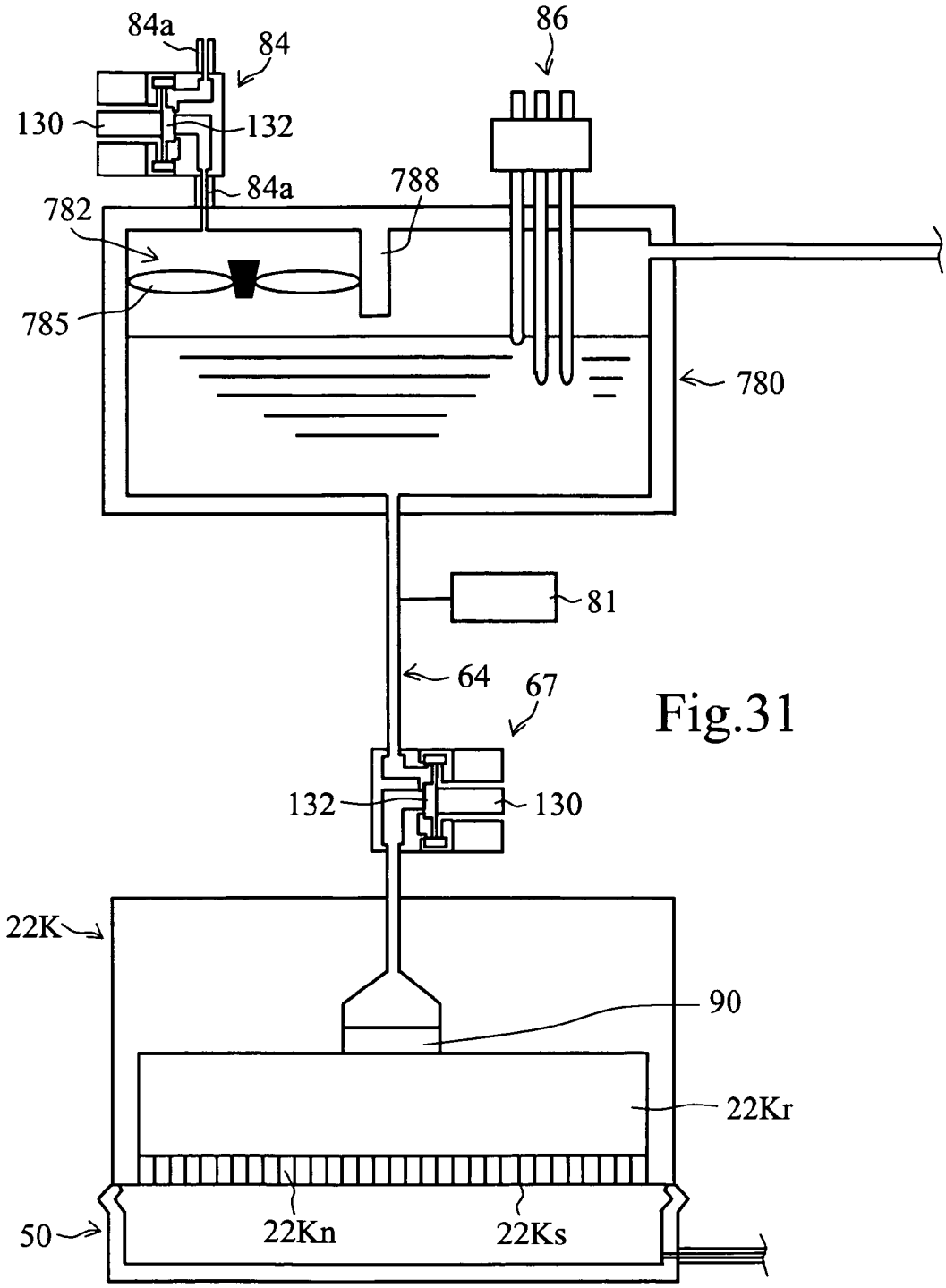
FIG. 31 is an enlarged view of an ink-feeding device.

FIG. 31 is an enlarged view of the ink-feeding device. In FIG. 31, the same reference numbers and symbols as in FIG. 29 are used for indicating the corresponding members.

During the recording (during image formation), a suitable negative pressure should be applied to the printing head 22K (a negative pressure for formation of a meniscus of the ink at the ink ejection openings (nozzle outlets)). For applying the negative pressure, the standby valve 67 and the air-vent valve 84 are kept opened, and the air fan 785 is rotated in a direction to reduce the air pressure in the sub-tank (in the arrow-C direction in FIG. 29) to decrease the pressure in the sub-tank 780. The pressure decrease in the sub-tank 780 induces a similar pressure decrease in the nozzles 22Kn and the liquid chamber 22Kr connected by the ink flow channel 64 to the sub-tank 780.

The aforementioned standby valve 67, and the air-vent valve 84 are, as shown in FIG. 31, respectively an electromagnetic valve which intercepts the ink flow channel by a valve sheet 132 integrated with a solenoid plunger 130. However, any type of the valve may be used in the present invention without limiting thereto.

The procedure for the recording operation starting from the standby mode is explained by reference to FIGS. 32 and 10.

Figure 32:
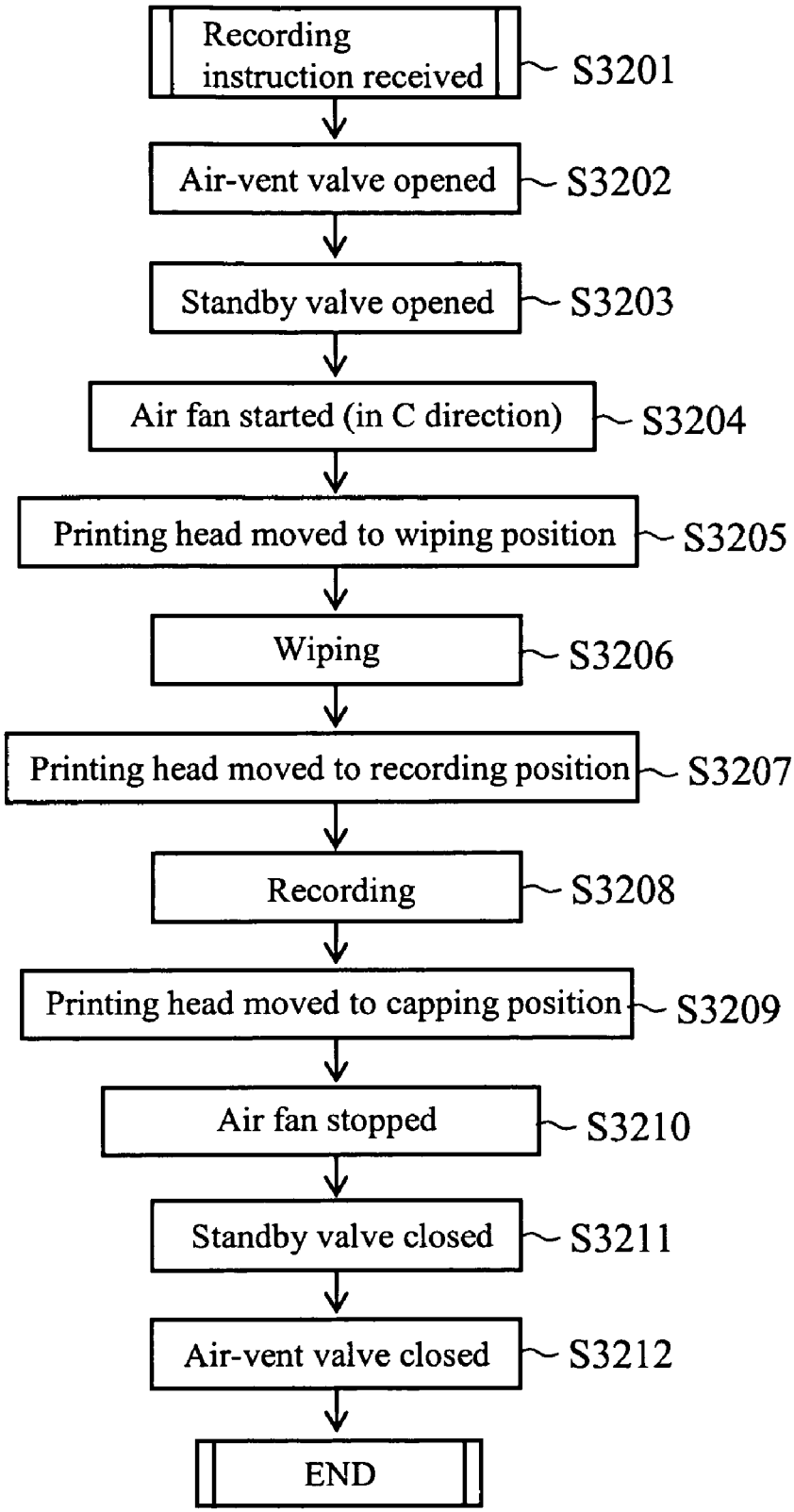
FIG. 32 is a flow chart showing a procedure for recording operation starting from a standby mode.

FIG. 32 is a flow chart showing the procedure from the standby mode to the recording operation. FIG. 10(*a*) illustrates schematically the printing head capped by a recovery cap. FIG. 10(*b*) illustrates schematically the placement of the printing head during the recording.

On receiving instructions for printing in the standby mode (S3201), the air-vent valve 84 (FIG. 29) is opened (S3202). Then, the standby valve 67 is opened to open the ink flow channel 64 (S3203) which connects the sub-tank 780 (FIG. 29) to the printing head 22K. In this Example, a sub-tank 780 is placed higher than the printing head 22K. Therefore, opening of the air-vent valve 84 and the pressure valve 67 applies a water-head pressure to the nozzle 22Kn of the printing head 22K, and ink tends to flow down from the sub-tank 780 through ink flow channel 64 to the printing head 22K. In this state, the air fan 785 is driven to reduce the pressure in the sub-tank 780 (The air fan 785 is rotated in the arrow-C direction in FIG. 29 to expel the air from the air-vent pipe 84*a*) (S3204). The reduction of the pressure in the sub-tank 780 is made larger than the above water-head pressure or applying a negative pressure to the nozzles 22Kn of the printing head 22K. The negative pressure applied to the ink in the printing head 22K enables formation of the meniscus of the ink at the ejection outlets.

Then the printing head 22K is moved to the wiping position (S3205), and the wiping operation is conducted, as explained above by reference to FIGS. 30 and 5 (S3206). Thereafter, the printing head 22K is lowered to the recording position as shown in FIG. 10(*b*) (S3207). Since the sub-tank 780, the ink flow channel 64, and the printing head 22K are fixed to the same frame, the ink flow channel 64 is kept fixed and the negative pressure is kept applied to the printing head 22K even when the printing head 22K is lowered.

After the printing head 22K is lowered to the prescribed recording position, recording operation (image formation) is conducted (S3208). After the recording operation, the printing head 22K is elevated and is capped with the recovery cap 54 (S3209). Thereafter the air fan 785 (FIG. 29) is stopped (S3210), the standby valve 67 is closed (S3211), and the air-vent valve 84 is closed (S3212) to bring the system to the standby mode again to end the flow.

During the recording operation (image formation), when the ink liquid face level in the sub-tank 780 is detected to be lower than a prescribed level by the liquid level sensor 86 installed in the sub-tank 780, the tank valve 74 is opened and the ink-feeding pump 72 is driven to feed the ink from the ink tank 70 to the sub-tank 780 until the ink face level is detected at the upper level limit by the level sensor 86. In this ink feeding operation, a volume of the air corresponding to the volume of the ink introduced into the sub-tank 780 should be discharged by the air fan 785 from the sub-tank 780 not to prevent unacceptable fluctuation of the pressure in the sub-tank 780. Therefore the air fan 785 should be capable of discharging immediately the air in a volume corresponding to the ink introduced into the sub-tank 780. However, in the case where the air fan satisfying the above conditions cannot be installed owing to the limited space or a like reason, the recording operation (image formation) may be interrupted temporarily to feed the ink. After completion of the intended ink feed, the ink-feeding pump 72 is stopped and the tank valve 74 is closed. In this Example, a tube pump is employed as the ink-feeding pump 72. The tube pump keeps the ink flow channel closed during non-working state, so that the pressure in the sub-tank 780 does not propagate to the side of the ink tank 70 (the pressure generated by the air fan 785 will not leak). However, when the ink-feeding pump 72 employed is a pump which is not capable of intercepting the ink flow channel during the non-working state, preferably a valve for closing the flow channel is additionally installed.

During the recording operation, ink is ejected from the nozzles 22Kn and the ink is replenished from the liquid chamber 22Kr to the nozzles 22Kn, decreasing the amount of the ink in the liquid chamber 22Kr. In the printing operation, the ink is allowed to flow in the ink flow channel 64. The ink flow rate varies depending on the ejection frequency of the printing head 22K and ratio of the ejecting nozzles to the entire nozzles (printing duty) changing with the recording speed (printing speed). This variation of the ink flow rate causes variation of the pressure in the nozzle 22Kn of the printing head 22K.

Since this variation of the pressure affects the ink ejection state of the printing head 22K, the variation of the pressure is prevented by controlling the rotation frequency of the air fan 785. This control is explained below.

To meet the decrease of the amount of the ink ejected from the nozzle 22Kn per unit time, the rotation frequency of the air fan 785 in the arrow-C direction is increased. Thereby, the pressure applied to the ink in the sub-tank 780 is decreased by discharge of the air from the room 782 through the air-vent pipe 84*a* to increase the negative pressure in the liquid chamber 22Kr (i.e., negative pressure in the nozzle 22Kn). Thus the decrease of the negative pressure in the printing head 22K caused by decrease of the ink ejection can be prevented to keep the negative pressure in the printing head 22K.

On the other hand, to meet the increase of the amount of the ink ejected from the nozzle 22Kn per unit time, the rotation frequency of the air fan 785 in the arrow-C direction (FIG. 29) is decreased, or to meet the remarkable increase of the ink ejection per unit time, the rotation of the air fan 785 is stopped or reversed (rotated in the direction reverse to the arrow-C). Thereby the negative pressure in the liquid chamber 22Kr (i.e., negative pressure in the nozzle 22Kn) is decreased. Thus the excessive negative pressure in the printing head 22K can be prevented to keep the negative pressure in the nozzle 22Kn at a suitable level.

For the above-described control, one method is to install a pressure sensor 81 (FIG. 3, etc.) in the liquid flow channel 64 and to feed back the detected pressure to the driving circuit of the air fan 785. That is, the rotation frequency of the air fan 785 is controlled according to the pressure detected by the pressure sensor 81 to control the rotation frequency of the air fan 785. This adjustment is explained later by reference to FIGS. 33 and 11.

In one method of the adjustment, an optimum driving table for the air fan 785 is prepared preliminarily from formed images and the ink ejection frequencies, and the air fan 785 is driven according to this driving table. That is, the rotation frequency and rotation direction of the air fan 785 are controlled depending on the amount of the ink ejected from the printing head 22K per unit time to control (adjust) the pressure in the printing head 22K. When the fluctuation of the ink ejection state is within the allowable range for the quality of the formed image in practical use, the air fan 785 may be driven under constant driving conditions.

Figure 33:
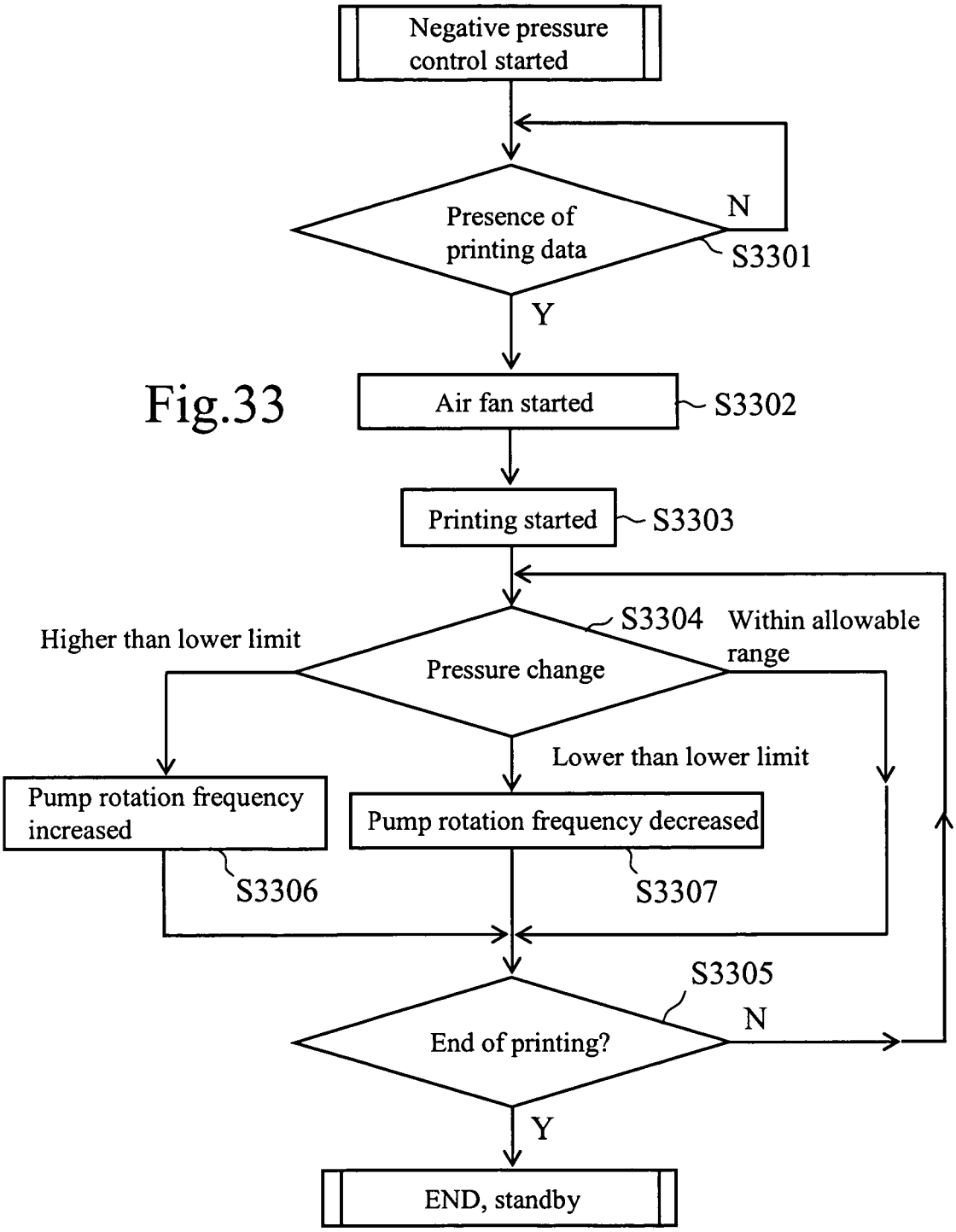
FIG. 33 is a flow chart showing a procedure for operating the ink-feeding device shown in FIG. 31.

The technique is explained in detail for adjusting the pressure in the printing head 22K by controlling the rotation frequency of the air fan 785 according to the pressure detected by the pressure sensor 81 by reference to FIGS. 33 and 11.

An example of the time chart of the operation of the ink-feeding device of FIG. 31 is the same as FIG. 11. FIG. 33 is a flow chart showing an example of the procedure for operation of the ink-feeding device shown in FIG. 31.

The operation of the ink-feeding device shown in FIG. 31 is explained by reference to FIG. 11 in view of the printing duty of the printing head 22K and the pressure applied to the printing head 22K.

In the non-ejection state (printing duty: OFF (0%)) 301 in which no ink is ejected from the printing head 22K, the air fan 785 is controlled to generate a prescribed pressure (a constant pressure is applied to the printing head 22K) as shown by the reference number 302 to make the printing head 22K ready for ink ejection. To start the ink ejection from the printing head 22K (ref. no.: 304), the pressure generated by the air fan 785 is preliminarily brought to about the atmospheric pressure (0 mmAq) prior to the ink ejection (ref. nos.: 306,305) (decrease of the negative pressure). After start of the printing, the pressure generated by the air fan 785 is adjusted to follow the change of the printing duty.

In such a manner, the pressure fluctuation caused by the ink ejection is decreased to keep the negative pressure within the preferred ink ejection-enabling range 307. When the pressure cannot be brought to be in the ink ejection-enabling range 307 by bringing the negative pressure near the atmospheric pressure, the rotation of the air fan 785 is reversed in the direction reverse to the arrow-C direction (FIG. 3) (to introduce the outside air into the room 782) of the sub-tank 780 to keep the pressure higher than the atmospheric pressure (positive pressure) 311. Conversely, when the printing duty decreases (ref. nos.: 310), the pressure generated by the air fan 785 is made negative (ref. no.: 309).

As described above, the drive of the air fan 785 is controlled according to the printing duty. Thereby the negative pressure can generally be controlled to be within the preferred ink ejection-enabling region although some irregular pressure change (ref. no.: 308) may appear by delay of the response caused by inertia of the ink.

An example of the procedure for pressure control is explained by reference to FIG. 33. In the constitution of the printer control system shown in FIG. 2, this procedure is conducted by the CPU 100 according to a program or the like contained in the ROM 104.

Firstly the presence of the printing data is confirmed (S3301). In the presence of the printing data, the air fan 785 is started to rotate in the arrow-C direction (FIG. 29) (S3302), and the printing is started (S3303). During the printing, the pressure is detected by the pressure sensor 81 (S3304). The printing is conducted with the air fan 785 kept rotating, insofar as the detected pressure is within a prescribed range. The end of the printing is judged (S3305). When the printing is judged to be ended, this flow is finished, whereas when the printing is judged to be continued, the flow is returned to the step S3304 and the pressure is detected again by the pressure sensor 81 (S3304).

When the pressure detected in the step S3304 is found to be higher than the prescribed lower limit, since the pressure in the printing head 22K can become higher than the atmospheric pressure, the pressure in the printing head 22K is controlled to be within the prescribed range by increasing the rotation frequency of the air fan 785 to lower the pressure in the room 782 (S3306) and the end of the printing is judged (S3305). When the printing is judged to be ended, this flow is finished, whereas when the printing is judged to be continued, the flow is returned to the step S3304 and the pressure is detected by the pressure sensor 81 (S3304).

When the pressure detected in the step S3304 is found to be lower than the prescribed lower limit, since the pressure in the printing head 22K can become much lower than the atmospheric pressure to prevent the ink ejection, the pressure in the printing head 22K is controlled to be within the prescribed range by decreasing (slow) the rotation frequency of the air fan 785 in the arrow-C direction to bring the pressure in the printing head 22K within the above prescribed range without lowering excessively the pressure in the room 782 (S3307), and the end of the printing is judged (S3305). When the end of the printing is judged to be ended, this flow is finished, whereas when the printing is judged to be continued, the flow is returned to the step S3304 and the pressure is detected by the pressure sensor 81 (S3304).

The air fan 785 may be of any type, provided that the fan is capable of introducing or discharging the air into or from the room 782 through the air-vent pipe 84*a*. For example, gear type pumps, screw type pumps, or the like which are usually used in a liquid are useful. However, turbo type air fans are preferred in the constitution of the present invention. The reason therefore is as follows. As described above, after the pressure in the sub-tank 780 is reduced by the air fan 785, the ink is fed from the sub-tank 780 to the ink head for recording (image formation) and is introduced into the sub-tank 780 from the ink tank 70. To meet the flow-in and flow-out of the ink, the turbo fan is capable of allowing the introduction and discharge of the air to or from the sub-tank 780 with the pressure in the sub-tank 780 kept within a certain range without causing significant pressure fluctuation.

Instead of conducting the control to meet the change of the printing duty during the progress of the printing, the air fan 785 may be controlled in a feed-forward manner according to a control curve for the air fan 785 preliminarily prepared based on printing data. Otherwise, the air fan 785 may be controlled according to the detection output of the pressure sensor for detecting the actual pressure in the printing head.

As described above, in the printer 10, a negative pressure is generated by driving the air fan 785. This negative pressure is exerted on the liquid chamber 22Kr to keep the pressure applied to the ink in the printing head 22K (ink in the nozzle 22Kn) in the suitable pressure range. Thereby, the recording quality is improved. Further the freedom degree in constituting the apparatus is increased since the positional relation between the sub-tank 780 and the printing head 22K is not limited.

Example 11

In the above Example 10, the sub-tank 780 is placed above the printing head 22K. However, the placement is not limited thereto in the present invention. In this Example 11, an ink-feeding device 860 in which the sub-tank 780 is placed lower than the printing head 22K is explained by reference to FIG. 34.

Figure 34:
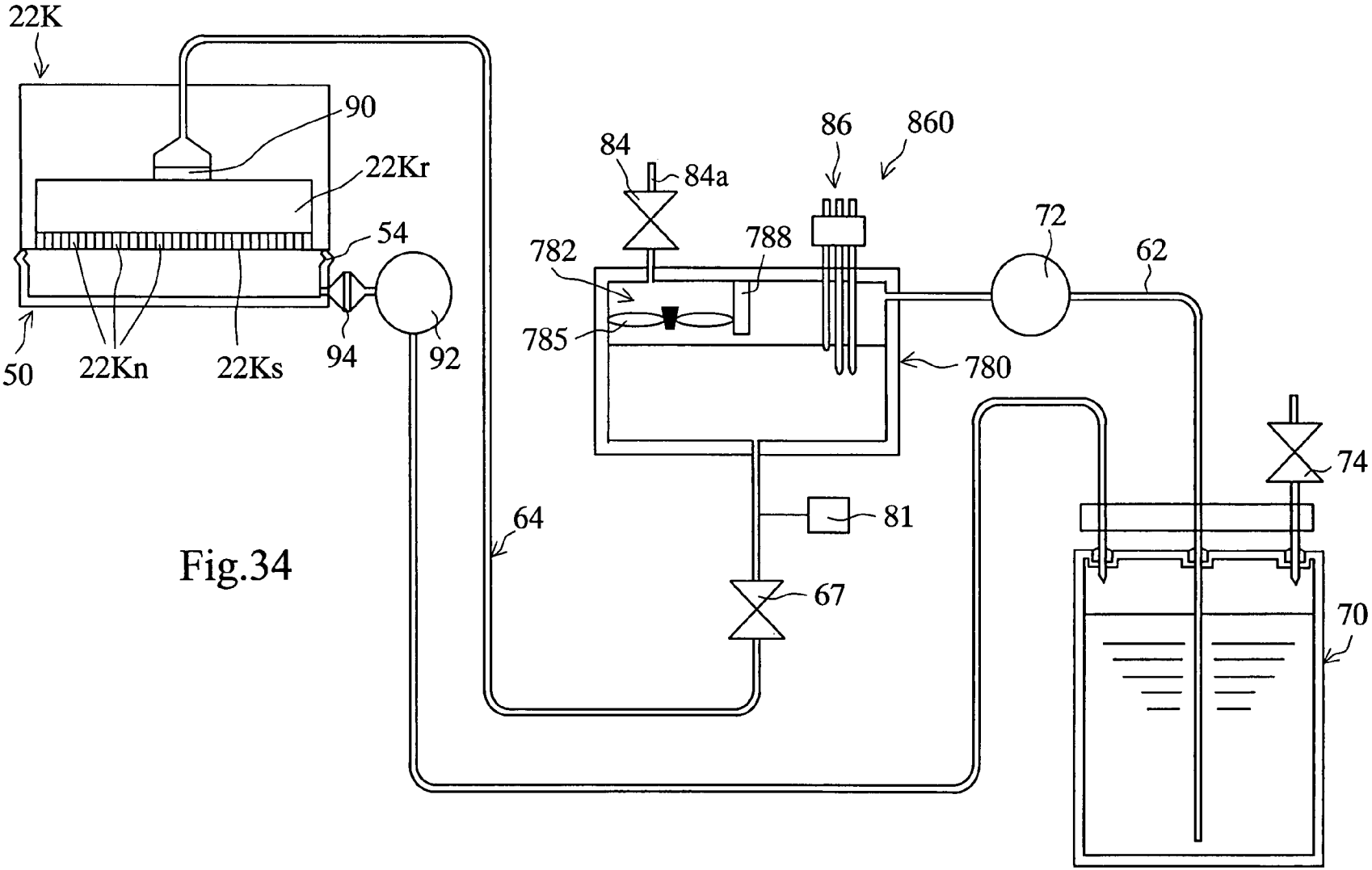
FIG. 34 illustrates schematically the ink-feeding device of Example 11.

FIG. 34 illustrates schematically the ink-feeding device of Example 11. In this FIG. 34, the same reference numbers and symbols as in FIG. 29 are used for indicating corresponding elements.

In the ink-feeding device 860 in this Example 11, sub-tank 780 is placed lower than the printing head 22K. Even in such a positional relation, the air fan 785 is useful for applying a positive pressure from the outside to keep a suitable negative pressure in the printing head 22K.

As described above, regardless of the relative positions of the printing head 22K and the sub-tank 780, the inside of the printing head 22K can be kept at a suitable negative pressure by the air fan 785. This improves the freedom degree in designing the device without restriction of the positional placement of the sub-tank 780 in comparison with the conventional device relying on the water head difference.

Example 12

In Example 10, the pressure applied to the printing head 22K is controlled by rotating (driving) the air fan 785 and the cleaning is conducted by discharging the ink by a pressure application. Generally, the air fan 785 is not suitable for producing a high pressure. Therefore, depending on the shape of the printing head, the air fan can be insufficient for producing a necessary pressure for the cleaning, or can be incapable of removing a bubble from the printing head by pressure application in one direction.

In this Example 12, the cleaning performance is improved with the recording (image-forming) system of Example 1 unchanged.

Figure 35:
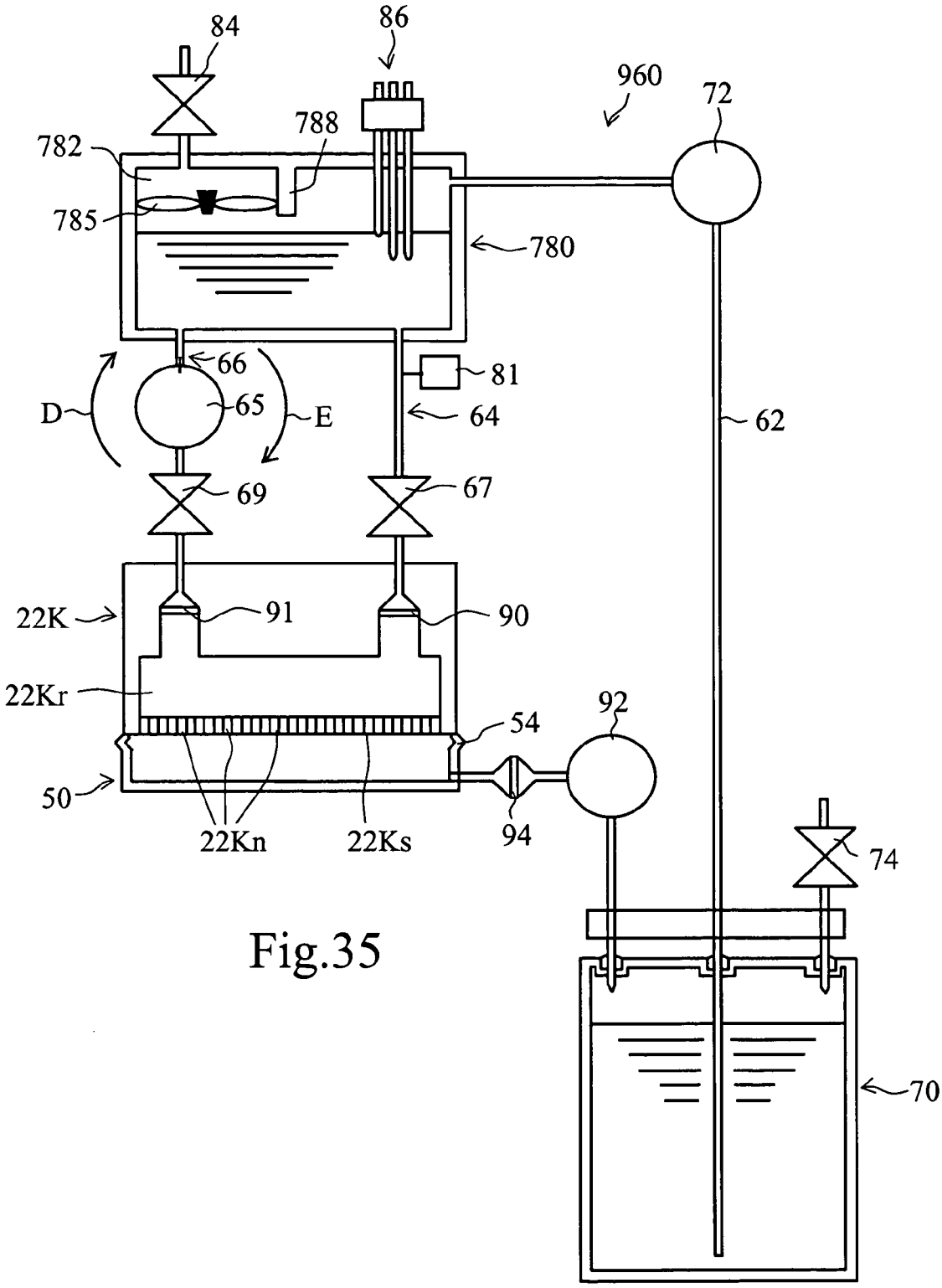
FIG. 35 is a schematic drawing of an ink-feeding device incorporated in a printer.
Figure 36:
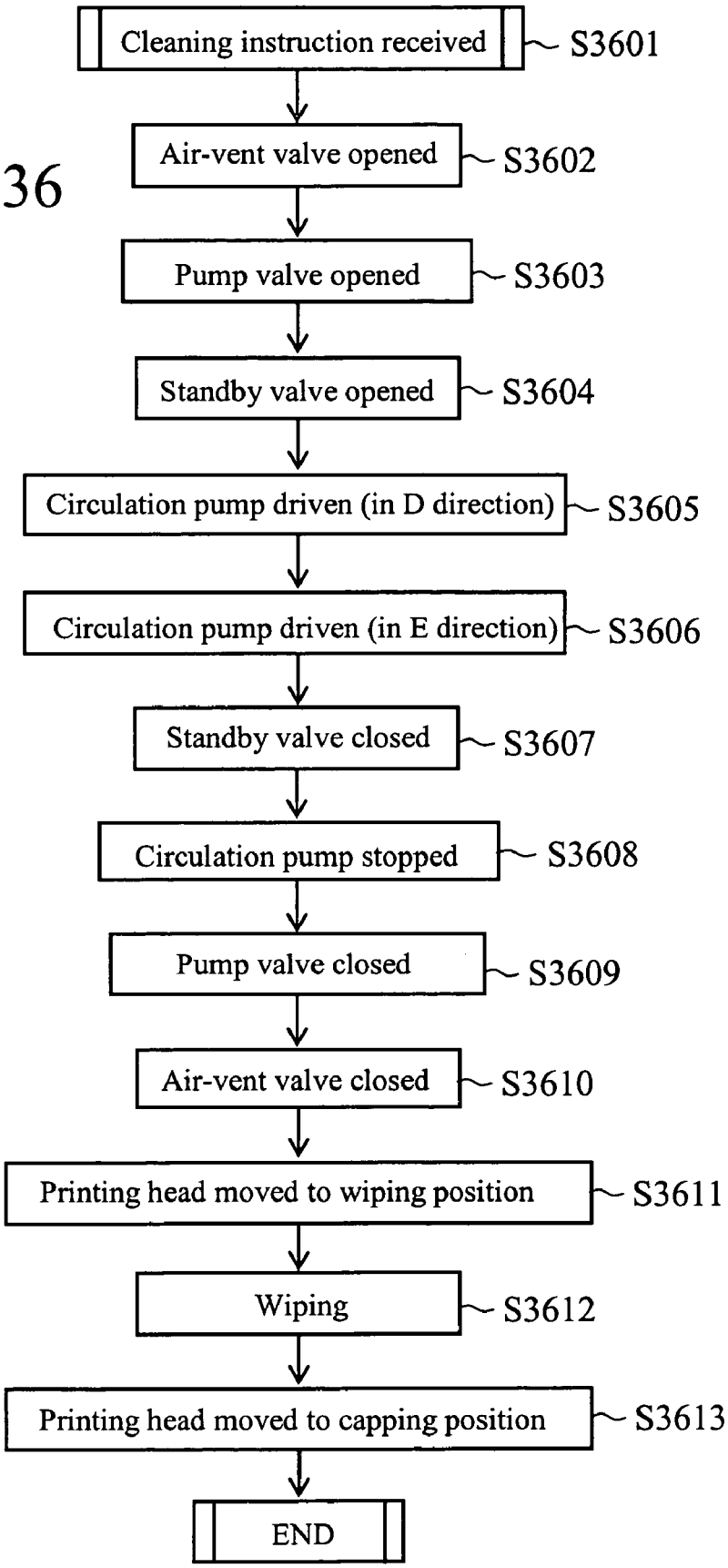
FIG. 36 is a flow chart showing a procedure for cleaning a printing head.

An ink-feeding device incorporated in the printer 10 is explained by reference to FIGS. 35 and 36. FIG. 35 illustrates schematically an ink-feeding device incorporated into a printer. In FIG. 35, the same reference numbers and symbols as in FIG. 29 are used for indicating corresponding elements. FIG. 36 is a flow chart of the procedure for cleaning the printing head.

In FIG. 36, the sub-tank 780 and the printing head 22K are connected by two ink flow channels 64,66 (an example of the ink circulation path in the present invention). The ink flow channel 64 connects the bottom of the sub-tank 780 and the upper portion of the liquid chamber (ink-holding chamber) 22Kr of the printing head 22K. The ink flow channel 66 connects the bottom of the sub-tank 780 and the upper portion of the liquid chamber 22Kr of the printing head 22K at connection positions different from the connecting positions of the ink flow channel 64.

Within the ink flow channel 66, a circulation pump 65 is installed to circulate the ink between the sub-tank 780 and the liquid chamber 22Kr. Within the ink flow channel 66, a pump valve 69 is installed to open and close the ink flow channel 64. On the other hand, within the ink flow channel 64, a standby valve 67 is installed to open and close the ink flow channel 64 at a predetermined timing.

The operation of cleaning the printing head 22K is explained below.

The cleaning operation herein signifies an operation for maintaining the ink ejection performance of the printing head 22K, and this operation is conducted automatically or non-automatically when the lapse of ejection time or the ejection state comes to a predetermined condition or when the image quality becomes abnormal.

As shown by the flow chart in FIG. 36, the cleaning operation is started on reception of cleaning instructions (S3601). On receiving the cleaning instructions, the air-vent valve 84, the pump valve 69, and the standby valve 67 are opened successively (S3602-S3604). Then the circulation pump 65 is driven (rotated in the arrow-D direction) (S3605) to circulate the ink by pressure from the sub-tank 780 through the ink flow channel 64, the printing head 22K, the circulation pump 65 to return to the sub-tank 780. This ink flow caused by pressure flushes a bubble or bubbles accumulating at filter 91 in the side of the sub-tank 780 during the recording and other operations back into the sub-tank 780. During the circulation flow, the pressure in the liquid chamber 22Kr of the printing head 22K is made negative by the flow resistance of the ink flow channel 64. Therefore, the flow rate of the ink circulation by the circulation pump 65 should be limited to be less than a certain level not to suck external air through the nozzle face 22Ks of the printing head 22K (to retain the meniscuses).

Then, the rotation of the circulation pump 65 is reversed (in the arrow-E direction) (S3606) to force the ink to flow by pressure from the sub-tank 780 through the ink flow channel 66 to the printing head 22K. This ink flow caused by pressure flushes a bubble or bubbles built up in the side of the sub-tank 780 of a filter 90 during the recording and other operations back into the sub-tank 780.

After driving the circulation pump 65 for a certain time, the standby valve 67 is closed (S3607) to close (interrupt) the ink flow channel 64. Thereby a strong positive pressure is applied to the liquid chamber 22Kr of the printing head 22K. This strong positive pressure discharges the ink through the nozzles 22Kn of the printing head 22K to remove a foreign matter such as bubbles and dirt in and around the nozzle 22Kn.

Further, after a certain time, the circulation pump 65 is stopped (S3608), and the pump valve 69 and the air-vent valve 84 are closed successively (S3609, S3610). In this state, the face 22Ks of the nozzles 22Kn of the printing head 22K including the nozzle outlets of the printing head 22K is in an uncleaned state soiled by the ink. To remove the soiling matters, the face 22Ks is wiped with a wiper 52 fixed to the capping mechanism 50 (S3611, S3612). This wiping operation is already explained above, so that the detailed explanation thereon is omitted. After the wiping operation, the printing head 22K is brought again to the standby state (S3613).

The ink discharged from the printing head 22K (waste ink) is received by the recovery cap 54 and is sucked by a suction pump.

Example 13

Example 13 of the present invention is explained by reference to FIG. 37.

Figure 37:
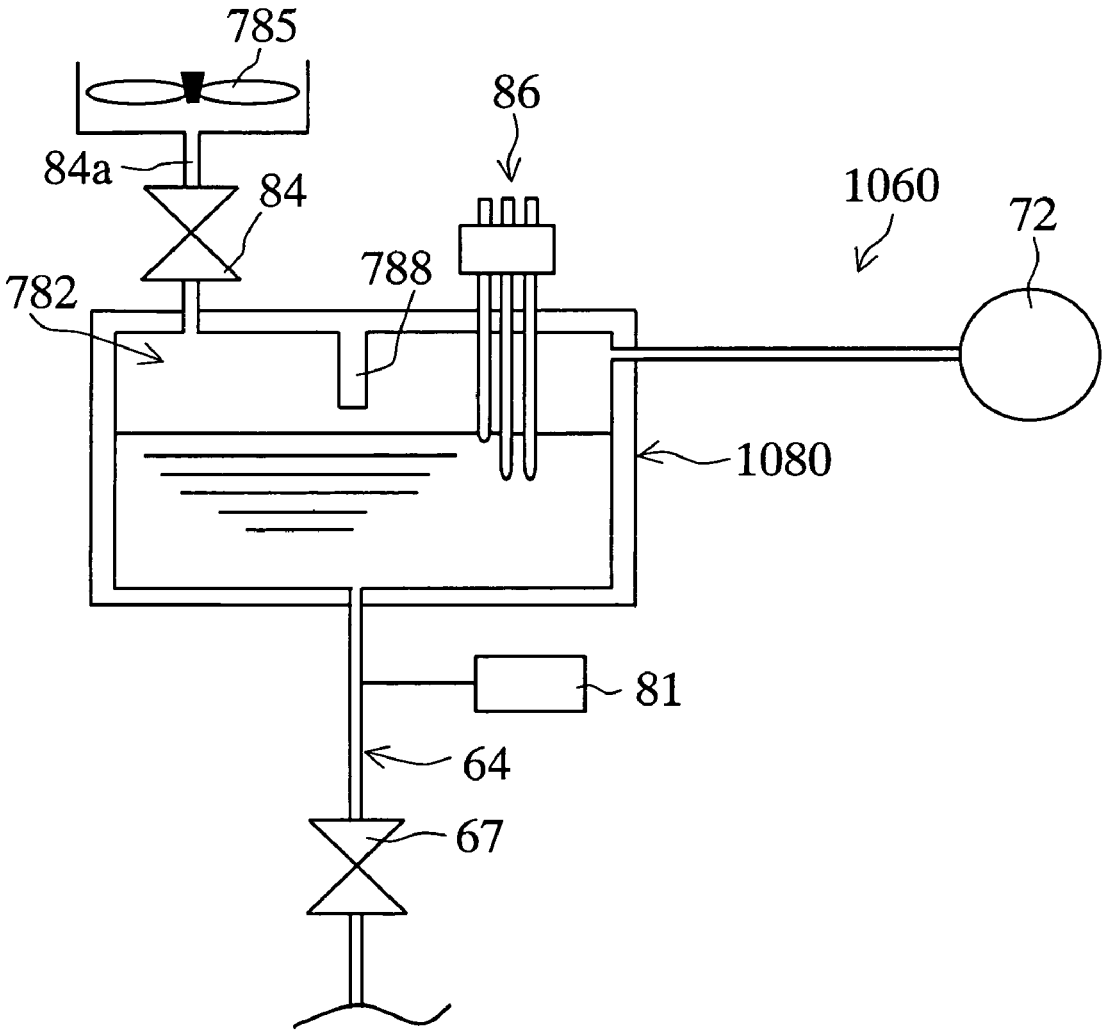
FIG. 37 illustrates schematically the sub-tank in Example 13.

FIG. 37 illustrates schematically a sub-tank of example 13. In FIG. 37 the same reference numbers and symbols as in FIG. 29 are used to indicate corresponding elements.

To the sub-tank 1080 in Example 13, an air fan 785 is installed at the top end of the air-vent pipe 84*a* outside the sub-tank 1080. The rotation of the air fan 785 allows the air to pass through the air-vent pipe 84*a* into or out of the room 782 to control the pressure in the room 782 to control thereby the negative pressure in the printing head 22K (FIG. 12).

Example 14

Example 14 of the present invention is explained by reference to FIG. 38.

Figure 38:
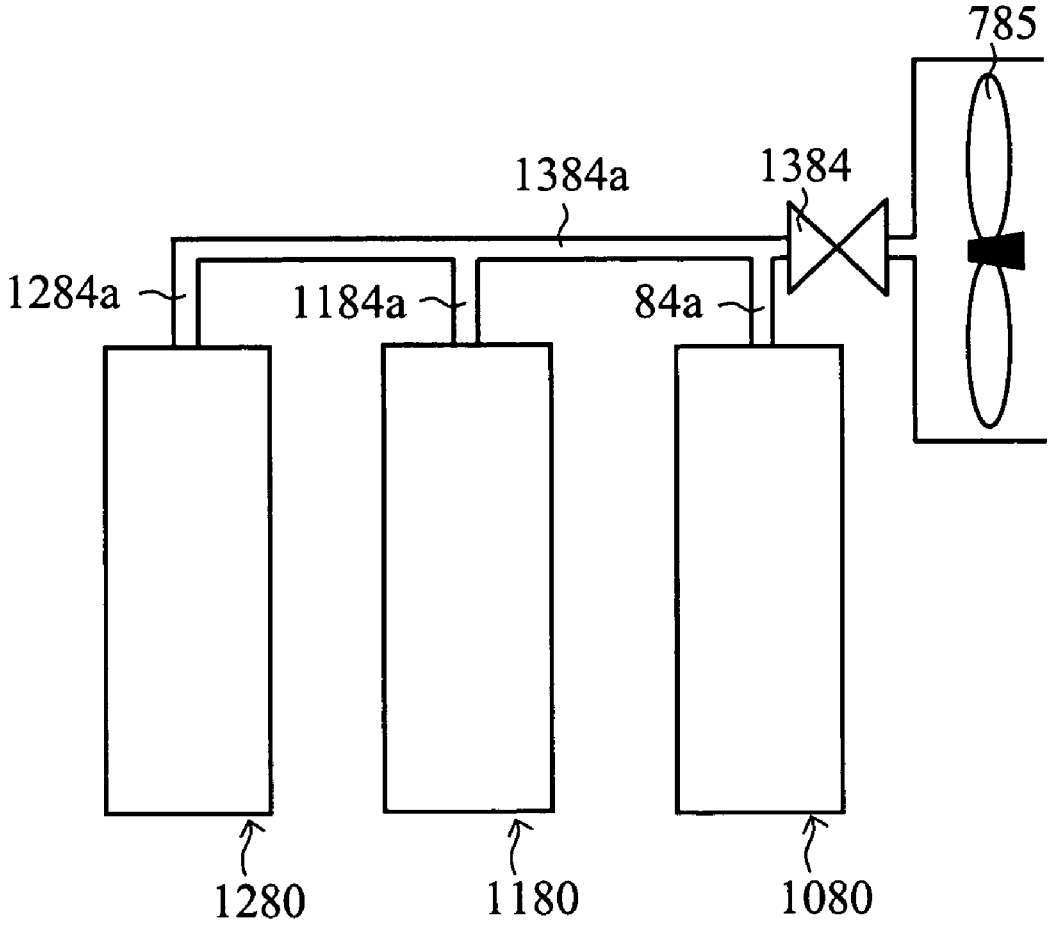
FIG. 38 illustrates schematically the sub-tank and an air fan of the printer employed in Example 14.

FIG. 38 illustrates schematically sub-tanks and an air fan of a printer of Example 14.

In the above Examples, one air fan 780 is installed for one sub-tank 780 (FIG. 29, etc.). In this Example 14, one air fan 785 is installed commonly for three sub-tanks 1080,1180, 1280 to control the pressure in the rooms 782 (FIG. 29, etc.) of the sub-tanks 1080,1180,1280.

The sub-tank 1080 has an air-vent pipe 84*a* for connecting the inside with the outside thereof. Similarly, the sub-tank 1180 has an air-vent pipe 1184*a* for connecting the inside with the outside thereof, and the sub-tank 1280 has an air-vent pipe 1284*a* for connecting the inside with the outside thereof. The air-vent pipes 84*a*,1184*a*,1284*a* are connected commonly to one air-vent pipe 1384*a*. This air-vent pipe 1384*a* is connected directly to the outside. The air-vent pipe 1384*a* has an air-vent valve 1384. An air fan 785 is installed at the top end of the air-vent pipe 1384*a* (a portion at the side of the air-vent valve 1384 opposite to the air-vent pipe 1384*a*). The rotation of the air fan 785 with the air-vent valve 1384 opened allows the air to pass through the air-vent pipes 84*a*,1184*a*, 1284*a*,1384*a* to enable control of the pressure in the rooms 782 (FIG. 29, etc.) to control the negative pressures applied to the printing heads connected respectively to the sub-tanks 1080,1180,1280. In the above examples, three sub-tanks are connected to one air fan, but two, or four or more of the sub-tank may be employed.

Figure 39:
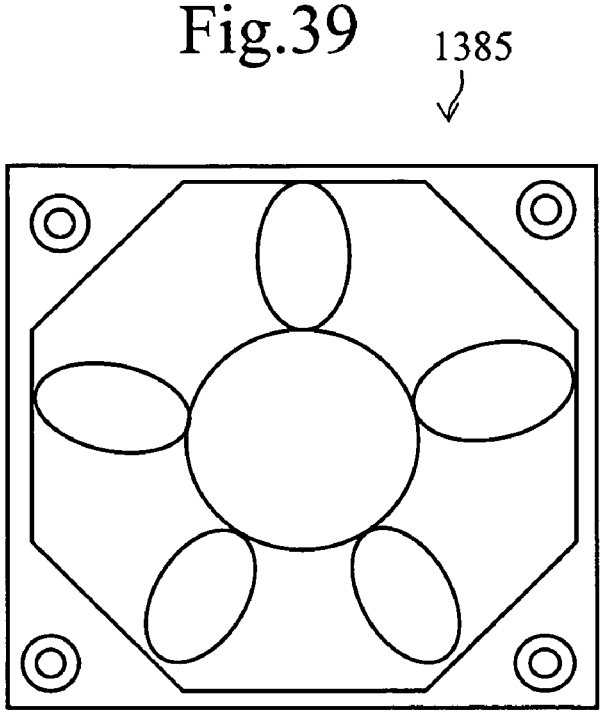
FIG. 39(*a*) is a plan view of an axial blower.
Figure 39:
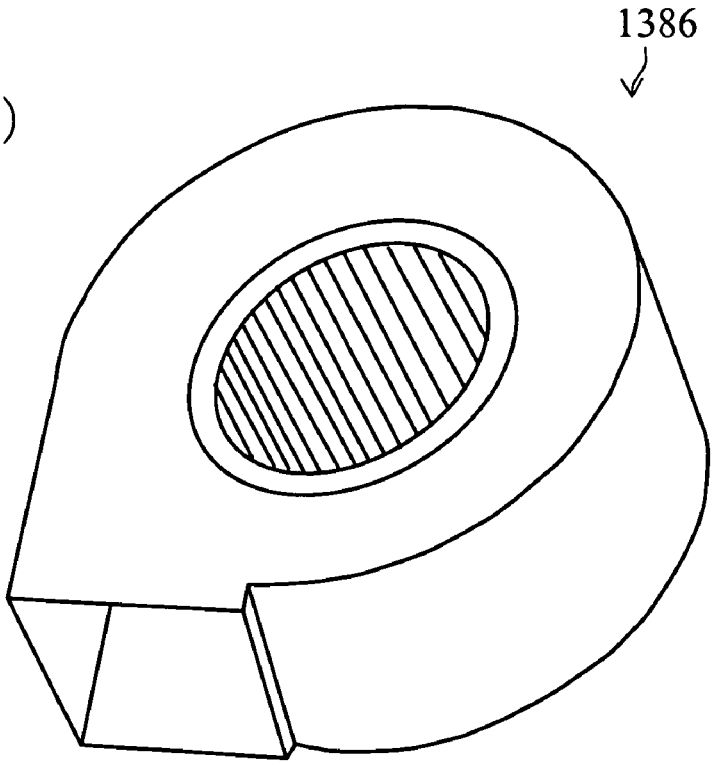

The above-mentioned air fan 785 may be an axial flow fan 1385 shown in a plan view in FIG. 39(*a*), or a sirocco fan 1386 shown in a perspective view in FIG. 39(*b*). Any system capable of applying a pressure to the air in the sub-tank and exerting this pressure to the printing head is included in the present invention.

The explanation is made above by reference to examples of inkjet recording heads (printing heads) of a so-called a bubble jet recording system which utilizes thermal energy generated by a heat-generating element for ink ejection. However, the present invention is applicable obviously to inkjet recording heads of other systems (e.g., a system employing a piezo element). Further, the mechanical constitution of the inkjet-type image-forming apparatus of the present invention may be a serial recording system which forms an image by moving a carriage having a printing head, or a full-line recording system which forms an image by use of a recording head having a breadth corresponding to the breadth of the recording medium by moving the recording medium.

The present invention includes any system which has an ink circulation path comprising a circulation pump and applies the negative pressure generated by the pressure loss caused by ink circulation by driving the circulation pump. The explanation is made above by reference to examples of inkjet recording heads (printing heads) of a so-called a bubble jet recording system which utilizes thermal energy generated by a heat-generating element for ink ejection. However, the present invention is applicable obviously to inkjet recording heads of other systems (e.g., a system employing a piezo element).

Further, the mechanical constitution of the inkjet-type image-forming apparatus may be a serial recording system which forms an image by moving a carriage having a printing head, or a full-line recording system which forms an image by use of a recording head of a breadth corresponding to the breadth of the recording medium by moving the recording medium.

The invention claimed is:

1. An ink-feeding device comprising
- an ink tank for holding an ink;
- a nozzle placed to be lower than the surface of the ink held in the tank;
- an air-vent pipe for communicating an upper space in the ink tank with the open air;
- an ink flow channel for connecting ink tank with the nozzle;
- a pressure sensor connected to the ink flow channel for sensing the pressure in the ink flow channel; and
- a pressure-controlling means for discharging the air from the upper space through the air-vent pipe to control the pressure in the nozzle to be at a prescribed pressure lower than the atmospheric pressure.

2. The ink-feeding device according to claim 1, wherein the pressure-controlling means is placed in the upper space.

3. The ink-feeding device according to claim 2, comprising a liquid chamber formed therein for holding the ink to be fed to the nozzle, and the ink tank is a sub-tank for feeding the ink to the liquid chamber.

4. The ink-feeding device according to claim 2, wherein the pressure-controlling means controls the pressure in the upper space depending on the amount of the ink ejected per unit time during image formation.

5. The ink-feeding device according to claim 1, wherein the pressure-controlling means is placed outside the ink tank, and is connected to the air-vent pipe.

6. The ink-feeding device according to claim 5, comprising a liquid chamber formed therein for holding the ink to be fed to the nozzle, and the ink tank is a sub-tank for feeding the ink to the liquid chamber.

7. The ink-feeding device according to claim 5, wherein the pressure-controlling means controls the pressure in the upper space depending on the amount of the ink ejected per unit time during image formation.

8. The ink-feeding device according to claim 5, wherein the ink tank is installed in plurality, and to the respective ink tanks, an air-vent pipe is attached, and the pressure-controlling means is connected to the respective air-vent pipes attached to the ink tanks.

9. The ink-feeding device according to claim 8, comprising a liquid chamber formed therein for holding the ink to be fed to the nozzle, and the ink tank is a sub-tank for feeding the ink to the liquid chamber.

10. The ink-feeding device according to claim 8, wherein the pressure-controlling means controls the pressure in the upper space depending on the amount of the ink ejected per unit time during image formation.

11. The ink-feeding device according to claim 1, further comprising a liquid chamber formed therein for holding the ink to be fed to the nozzle, and the ink tank is a sub-tank for feeding the ink to the liquid chamber.

12. The ink-feeding device according to claim 11, wherein the pressure-controlling means controls the pressure in the upper space depending on the amount of the ink ejected per unit time during image formation.

13. The ink-feeding device according to claim 11, wherein the ink-feeding device has an ink circulation channel for connecting the liquid chamber and the ink tank, and a circulation pump for circulating the ink through the ink circulation channel.

14. The ink-feeding device according to claim 13, wherein the ink circulation channel is constituted of two separate ink flow channels connecting the liquid chamber and the ink tank, and the circulation pump is installed within at least one of the two ink flow channels.

15. The ink-feeding device according to claim 14, wherein the circulation pump serves to circulate the ink in any of normal and reverse directions.

16. The ink-feeding device according to claim 13, wherein the circulation pump serves to circulate the ink in any of normal and reverse directions.

17. The ink-feeding device according to claim 1, wherein the pressure-controlling means controls the pressure in the upper space depending on the amount of the ink ejected per unit time during image formation.

18. The ink-feeding device according to claim 17, wherein the ink-feeding device has an ink circulation channel for connecting the liquid chamber and the ink tank, and a circulation pump for circulating the ink through the ink circulation channel.

19. The ink-feeding device according to claim 1, wherein the pressure-controlling means controls the pressure in the upper space depending on the pressure detected by the pressure sensor for detecting the pressure in the ink flow channel.

20. The ink-feeding device according to claim 19, wherein the ink-feeding device has an ink circulation channel for connecting the liquid chamber and the ink tank, and a circulation pump for circulating the ink through the ink circulation channel.

21. The ink-feeding device according to claim 1, wherein the printing head has a liquid chamber formed therein for holding the ink to be fed to the nozzle, and the ink tank is a sub-tank for feeding the ink to the liquid chamber.

22. The ink-feeding device according to claim 1, wherein the pressure-controlling means controls the pressure in the upper space depending on the amount of the ink ejected per unit time during image formation.

23. An ink-feeding device comprising an ink tank for holding an ink, the ink having a surface;

a nozzle placed to be lower than the surface of the ink held in the tank for ejecting the ink;

an air-vent pipe for communicating the upper space in the ink tank with the open air;

an ink flow channel for connecting ink tank with the nozzle;

a pressure sensor connected to the ink flow channel for sensing the pressure in the ink flow channel; and and a pressure-controlling means for discharging the air from the upper space through the air-vent pipe to control the pressure in the nozzle to be at a prescribed pressure lower than the atmospheric pressure;

wherein the pressure-controlling means comprises an air-fan for controlling the pressure in the nozzle to be within a prescribed range, by increasing the rotation speed of the air-fan when the pressure in the nozzle is higher than the prescribed pressure range, or by decreasing the rotation speed of the air-fan when the pressure in the nozzle is lower than the prescribed range, or by keeping the rotation speed of the air-fan when the pressure is within the prescribed range.

24. The ink-feeding device according to claim 23, comprising a liquid chamber formed therein for holding the ink to be fed to the nozzle, and the ink tank is a sub-tank for feeding the ink to the liquid chamber.

25. The ink-feeding device according to claim 23, wherein the pressure-controlling means controls the pressure in the upper space depending on the amount of the ink ejected per unit time during image formation.

* * * * *